US007340188B2

(12) United States Patent
Yamada et al.

(10) Patent No.: US 7,340,188 B2
(45) Date of Patent: Mar. 4, 2008

(54) IMAGE FORMING APPARATUS AND SYSTEM CONTAINING DETACHABLE DEVELOPER CONTAINERS

(75) Inventors: Yoichi Yamada, Nagano-ken (JP); Keiichi Taguchi, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/454,891

(22) Filed: Jun. 19, 2006

(65) Prior Publication Data

US 2006/0239698 A1 Oct. 26, 2006

Related U.S. Application Data

(62) Division of application No. 10/807,399, filed on Mar. 24, 2004, now Pat. No. 7,085,520.

(30) Foreign Application Priority Data

Mar. 25, 2003 (JP) ..... 2003-083343
Mar. 25, 2003 (JP) ..... 2003-083344
Mar. 25, 2003 (JP) ..... 2003-083345
Apr. 17, 2003 (JP) ..... 2003-112771

(51) Int. Cl.
*G03G 15/00* (2006.01)

(52) U.S. Cl. ..... 399/12; 399/227

(58) Field of Classification Search ..... 399/12, 399/227

See application file for complete search history.

(56) References Cited

U.S. PATENT DOCUMENTS 5,587,783 A 12/1996 Nakamura et al.
5,640,654 A 6/1997 Yoshizawa
5,799,228 A 8/1998 Iwata et al.
5,839,031 A 11/1998 Waterschool et al.
5,918,092 A 6/1999 Hama
6,023,599 A 2/2000 Matsuzaka et al.
6,069,641 A 5/2000 Matsuno et al.
6,184,909 B1 2/2001 Matsuno et al.
6,324,352 B1 11/2001 Suzuki
6,327,449 B1 12/2001 Matsuzaki
6,345,160 B1 2/2002 Matsuo et al.

(Continued)

FOREIGN PATENT DOCUMENTS

JP 8-227199 9/1996

(Continued)

OTHER PUBLICATIONS

Computer Translation of JP11-084807A.*

*Primary Examiner*—Quana Grainger
(74) *Attorney, Agent, or Firm*—Sughrue Mion, PLLC

(57) ABSTRACT

An image forming apparatus comprises a rotatable rotating body to and from which a plurality of developer containers can be attached and detached, each of the developer containers being capable of containing developer of a different color. When the image forming apparatus continuously forms images on a plurality of number of sheets of media using the developer of a single color contained in one of the developer containers attached to the rotating body, the image forming apparatus causes rotational movement of the rotating body at least once at least either when the image forming apparatus starts to continuously form the images, or when the image forming apparatus ends the continuous formation of the images.

18 Claims, 34 Drawing Sheets

U.S. PATENT DOCUMENTS

| | | | |
|---|---|---|---|
| 6,763,202 | B2 | 7/2004 | Maeda |
| 6,889,024 | B2 | 5/2005 | Shiraki et al. |
| 2004/0146316 | A1 | 7/2004 | Yamada et al. |
| 2005/0025513 | A1 | 2/2005 | Ichikawa et al. |

FOREIGN PATENT DOCUMENTS

| | | | |
|---|---|---|---|
| JP | 8-305117 | | 11/1996 |
| JP | 9-48458 | A | 2/1997 |
| JP | 9-244860 | | 9/1997 |
| JP | 11-125969 | A | 5/1999 |
| JP | 11-84807 | | 9/1999 |
| JP | 2000-75592 | A | 3/2000 |
| JP | 2000-172035 | A | 6/2000 |
| JP | 2000-347499 | A | 12/2000 |
| JP | 2002-333756 | A | 11/2002 |

* cited by examiner

| | N number of sheets(sheets) | start (times) | middle (times) | end (times) | total M (times) | M/N (times/sheet) |
|---|---|---|---|---|---|---|
| present example | 100 | 1.5 | 2 | 1.5 | 5 | 0.05 |
| | 40 | 1.5 | 0 | 1.5 | 3 | 0.075 |
| compara-tive example | 100 | 0.5 | 2 | 0.5 | 3 | 0.03 |
| | 40 | 0.5 | 0 | 0.5 | 1 | 0.025 |

FIG. 8

IMAGE FORMING APPARATUS AND SYSTEM CONTAINING DETACHABLE DEVELOPER CONTAINERS

CROSS-REFERENCE TO RELATED APPLICATIONS

This application is a divisional of application Ser. No. 10/807,399 filed on Mar. 24, 2004, now U.S. Pat. No. 7,085,520 which is a utility application. Also the present application claims priority upon Japanese Patent Application No. 2003-83343 filed Mar. 25, 2003, Japanese Patent Application No. 2003-83344 filed Mar. 25, 2003, Japanese Patent Application No. 2003-83345 filed Mar. 25, 2003, and Japanese Patent Application No. 2003-112771 filed Apr. 17, 2003, the contents of which are herein incorporated by reference.

BACKGROUND OF THE INVENTION

1. Field of the Invention

The present invention relates to developing devices, image forming apparatuses, and image forming systems.

2. Description of the Related Art (1) As one type of image forming apparatus, there is known an apparatus comprising, for example, a rotary-type developing device. The rotary-type developing device comprises a plurality of developing units, which serve as an example of a developer container for developing a latent image formed on a photoconductor using toner, and these developing units are arranged radially about the axis of rotation of the developing device. When an image signal is transmitted from an external device such as a host computer, the image forming apparatus rotates the developing units about the axis of rotation to thereby locate one of the developing units in a developing position opposing the photoconductor. A toner image is formed by developing the latent image formed on the photoconductor, and the image is transferred to an intermediate medium. The image forming apparatus sequentially changes the developing units and repeats the developing and transferring in a similar manner to superimpose a plurality of toner images and thereby form a color image.

There are cases in which the above-described image forming apparatus is used for continuously forming images on a plurality of number of sheets of media using toner of a single color (for example, monochrome). In this continuous image-forming process according to the monochrome image-forming mode, development is carried out using the same developing unit for a long time. Therefore, the developing units will not be subjected to rotation for a long time, in contrast to the case in which color images are formed.

In such a situation, the toner contained in the developing units settles out in the direction of gravity. The settlement of toner causes deterioration in toner flowability. This deterioration in toner flowability causes various problems. For example, the deterioration in toner flowability gives rise to insufficient charging of toner, and as a consequence, it causes a problem that desired images cannot be obtained.

A countermeasure has been proposed in order to avoid such problems. (See, for example, Japanese Patent Application Laid-open Publication No. 2000-347499.) In this method, when images are to be continuously formed on a plurality of number of sheets of media using toner of a single color (for example, monochrome), the developing units are rotated during the continuous image-formation every time the number of sheets of media on which images are formed reaches, for example, a predetermined number of sheets, in order to enhance the flowability of toner.

By adopting the above-described method for enhancing the toner flowability, it is possible to obtain a desired effect if the number of sheets of media on which images are continuously formed is larger than the above-mentioned predetermined number of sheets. If, however, the number of sheets of media on which images are continuously formed is smaller than the predetermined number of sheets, then the following problem arises. An example of such problem is described below.

For example, suppose that the predetermined number of sheets is 48 sheets. When images are continuously formed on 100 sheets of media, then the developing units will be rotated twice during the continuous image-forming process, and thus, the toner flowability will be enhanced. If, however, images are continuously formed on only 40 sheets of media, then the developing units will not be rotated during the continuous image-forming process. Therefore, if the operation of continuously forming images on 40 sheets of media is repeated for several times, then the toner flowability will deteriorate. There will be a more significant deterioration in toner flowability particularly when the number of sheets of media on which images are continuously formed is close to the predetermined number of sheets.

Therefore, there is a need for another method for avoiding the problems caused by deterioration in toner flowability.

(2) As another type of image forming apparatus, there is known an apparatus comprising, for example, a rotary-type developing device. The rotary-type developing device comprises a plurality of developing units, which serve as an example of a developer container for developing a latent image formed on a photoconductor using toner, which serves as an example of developer, and these developing units are arranged radially about the axis of rotation of the developing device. When an image signal is transmitted from an external device such as a host computer, the image forming apparatus rotates the developing units about the axis of rotation to thereby locate one of the developing units in a developing position opposing the photoconductor. A toner image is formed by developing the latent image formed on the photoconductor using the toner bore by a developing roller, which serves as an example of a developer bearing body, and the image is transferred to an intermediate medium. The image forming apparatus sequentially changes the developing units and repeats the developing and transferring in a similar manner to superimpose a plurality of toner images and thereby form a color image.

There are cases in which the above-described image forming apparatus is used for continuously forming images on a plurality of number of sheets of media using toner of a single color (for example, monochrome). In this continuous image-forming process according to the monochrome image-forming mode, development is carried out using the same developing unit for a long time. Therefore, the developing units will not be subjected to rotation for a long time, in contrast to the case in which color images are formed.

If the latent image, which is formed on the photoconductor, is continuously developed using the toner bore by the developing roller in the above-described state in which a developing unit is not rotated for a long time, then the amount of electrical charge of the toner, out of all the toner contained in the developing unit, that is near the developing roller increases excessively. This increase in the amount of electrical charge of toner causes, for example, agglomeration of toner, which gives rise to problems such as image fogging, toner scattering, and toner spilling. Forming images with toner that is in such an inappropriate state will ultimately result in causing a problem that desired images cannot be obtained.

A countermeasure has been proposed in order to avoid such problems. (See, for example, Japanese Patent Application Laid-open Publication No. 2000-347499.) In this method, when images are to be continuously formed on a plurality of number of sheets of media using toner of a single color, the developing units are rotated at a predetermined frequency.

However, since it is not possible to carry out development while the developing units are rotating, there is a disadvantage that the amount of time required for forming images becomes long when the above-described method is employed.

(3) As another type of image forming apparatus, there is known an apparatus comprising, for example, a movable moving member. The movable moving member comprises developing units, which serve as an example of a developer container for developing a latent image formed on a photoconductor using developer. When an image signal is transmitted from an external device such as a host computer, the image forming apparatus moves the developing units to thereby locate the developing units at a developing position opposing the photoconductor. A developer image is formed by developing the latent image formed on the photoconductor, and the image is temporarily transferred to an intermediate medium. The developer image formed on the intermediate transferring body is then transferred onto a medium to form an image thereon. Further, the developing units are configured so that they can be attached to and detached from the moving body. Upon detachment of a developing unit, the moving body moves to a predetermined detachment position, enabling the operator to detach the developing unit. (See, for example, Japanese Patent Application Laid-open Publication No. 11-125969.).

There are cases in which the developer, which is contained in each developing unit described above, spills out from the developing unit and the developer that has spilled adheres to the developing unit. If the operator detaches the developing unit with the developer adhering to it, then the developer on the developing unit may get on the hands of the operator and contaminate his/her hands, or the developer on the developing unit may spill and contaminate the operator or the places around him/her.

(4) As another type of image forming apparatus, there is known an apparatus comprising, for example, an image bearing body for bearing a latent image, and a developing device for developing the latent image bore on the image bearing body with developer. When an image signal is transmitted from an external device such as a host computer, the image forming apparatus moves the developing device to thereby locate the developing device at a developing position opposing the image bearing body. A developer image is formed by developing the latent image formed on the image bearing body, and the image is temporarily transferred to an intermediate medium. The developer image formed on the intermediate transferring body is then transferred onto a medium to form an image thereon. Further, the developing device includes a developer bearing body for bearing the developer, an abutting member that abuts against the developer bearing body, an opposing member that is arranged in opposition to the abutting member on the side opposite from the developer bearing body with respect to the abutting member, and a sealing member for preventing the developer from spilling from between the abutting member and the opposing member. (See, for example, Japanese Patent Application Laid-open Publication No. 9-48458.)

In the above-mentioned case, the sealing member described above is arranged bonded to one of either the abutting member or the opposing member, for example. In such a case, it is necessary to provide the sealing member in the developing device in such a state that the sealing member is highly compressed by the abutting member and the opposing member in order to appropriately prevent the developer from spilling from between the abutting member and the opposing member (particularly from between the sealing member and the member to which the sealing member is not bonded).

In such a situation, the abutting member receives a great force from the compressed sealing member. Therefore, a problem that the functions to be achieved by the abutting member abutting against the developer bearing body are not obtained appropriately may arise.

For example, when a thickness restricting member for restricting the thickness of the layer of the developer bore by the developer bearing body serves as the abutting member, there is a possibility that an excessive restriction load is applied on the thickness restricting member and that it will become difficult to restrict the layer thickness of the developer appropriately. Further, when a developer collecting member for collecting the developer bore by the developer bearing body into the developing device serves as the abutting member, there is a possibility that it will become difficult to collect the developer into the developing device appropriately.

SUMMARY OF THE INVENTION

The present invention has been made in view of the above and other problems.

(1) An object of the present invention is to provide an image forming apparatus and an image forming system that are capable of avoiding the problems caused by deterioration in toner flowability.

(2) Another object of the present invention is to provide an image forming apparatus and an image forming system that allow to maintain the developer in an appropriate state while reducing the decrease in image-forming speed.

(3) Another object of the present invention is to provide an image forming apparatus and an image forming system that prevent contamination caused by developer upon detachment of a developer container.

(4) Another object of the present invention is to provide a developing device, an image forming apparatus, and an image forming system that allow the functions of an abutting member that abuts against a developer bearing body to be achieved effectively and that appropriately prevent the developer from spilling.

(1) A first aspect of the present invention is an image forming apparatus comprising a rotatable rotating body to and from which a plurality of developer containers can be attached and detached, each of the developer containers being capable of containing developer of a different color. When the image forming apparatus continuously forms images on a plurality of number of sheets of media using the developer of a single color contained in one of the developer containers attached to the rotating body, the image forming apparatus causes rotational movement of the rotating body at least once at least either when the image forming apparatus starts to continuously form the images, or when the image forming apparatus ends the continuous formation of the images.

(2) A second aspect of the present invention is an image forming apparatus comprising a rotatable rotating body to and from which a plurality of developer containers can be attached and detached, each of the developer containers being capable of containing developer of a different color. The image forming apparatus causes rotational movement of the rotating body at a predetermined frequency when the image forming apparatus continuously forms images on a plurality of number of sheets of media using the developer of a single color contained in one of the developer containers attached to the rotating body, and the predetermined frequency after a number of sheets of media on which the images have been continuously formed has reached a predetermined number of sheets is higher than the predetermined frequency before the number of sheets reaches the predetermined number of sheets.

(3) A third aspect of the present invention is an image forming apparatus comprising a movable moving body to and from which a developer container for containing developer can be attached and detached. Upon detachment of the developer container that is attached to the moving body, the image forming apparatus temporarily halts the moving body at least once while the moving body moves to a predetermined detachment position at which the developer container can be detached.

(4) A fourth aspect of the present invention is a developing device comprising: a developer bearing body for bearing developer; an abutting member that abuts against the developer bearing body; an opposing member that is arranged in opposition to the abutting member on a side opposite from the developer bearing body with respect to the abutting member; and a sealing member that is for preventing the developer from spilling from between the abutting member and the opposing member, and that is bonded to both the abutting member and the opposing member.

Features and objects of the present invention other than the above will become clear by reading the description of the present specification with reference to the accompanying drawings.

BRIEF DESCRIPTION OF THE DRAWINGS

In order to facilitate further understanding of the present invention and the advantages thereof, reference is now made to the following description taken in conjunction with the accompanying drawings wherein:

FIG. 8 is an explanatory diagram for illustrating the toner stirring effect obtained by the rotational movement of the YMCK developing device 50;

DETAILED DESCRIPTION OF THE INVENTION

Figure 1:
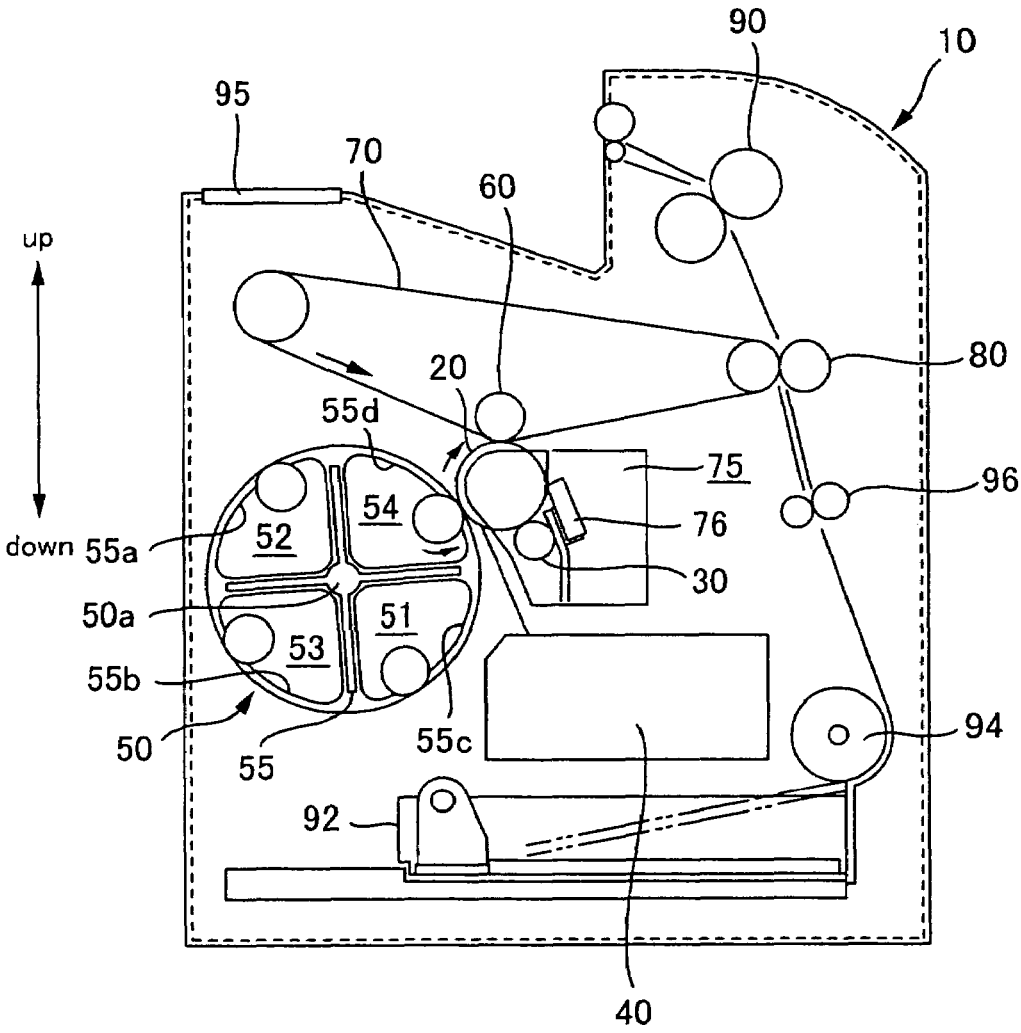
FIG. 1 is a diagram showing main structural components constructing an image forming apparatus according to one embodiment.

At least the following matters will be made clear by the explanation in the present specification and the description of the accompanying drawings.

<<<First Aspect>>>

An image forming apparatus comprises a rotatable rotating body to and from which a plurality of developer containers can be attached and detached, each of the developer containers being capable of containing developer of a different color. When the image forming apparatus continuously forms images on a plurality of number of sheets of media using the developer of a single color contained in one of the developer containers attached to the rotating body, the image forming apparatus causes rotational movement of the rotating body at least once at least either when the image forming apparatus starts to continuously form the images, or when the image forming apparatus ends the continuous formation of the images.

It is possible to avoid problems caused by deterioration in developer flowability by rotating the rotating body at least once at least either when the continuous image formation is started or when the continuous image formation is ended if the image forming apparatus continuously forms images on a plurality of number of sheets of media using the developer of a single color.

Further, when the image forming apparatus continuously forms the images on the plurality of number of sheets of media using the developer of the single color, the image forming apparatus may cause rotational movement of the rotating body every time a number of sheets of media on which the images have been formed reaches a predetermined number of sheets.

In this way, it becomes possible to reduce the deterioration in developer flowability more appropriately, and therefore, it is possible to avoid the problems caused by such deterioration more certainly.

Further, the image forming apparatus may temporarily halt the rotating body at least once during rotational movement of the rotating body.

In this way, stirring of the developer is carried out more effectively, and therefore, it becomes possible to reduce the deterioration in developer flowability more appropriately.

Further, the developer container may include: a developer bearing body for bearing the developer; and a developer supplying member for supplying the developer to the developer bearing body.

In such a situation, the developer-stirring effect, which is obtained by rotating the rotating body at least once at least either when the continuous image formation is started or when the continuous image formation is ended, becomes more important in terms of preventing the characteristics of the developer from being polarized into two. Therefore, the object of the present invention is achieved more effectively.

Further, the image forming apparatus may further comprise an image bearing body for bearing a latent image; the rotating body may have a rotating shaft at the center of the rotating body; and the direction from the developer container, which is attached to the rotating body and which contains the developer of the single color, towards the rotating shaft when the image forming apparatus temporarily halts the rotating body during rotational movement of the rotating body may be in the direction from the rotating shaft towards the developer container that contains the developer of the single color when the rotating body is positioned at a predetermined developing position for developing the latent image with the developer of the single color bore by the developer bearing body.

With such a configuration, the developer which has settled out in the direction of gravity upon development will be dissolved more appropriately.

Further, the developer container may include a partitioning wall that is for partitioning the developer and that protrudes inward from an inner wall of the developer container, and two developer containing sections formed by partitioning the developer container with the partitioning wall; and the developer supplying member may be provided in one of the two developer containing sections.

In such a situation, the developer-stirring effect, which is obtained by rotating the rotating body at least once at least either when the continuous image formation is started or when the continuous image formation is ended, becomes even more important. Therefore, the object of the present invention is achieved more effectively.

Further, when the image forming apparatus temporarily halts the rotating body during rotational movement of the rotating body, an angle formed between a protruding direction of the partitioning wall of the developer container that is attached to the rotating body and that contains the developer of the single color and a vertically downward direction may be smaller than 90°.

With such a configuration, the developer contained in both of the two developer containing sections will be mixed more easily, and therefore, stirring of the developer will be carried out appropriately.

Further, a halt position of the rotating body for when the image forming apparatus temporarily halts the rotating body during rotational movement of the rotating body may be a standby position of the rotating body for when the image forming apparatus is on standby for formation of an image to be carried out.

With such a configuration, it becomes possible to obtain an appropriate developer-stirring effect even when the apparatus is on standby for image formation to be carried out.

Further, the developer of the single color may be black developer.

The importance of the present invention increases when the single-color developer is black developer, because black developer is often used as the single-color developer when images are continuously formed on a plurality of number of sheets of media using single-color developer. Therefore, the object of the present invention is achieved more effectively.

Further, the developer container does not have to be provided with a stirring member for stirring the developer.

The importance of the present invention increases when a stirring member is not provided. Therefore, the object of the present invention is achieved more effectively.

It is also possible to provide an image forming apparatus comprising a rotatable rotating body to and from which a plurality of developer containers can be attached and detached, each of the developer containers being capable of containing developer of a different color, wherein: when the image forming apparatus continuously forms images on a plurality of number of sheets of media using the developer of a single color contained in one of the developer containers attached to the rotating body, the image forming apparatus causes rotational movement of the rotating body at least once at least either when the image forming apparatus starts to continuously form the images, or when the image forming apparatus ends the continuous formation of the images; when the image forming apparatus continuously forms the images on the plurality of number of sheets of media using the developer of the single color, the image forming apparatus causes rotational movement of the rotating body every time a number of sheets of media on which the images have been formed reaches a predetermined number of sheets; the image forming apparatus temporarily halts the rotating body at least once during rotational movement of the rotating body; the developer container includes a developer bearing body for bearing the developer, and a developer supplying member for supplying the developer to the developer bearing body; the image forming apparatus further comprises an image bearing body for bearing a latent image; the rotating body has a rotating shaft at the center of the rotating body; when the image forming apparatus temporarily halts the rotating body during rotational movement of the rotating body, the direction from the developer container that is attached to the rotating body and that contains the developer of the single color towards the rotating shaft is in the direction from the rotating shaft towards the developer container that contains the developer of the single color when the rotating body is positioned at a predetermined developing position for developing the latent image with the developer of the single color bore by the developer bearing body; the developer container includes a partitioning wall that is for partitioning the developer and that protrudes inward from an inner wall of the developer container, and two developer containing sections formed by partitioning the developer container with the partitioning wall; the developer supplying member is provided in one of the two developer containing sections; when the image forming apparatus temporarily halts the rotating body during rotational movement of the rotating body, an angle formed between a protruding direction of the partitioning wall of the developer container that is attached to the rotating body and that contains the developer of the single color and a vertically downward direction is smaller than 90°; a halt position of the rotating body for when the image forming apparatus temporarily halts the rotating body during rotational movement of the rotating body is a standby position of the rotating body for when the image forming apparatus is on standby for formation of an image to be carried out; the developer of the single color is black developer; and the developer container is not provided with a stirring member for stirring the developer.

The object of the present invention is achieved most effectively because in this way, almost all of the effects mentioned above can be obtained.

It is also possible to provide an image forming apparatus comprising a rotatable rotating body that is provided with a plurality of developer containers, each of the developer containers being capable of containing developer of a different color, wherein, when the image forming apparatus continuously forms images on a plurality of number of sheets of media using the developer of a single color contained in one of the developer containers, the image forming apparatus causes rotational movement of the rotating body at least once at least either when the image forming apparatus starts to continuously form the images, or when the image forming apparatus ends the continuous formation of the images.

It is also possible to provide an image forming system comprising: a computer; a display device that is connectable to the computer; and an image forming apparatus, wherein the image forming apparatus is connectable to the computer, the image forming apparatus includes a rotatable rotating body to and from which a plurality of developer containers can be attached and detached, each of the developer containers being capable of containing developer of a different color, and when the image forming apparatus continuously forms images on a plurality of number of sheets of media using the developer of a single color contained in one of the developer containers attached to the rotating body, the image forming apparatus causes rotational movement of the rotating body at least once at least either when the image forming apparatus starts to continuously form the images, or when the image forming apparatus ends the continuous formation of the images.

As an overall system, the image forming system that is achieved in this way becomes superior to conventional systems.

<<<Second Aspect>>>

An image forming apparatus comprises a rotatable rotating body to and from which a plurality of developer containers can be attached and detached, each of the developer containers being capable of containing developer of a different color. The image forming apparatus causes rotational movement of the rotating body at a predetermined frequency when the image forming apparatus continuously forms images on a plurality of number of sheets of media using the developer of a single color contained in one of the developer containers attached to the rotating body, and the predetermined frequency after a number of sheets of media on which the images have been continuously formed has reached a predetermined number of sheets is higher than the predetermined frequency before the number of sheets reaches the predetermined number of sheets.

By setting the predetermined frequency after the number of sheets of media on which the images have been continuously formed has reached the predetermined number of sheets to be higher than the predetermined frequency before the number of sheets reaches the predetermined number of sheets, it becomes possible to maintain the developer in an appropriate state while reducing the decrease in image-forming speed.

Further, when the image forming apparatus continuously forms the images on the plurality of number of sheets of media using the developer of the single color, the image forming apparatus may cause rotational movement of the rotating body every time the number of sheets of media on which the images have been continuously formed reaches a unit number of sheets; and the unit number of sheets after the number of sheets of media on which the images have been continuously formed has reached the predetermined number of sheets may be smaller than the unit number of sheets before the number of sheets reaches the predetermined number of sheets.

By managing the predetermined frequency according to the number of sheets of media on which the images have been continuously formed in the case where the predetermined frequency after the number of sheets of media on which the images have been continuously formed has reached the predetermined number of sheets is set to be higher than the predetermined frequency before the number of sheets reaches the predetermined number of sheets, it becomes easy to manage the predetermined frequency.

Further, the rotational movement of the rotating body may be one revolution; and the image forming apparatus may temporarily halt the rotating body at least once during one revolution of the rotating body.

In this way, the developer is stirred more effectively. Therefore, it becomes possible to reduce deterioration in flowability of the developer more appropriately, and thus, it becomes possible to maintain the developer in an appropriate state even further.

Further, the developer container may include: a developer bearing body for bearing the developer; and a developer supplying member for supplying the developer to the developer bearing body.

In such a situation, stirring of the toner caused by rotating the rotating body becomes more important in terms of preventing the characteristics of the developer from being polarized into two. Therefore, the object of the present invention is achieved more effectively.

Further, the image forming apparatus may further comprise an image bearing body for bearing a latent image; the rotating body may have a rotating shaft at the center of the rotating body; and the direction from the developer container, which is attached to the rotating body and which contains the developer of the single color, towards the rotating shaft when the image forming apparatus temporarily halts the rotating body during one revolution of the rotating body may be in the direction from the rotating shaft towards the developer container that contains the developer of the single color when the rotating body is positioned at a predetermined developing position for developing the latent image with the developer of the single color bore by the developer bearing body.

With such a configuration, the developer which has settled out in the direction of gravity upon development will be dissolved more appropriately.

Further, the developer container may include a partitioning wall that is for partitioning the developer and that protrudes inward from an inner wall of the developer container, and two developer containing sections formed by partitioning the developer container with the partitioning wall; and the developer supplying member may be provided in one of the two developer containing sections.

In such a situation, stirring of the developer caused by rotating the rotating body becomes even more important. Therefore, the object of the present invention is achieved more effectively.

Further, when the image forming apparatus temporarily halts the rotating body during one revolution of the rotating body, an angle formed between a protruding direction of the partitioning wall of the developer container that is attached to the rotating body and that contains the developer of the single color and a vertically downward direction may be smaller than 90°.

With such a configuration, the developer contained in both of the two developer containing sections will be mixed more easily, and therefore, stirring of the developer will be carried out appropriately.

Further, a halt position of the rotating body for when the image forming apparatus temporarily halts the rotating body during one revolution of the rotating body may be a standby position of the rotating body for when the image forming apparatus is on standby for formation of an image to be carried out.

With such a configuration, it becomes possible to obtain an appropriate developer-stirring effect even when the apparatus is on standby for image formation to be carried out.

Further, the developer of the single color may be black developer.

The importance of the present invention increases when the single-color developer is black developer, because black developer is often used as the single-color developer when images are continuously formed on a plurality of number of sheets of media using single-color developer. Therefore, the object of the present invention is achieved more effectively.

Further, the developer container does not have to be provided with a stirring member for stirring the developer.

The importance of the present invention increases when a stirring member is not provided. Therefore, the object of the present invention is achieved more effectively.

It is also possible to provide an image forming apparatus comprising a rotatable rotating body to and from which a plurality of developer containers can be attached and detached, each of the developer containers being capable of containing developer of a different color, wherein: the image forming apparatus causes rotational movement of the rotating body at a predetermined frequency when the image forming apparatus continuously forms images on a plurality of number of sheets of media using the developer of a single color contained in one of the developer containers attached to the rotating body; the predetermined frequency after a number of sheets of media on which the images have been continuously formed has reached a predetermined number of sheets is higher than the predetermined frequency before the number of sheets reaches the predetermined number of sheets; when the image forming apparatus continuously forms the images on the plurality of number of sheets of media using the developer of the single color, the image forming apparatus causes rotational movement of the rotating body every time the number of sheets of media on which the images have been continuously formed reaches a unit number of sheets; the unit number of sheets after the number of sheets of media on which the images have been continuously formed has reached the predetermined number of sheets is smaller than the unit number of sheets before the number of sheets reaches the predetermined number of sheets; the rotational movement of the rotating body is one revolution; the image forming apparatus temporarily halts the rotating body at least once during one revolution of the rotating body; the developer container includes a partitioning wall that is for partitioning the developer and that protrudes inward from an inner wall of the developer container, and two developer containing sections formed by partitioning the developer container with the partitioning wall; when the image forming apparatus temporarily halts the rotating body during one revolution of the rotating body, an angle formed between a protruding direction of the partitioning wall of the developer container that is attached to the rotating body and that contains the developer of the single color and a vertically downward direction is smaller than 90°; the developer container includes a developer bearing body for bearing the developer, and a developer supplying member for supplying the developer to the developer bearing body; the developer supplying member is provided in one of the two developer containing sections; the image forming apparatus further comprises an image bearing body for bearing a latent image; the rotating body has a rotating shaft at the center of the rotating body; the direction from the developer container, which is attached to the rotating body and which contains the developer of the single color, towards the rotating shaft when the image forming apparatus temporarily halts the rotating body during one revolution of the rotating body is in the direction from the rotating shaft towards the developer container that contains the developer of the single color when the rotating body is positioned at a predetermined developing position for developing the latent image with the developer of the single color bore by the developer bearing body; a halt position of the rotating body for when the image forming apparatus temporarily halts the rotating body during one revolution of the rotating body is a standby position of the rotating body for when the image forming apparatus is on standby for formation of an image to be carried out; the developer of the single color is black developer; and the developer container is not provided with a stirring member for stirring the developer.

The object of the present invention is achieved most effectively because in this way, almost all of the effects mentioned above can be obtained.

It is also possible to provide an image forming apparatus comprising a rotatable rotating body that is provided with a plurality of developer containers, each of the developer containers being capable of containing developer of a different color, wherein: the image forming apparatus causes rotational movement of the rotating body at a predetermined frequency when the image forming apparatus continuously forms images on a plurality of number of sheets of media using the developer of a single color contained in one of the developer containers; and the predetermined frequency after a number of sheets of media on which the images have been continuously formed has reached a predetermined number of sheets is higher than the predetermined frequency before the number of sheets reaches the predetermined number of sheets.

It is also possible to provide an image forming system comprising: a computer; a display device that is connectable to the computer; and an image forming apparatus, wherein: the image forming apparatus is connectable to the computer; the image forming apparatus includes a rotatable rotating body to and from which a plurality of developer containers can be attached and detached, each of the developer containers being capable of containing developer of a different color; the image forming apparatus causes rotational movement of the rotating body at a predetermined frequency when the image forming apparatus continuously forms images on a plurality of number of sheets of media using the developer of a single color contained in one of the developer containers attached to the rotating body; and the predetermined frequency after a number of sheets of media on which the images have been continuously formed has reached a predetermined number of sheets is higher than the predetermined frequency before the number of sheets reaches the predetermined number of sheets.

As an overall system, the image forming system that is achieved in this way becomes superior to conventional systems.

<<<Third Aspect>>>

An image forming apparatus comprises a movable moving body to and from which a developer container for containing developer can be attached and detached. Upon detachment of the developer container that is attached to the moving body, the image forming apparatus temporarily halts the moving body at least once while the moving body moves to a predetermined detachment position at which the developer container can be detached.

By temporarily halting the moving body at least once while the moving body moves to the predetermined detachment position, it is possible to prevent contamination caused by the developer upon detachment of the developer container.

Further, the developer container may have a storage element for storing information about the developer container; and the image forming apparatus may carry out communication with the storage element when the image forming apparatus temporarily halts the moving body while the moving body moves to the predetermined detachment position.

In this way, time can be used efficiently, and thus, it becomes possible to reduce the amount of time for which the operator has to wait in order to carry out his/her developer-container detachment task.

Further, a movement speed at which the moving body moves to the predetermined detachment position may reach its maximum right before the image forming apparatus temporarily halts the moving body at least once.

In this way, the acceleration that is imparted on the developer adhering to the developer container when the moving body is temporarily halted while the moving body moves to the predetermined detachment position becomes larger. Therefore, it becomes easier to strip off, from the developer container, the developer adhering to the developer container.

Further, a plurality of the developer containers may be attached to and detached from the moving body, each of the developer containers being capable of containing developer of a different color; and the movement speed that has reached its maximum right before the image forming apparatus temporarily halts the moving body at least once may approximately be the same as a movement speed at which the moving body moves when an image is formed on a medium using the developers of the plurality of the different colors that are contained in the plurality of developer containers attached to the moving body.

In this way, the acceleration that is imparted on the developer adhering to the developer container when the moving body is temporarily halted while the moving body moves to the predetermined detachment position becomes larger. Therefore, it becomes easier to strip off, from the developer container, the developer adhering to the developer container.

Further, the moving body may be a rotatable rotating body; the rotating body may have a rotating shaft at the center of the rotating body, an axial direction of the rotating shaft intersecting with the vertical direction; and the developer container that is to be detached may be positioned lower, in the vertical direction, than the rotating shaft when the image forming apparatus temporarily halts the rotating body while the rotating body rotationally moves to the predetermined detachment position.

In this way, it is possible to certainly cause the developer that has been stripped off to fall towards the lower section, in the vertical direction, in the image forming apparatus when the developer adhering to the developer container is stripped off from the developer container.

Further, the image forming apparatus may further comprise a developer receiving member that is for receiving the developer and that is positioned at a lower side, in the vertical direction, of the rotating body.

In this way, the developer that has been stripped off from the developer container and that has fallen downwards in the image forming apparatus is received by the developer receiving member. Thus, a user or a service person can easily remove the fallen developer from the image forming apparatus.

Further, the developer container may have a developer bearing body for bearing the developer, and an opening towards which the developer bearing body faces; and the opening of the developer container that is to be detached may be positioned at a lower side, in the vertical direction, of the developer container when the image forming apparatus temporarily halts the rotating body while the rotating body rotationally moves to the predetermined detachment position.

In this way, it is possible to certainly cause the developer that has been stripped off to fall towards the lower section, in the vertical direction, in the image forming apparatus when the developer adhering to the developer container near its opening is stripped off from the developer container.

Further, the opening of the developer container that is to be detached may be positioned at an upper side, in the vertical direction, of the developer container when the rotating body has rotationally moved to the predetermined detachment position.

In this way, it is possible to detach the developer container without spilling the developer adhering to the developer container near its opening, even if the developer adhering to the developer container is not sufficiently stripped off therefrom and remains on the developer container.

Further, the developer container may include a developer charging member that is for electrically charging the developer bore by the developer bearing body and that has an abutting member that abuts against the developer bearing body and a supporting member for supporting the abutting member; the developer charging member may face the opening from the outside; and the supporting member may have a slide member on the surface thereof for causing the developer to slide.

In this way, it becomes easy to strip off, from the developer container, the developer adhering to the developer container.

Further, a halt position of the moving body for when the image forming apparatus temporarily halts the moving body while the moving body moves to the predetermined detachment position may be a standby position of the moving body for when the image forming apparatus is on standby for formation of an image to be carried out.

In this way, the standby position is also used as the halt position of the moving body where the developer is stripped off from the developer container, and thus, it becomes possible to avoid complication in structure of the image forming apparatus caused by providing a halt position anew.

Further, the moving body may be a rotatable rotating body; the rotating body may have a rotating shaft at the center of the rotating body, an axial direction of the rotating shaft intersecting with the vertical direction; a plurality of the developer containers may be attached to and detached from the rotating body, each of the developer containers being capable of containing developer of a different color; and the developer container for containing black developer may be positioned lower, in the vertical direction, than the rotating shaft when the image forming apparatus temporarily halts the rotating body at the standby position.

In this way, it is possible to certainly cause the black developer that has been stripped off to fall towards the lower section, in the vertical direction, in the image forming apparatus when the black developer, for which the possibility of adhering to the developer container is high, is stripped off from the developer container.

Further, a plurality of the developer containers may be attached to and detached from the moving body, each of the developer containers being capable of containing developer of a different color; the image forming apparatus may have a plural-color image-forming mode in which the image forming apparatus forms an image on a medium using the developers of the plurality of the different colors that are contained in the plurality of developer containers attached to the moving body, and a single-color image-forming mode in which the image forming apparatus forms an image on a medium using developer that is of a single color and that is contained in one of the plurality of developer containers attached to the moving body; and the image forming apparatus may temporarily halt the moving body at least once while the moving body moves to the predetermined detachment position if the image-forming mode of the image forming apparatus right before the detachment of the developer container is the single-color image-forming mode, and the developer container that is to be detached is the developer container that contains the developer of the single color.

In this way, it becomes possible to appropriately prevent contamination caused by the developer upon detachment of the developer container while taking into consideration the reduction in the amount of time for which the operator has to wait in order to carry out his/her developer-container detachment task.

Further, a plurality of the developer containers may be attached to and detached from the moving body, each of the developer containers being capable of containing developer of a different color; and the image forming apparatus may temporarily halt the moving body at least once while the moving body moves to the predetermined detachment position if the developer container that is to be detached is the developer container that contains black developer.

In this way, it becomes possible to appropriately prevent contamination caused by the developer upon detachment of the developer container while taking into consideration the reduction in the amount of time for which the operator has to wait in order to carry out his/her developer-container detachment task.

It is also possible to provide an image forming apparatus comprising a movable moving body to and from which a developer container for containing developer can be attached and detached, wherein: upon detachment of the developer container that is attached to the moving body, the image forming apparatus temporarily halts the moving body at least once while the moving body moves to a predetermined detachment position at which the developer container can be detached; the developer container has a storage element for storing information about the developer container; the image forming apparatus carries out communication with the storage element when the image forming apparatus temporarily halts the moving body while the moving body moves to the predetermined detachment position; a movement speed at which the moving body moves to the predetermined detachment position reaches its maximum right before the image forming apparatus temporarily halts the moving body at least once; a plurality of the developer containers can be attached to and detached from the moving body, each of the developer containers being capable of containing developer of a different color; the movement speed that has reached its maximum right before the image forming apparatus temporarily halts the moving body at least once is approximately the same as a movement speed at which the moving body moves when an image is formed on a medium using the developers of the plurality of the different colors that are contained in the plurality of developer containers attached to the moving body; the moving body is a rotatable rotating body; the rotating body has a rotating shaft at the center of the rotating body, an axial direction of the rotating shaft intersecting with the vertical direction; the developer container that is to be detached is positioned lower, in the vertical direction, than the rotating shaft when the image forming apparatus temporarily halts the rotating body while the rotating body rotationally moves to the predetermined detachment position; the image forming apparatus further comprises a developer receiving member that is for receiving the developer and that is positioned at a lower side, in the vertical direction, of the rotating body; the developer container has a developer bearing body for bearing the developer, and an opening towards which the developer bearing body faces; the opening of the developer container that is to be detached is positioned at a lower side, in the vertical direction, of the developer container when the image forming apparatus temporarily halts the rotating body while the rotating body rotationally moves to the predetermined detachment position; and the opening of the developer container that is to be detached is positioned at an upper side, in the vertical direction, of the developer container when the rotating body has rotationally moved to the predetermined detachment position.

It is also possible to provide an image forming apparatus comprising a movable moving body to and from which a developer container for containing developer can be attached and detached, wherein: upon detachment of the developer container that is attached to the moving body, the image forming apparatus temporarily halts the moving body at least once while the moving body moves to a predetermined detachment position at which the developer container can be detached; a halt position of the moving body for when the image forming apparatus temporarily halts the moving body while the moving body moves to the predetermined detachment position is a standby position of the moving body for when the image forming apparatus is on standby for formation of an image to be carried out; the moving body is a rotatable rotating body; the rotating body has a rotating shaft at the center of the rotating body, an axial direction of the rotating shaft intersecting with the vertical direction; a plurality of the developer containers can be attached to and detached from the rotating body, each of the developer containers being capable of containing developer of a different color; and the developer container for containing black developer is positioned lower, in the vertical direction, than the rotating shaft when the image forming apparatus temporarily halts the rotating body at the standby position.

It is also possible to provide an image forming apparatus comprising a movable moving body to and from which a developer container for containing developer can be attached and detached, wherein: upon detachment of the developer container that is attached to the moving body, the image forming apparatus temporarily halts the moving body at least once while the moving body moves to a predetermined detachment position at which the developer container can be detached; a plurality of the developer containers can be attached to and detached from the moving body, each of the developer containers being capable of containing developer of a different color; the image forming apparatus has a plural-color image-forming mode in which the image forming apparatus forms an image on a medium using the developers of the plurality of the different colors that are contained in the plurality of developer containers attached to the moving body, and a single-color image-forming mode in which the image forming apparatus forms an image on a medium using developer that is of a single color and that is contained in one of the plurality of developer containers attached to the moving body; the image forming apparatus temporarily halts the moving body at least once while the moving body moves to the predetermined detachment position if the image-forming mode of the image forming apparatus right before the detachment of the developer container is the single-color image-forming mode, and the developer container that is to be detached is the developer container that contains the developer of the single color; and the image forming apparatus temporarily halts the moving body at least once while the moving body moves to the predetermined detachment position if the developer container that is to be detached is the developer container that contains black developer.

It is also possible to provide an image forming apparatus comprising a movable moving body that is provided with a developer container for containing developer, wherein upon detachment of the developer container that is attached to the moving body, the image forming apparatus temporarily halts the moving body at least once while the moving body moves to a predetermined detachment position at which the developer container can be detached.

It is also possible to provide an image forming system comprising: a computer; a display device that is connectable to the computer; and an image forming apparatus, wherein: the image forming apparatus is connectable to the computer; the image forming apparatus includes a movable moving body to and from which a developer container for containing developer can be attached and detached; and upon detachment of the developer container that is attached to the moving body, the image forming apparatus temporarily halts the moving body at least once while the moving body moves to a predetermined detachment position at which the developer container can be detached.

As an overall system, the image forming system that is achieved in this way becomes superior to conventional systems.

<<<Fourth Aspect>>>

A developing device comprises: a developer bearing body for bearing developer; an abutting member that abuts against the developer bearing body; an opposing member that is arranged in opposition to the abutting member on a side opposite from the developer bearing body with respect to the abutting member; and a sealing member that is for preventing the developer from spilling from between the abutting member and the opposing member, and that is bonded to both the abutting member and the opposing member.

By bonding the sealing member to both the abutting member and the opposing member, it is possible to allow the functions of the abutting member to be achieved effectively as well as appropriately prevent the developer from spilling.

Further, the abutting member may be a thickness restricting member for restricting the thickness of a layer of the developer bore by the developer bearing body.

In this way, it is possible to allow the functions of the thickness restricting member to be achieved effectively as well as appropriately prevent the developer from spilling.

Further, the abutting member may be a developer collecting member for collecting the developer bore by the developer bearing body into the developing device.

In this way, it is possible to allow the functions of the developer collecting member to be achieved effectively as well as appropriately prevent the developer from spilling.

Further, the sealing member may be bonded to both the abutting member and the opposing member by a double-faced tape.

In this way, handling upon manufacture etc. becomes easy.

Further, the bond strength of the double-faced tape for bonding the sealing member to the abutting member may be different from the bond strength of the double-faced tape for bonding the sealing member to the opposing member.

In this way, the time and effort necessary for disassembling the developing device for discarding, recycling, or reusing the device, for example, are reduced.

Further, the area of the double-faced tape in which the sealing member is bonded to the abutting member may be different from the area of the double-faced tape in which the sealing member is bonded to the opposing member.

In this way, the time and effort necessary for disassembling the developing device for discarding, recycling, or reusing the device, for example, are reduced.

Further, the sealing member may be bonded to both the thickness restricting member and the opposing member by a double-faced tape; and a bond strength of the double-faced tape for bonding the sealing member to the thickness restricting member may be smaller than a bond strength of the double-faced tape for bonding the sealing member to the opposing member.

In this way, the time and effort for work relating to recycling and reuse of the thickness restricting member are reduced, because upon disassembly of the developing device, the sealing member is removed first from the thickness restricting member, for which the demand for recycling or reuse is higher than the opposing member.

Further, the thickness restricting member may have an abutting section that abuts against the developer bearing body, and a supporting section for supporting the abutting section; the sealing member may be bonded to both the supporting section and the opposing member by the double-faced tape; the supporting section may be made of metal; and the opposing member may be made of resin.

In this way, the time and effort for work relating to recycling and reuse of metal are reduced, because upon disassembly of the developing device, the sealing member is removed first from the metal, for which the demand for recycling or reuse is higher than resin.

It is also possible to provide a developing device comprising: a developer bearing body for bearing developer; an abutting member that abuts against the developer bearing body; an opposing member that is arranged in opposition to the abutting member on a side opposite from the developer bearing body with respect to the abutting member; and a sealing member that is for preventing the developer from spilling from between the abutting member and the opposing member, and that is bonded to both the abutting member and the opposing member by a double-faced tape, wherein: a bond strength of the double-faced tape for bonding the sealing member to the abutting member is different from a bond strength of the double-faced tape for bonding the sealing member to the opposing member; the abutting member is a thickness restricting member for restricting the thickness of a layer of the developer bore by the developer bearing body; the bond strength of the double-faced tape for bonding the sealing member to the thickness restricting member is smaller than the bond strength of the double-faced tape for bonding the sealing member to the opposing member; the thickness restricting member has an abutting section that abuts against the developer bearing body, and a supporting section for supporting the abutting section; the sealing member is bonded to both the supporting section and the opposing member by the double-faced tape; the supporting section is made of metal; and the opposing member is made of resin.

The object of the present invention is achieved most effectively because in this way, almost all of the effects mentioned above can be obtained.

It is also possible to provide an image forming apparatus comprising: an image bearing body for bearing a latent image; and a developing device, the developing device including a developer bearing body for bearing developer, an abutting member that abuts against the developer bearing body, an opposing member that is arranged in opposition to the abutting member on a side opposite from the developer bearing body with respect to the abutting member, and a sealing member that is for preventing the developer from spilling from between the abutting member and the opposing member, and that is bonded to both the abutting member and the opposing member, and the developing device being capable of developing the latent image bore by the image bearing body using the developer bore by the developer bearing body.

With this image forming apparatus, it is possible to allow the functions of the abutting member to be achieved effectively as well as appropriately prevent the developer from spilling.

It is also possible to provide an image forming system comprising: a computer; a display device that is connectable to the computer; and an image forming apparatus that is connectable to the computer, and that includes: an image bearing body for bearing a latent image; and a developing device, the developing device having a developer bearing body for bearing developer, an abutting member that abuts against the developer bearing body, an opposing member that is arranged in opposition to the abutting member on a side opposite from the developer bearing body with respect to the abutting member, and a sealing member that is for preventing the developer from spilling from between the abutting member and the opposing member, and that is bonded to both the abutting member and the opposing member, and the developing device being capable of developing the latent image bore by the image bearing body using the developer bore by the developer bearing body.

As an overall system, the image forming system that is achieved in this way becomes superior to conventional systems.

First Embodiment

===Overall Configuration Example of Image Forming Apparatus===

Next, using FIG. 1, an outline of an image-forming apparatus will be described, taking a laser-beam printer 10 (hereinafter referred to also as "printer") as an example. FIG. 1 is a diagram showing main structural components constructing the printer 10. Note that in FIG. 1, the vertical direction is shown by the arrow, and, for example, a paper supply tray 92 is arranged at a lower section of the printer 10, and a fusing unit 90 is arranged at an upper section of the printer 10.

As shown in FIG. 1, the printer 10 according to the present embodiment includes a charging unit 30, an exposing unit 40, a YMCK developing device 50 which serves as an example of a rotatable rotating body, a first transferring unit 60, an intermediate transferring body 70, and a cleaning unit 75, all of which being arranged in the direction of rotation of a photoconductor 20, which serves as an example of an image bearing body for bearing a latent image. The printer 10 further includes a second transferring unit 80, a fusing unit 90, a displaying unit 95 constructed of a liquid-crystal panel and serving as means for making notifications to a user, and a control unit (FIG. 2) for controlling these units etc. and managing the operations as a printer.

The photoconductor 20 has a cylindrical conductive base and a photoconductive layer formed on the outer peripheral surface of the conductive base, and it is rotatable about a central axis. In the present embodiment, the photoconductor 20 rotates clockwise, as shown by the arrow in FIG. 1.

The charging unit 30 is a device for charging the photoconductor 20. The exposing unit 40 is a device for forming a latent image on the charged photoconductor 20 by radiating laser thereon. The exposing unit 40 has, for example, a semiconductor laser, a polygon mirror, and an F-θ lens, and radiates modulated laser onto the charged photoconductor 20 according to image information having been input from a not-shown host computer such as a personal computer or a word processor.

The YMCK developing device 50 is a device for developing the latent image formed on the photoconductor 20 using toner T, that is, black (K) toner contained in a black developing unit 51, magenta (M) toner contained in a magenta developing unit 52, cyan (C) toner contained in a cyan developing unit 53, and yellow (Y) toner contained in a yellow developing unit 54. The toner T is an example of developer contained in each of the developing units, which serve as an example of a developer container.

In the present embodiment, the YMCK developing device 50 can move the positions of the four developing units 51, 52, 53, and 54 by rotating. More specifically, the YMCK developing device 50 holds the four developing units 51, 52, 53, and 54 with four holding sections 55*a*, 55*b*, 55*c*, and 55*d*. The four developing units 51, 52, 53, and 54 can be rotated about a rotating shaft 50*a* while maintaining their relative positions. Every time an image forming process for one page is finished, each of the developing units selectively opposes the photoconductor 20 to successively develop the latent image formed on the photoconductor 20 using the toner T contained in each of the developing units 51, 52, 53, and 54. It should be noted that each of the four developing units 51, 52, 53, and 54 described above is attachable to and detachable from the respective holding sections of the YMCK developing device 50. Further, details on the YMCK developing device 50 and the developing units will be described later.

The first transferring unit 60 is a device for transferring, onto the intermediate transferring body 70, a single-color toner image formed on the photoconductor 20. When the toners of all four colors are successively transferred in a superimposing manner, a full-color toner image will be formed on the intermediate transferring body 70.

The intermediate transferring body 70 is a laminated endless belt that is made by providing an aluminum layer on the surface of a PET film by vapor deposition, and then further applying semiconducting coating on the outer layer thereof. The intermediate transferring body 70 is driven to rotate at substantially the same circumferential speed as the photoconductor 20.

The second transferring unit 80 is a device for transferring the single-color toner image or the full-color toner image formed on the intermediate transferring body 70 onto a medium such as paper, film, and cloth.

The fusing unit 90 is a device for fusing the single-color toner image or the full-color toner image, which has been transferred onto the medium, onto the medium such as paper to make it into a permanent image.

The cleaning unit 75 is a device that is provided between the first transferring unit 60 and the charging unit 30, that has a rubber cleaning blade 76 made to abut against the surface of the photoconductor 20, and that is for removing the toner T remaining on the photoconductor 20 by scraping it off with the cleaning blade 76 after the toner image has been transferred onto the intermediate transferring body 70 by the first transferring unit 60.

Figure 2:
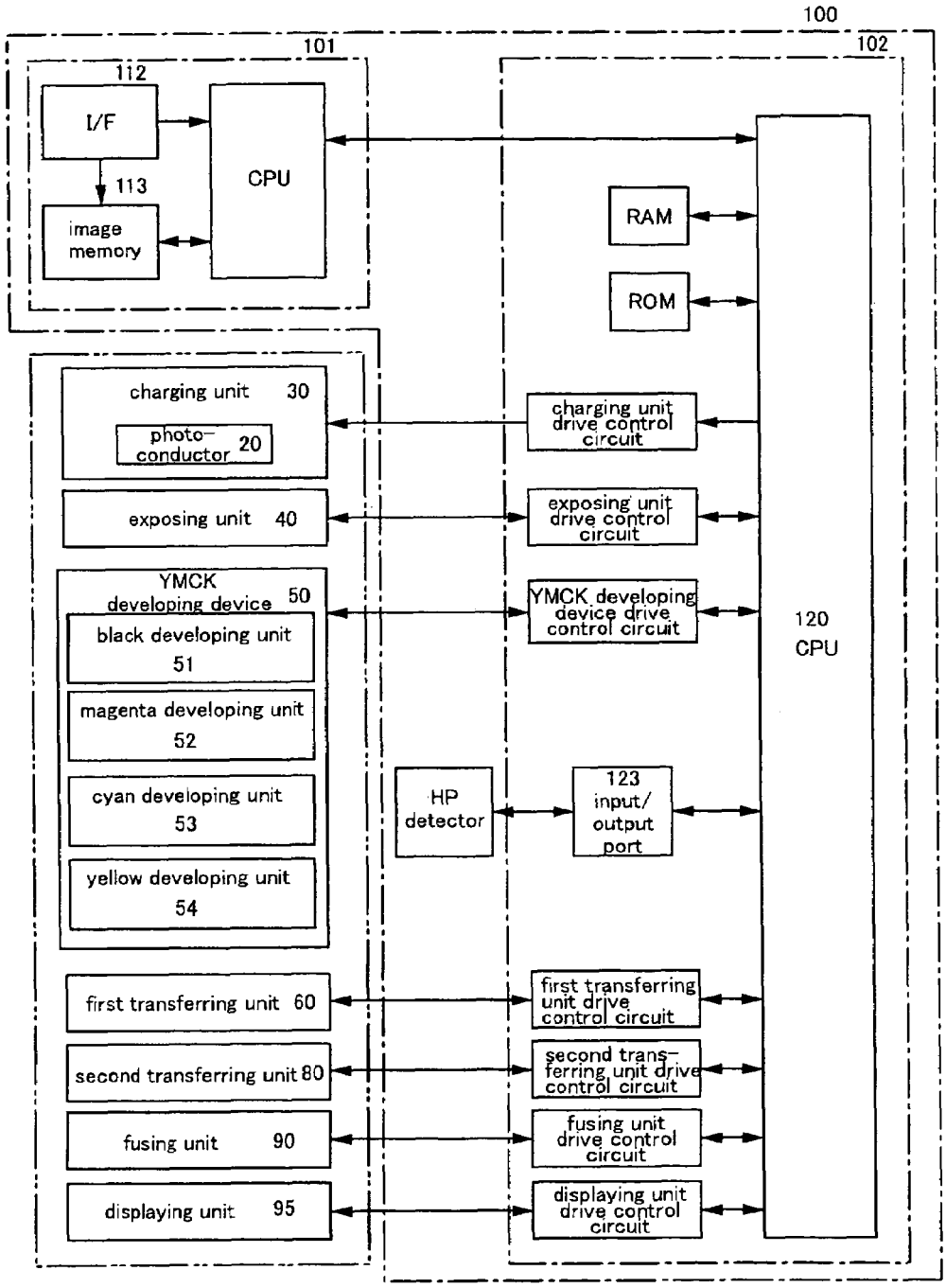
FIG. 2 is a block diagram showing a control unit of the image forming apparatus in FIG. 1.

The control unit 100 comprises a main controller 101 and a unit controller 102 as shown in FIG. 2. An image signal is input to the main controller 101, and according to instructions based on the image signal, the unit controller 102 controls each of the above-mentioned units etc. to form an image.

Next, operations of the printer 10 structured as above will be described with reference to other structural components.

First, when an image signal is input from the not-shown host computer to the main controller 101 of the printer 10 through an interface (I/F) 112, the photoconductor 20, a developing roller as an example of a developer bearing body, and the intermediate transferring body 70 rotate under the control of the unit controller 102 based on the instructions from the main controller 101. While being rotated, the photoconductor 20 is successively charged by the charging unit 30 at a charging position.

With the rotation of the photoconductor 20, the charged area of the photoconductor 20 reaches an exposing position. A latent image that corresponds to the image information about the first color, for example, yellow Y, is formed in that area by the exposing unit 40. The YMCK developing device 50 positions the yellow developing unit 54, which contains yellow (Y) toner, in the developing position opposing the photoconductor 20.

With the rotation of the photoconductor 20, the latent image formed on the photoconductor 20 reaches the developing position, and is developed with the yellow toner by the yellow developing unit 54. Thus, a yellow toner image is formed on the photoconductor 20.

With the rotation of the photoconductor 20, the yellow toner image formed on the photoconductor 20 reaches a first transferring position, and is transferred onto the intermediate transferring body 70 by the first transferring unit 60. At this time, a first transferring voltage, which is in an opposite polarity to the polarity to which the toner T is charged, is applied to the first transferring unit 60. It should be noted that, during this process, the photoconductor 20 and the intermediate transferring body 70 are placed in contact with each other, and the second transferring unit 80 is kept separated from the intermediate transferring body 70.

By subsequently performing the above-mentioned processes for the second, the third, and the fourth colors for each of the developing units, toner images in four colors corresponding to the respective image signals are transferred to the intermediate transferring body 70 in a superimposed manner. As a result, a full-color toner image is formed on the intermediate transferring body 70.

With the rotation of the intermediate transferring body 70, the full-color toner image formed on the intermediate transferring body 70 reaches a second transferring position, and is transferred onto a medium by the second transferring unit 80. It should be noted that the medium is carried from the paper supply tray 92 to the second transferring unit 80 via the paper-feed roller 94 and resisting rollers 96. During transferring operations, a second transferring voltage is applied to the second transferring unit 80 and also the unit 80 is pressed against the intermediate transferring body 70.

The full-color toner image transferred onto the medium is heated and pressurized by the fusing unit 90 and fused to the medium.

On the other hand, after the photoconductor 20 passes the first transferring position, the toner T adhering to the surface of the photoconductor 20 is scraped off by the cleaning blade 76 that is supported on the cleaning unit 75, and the photoconductor 20 is prepared for charging for forming the next latent image. The scraped-off toner T is collected in a remaining-toner collector that the cleaning unit 75 comprises.

===Configuration Example of Developing Unit===

Figure 3:
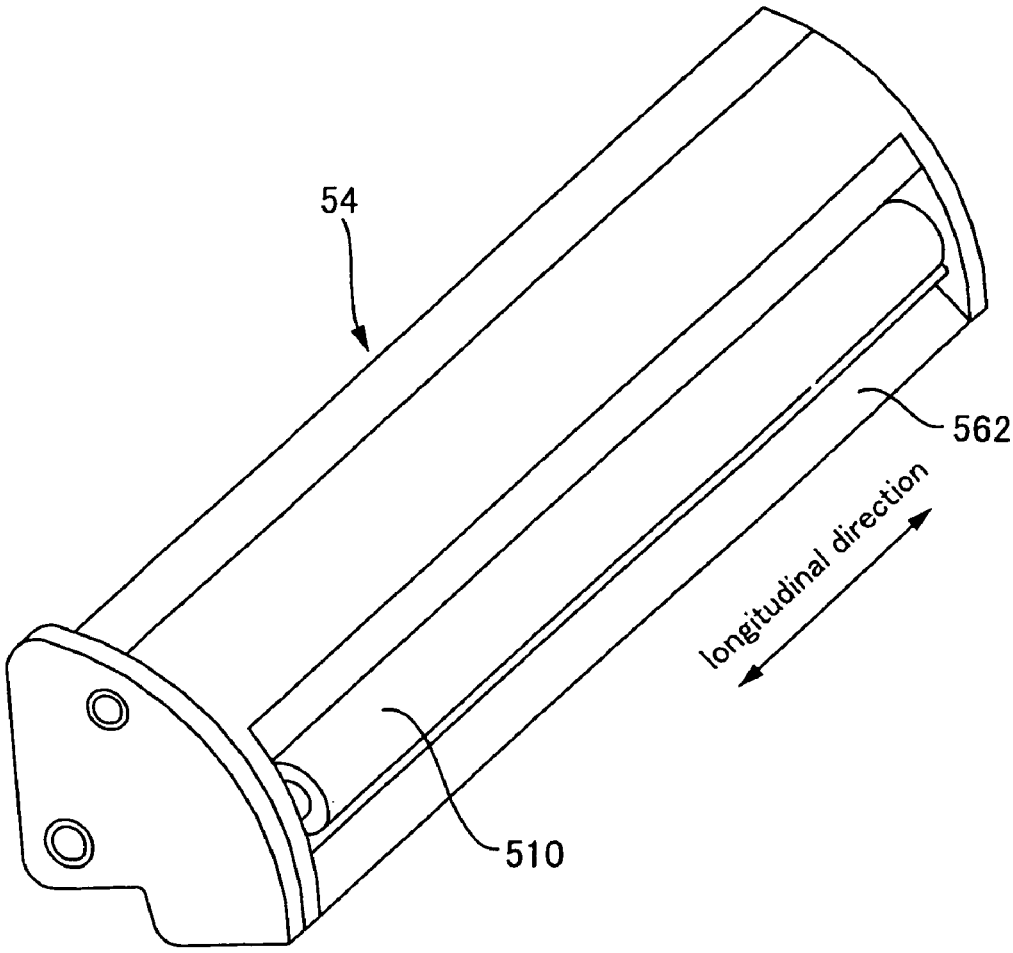
FIG. 3 is a conceptual diagram of a developing unit.
Figure 4:
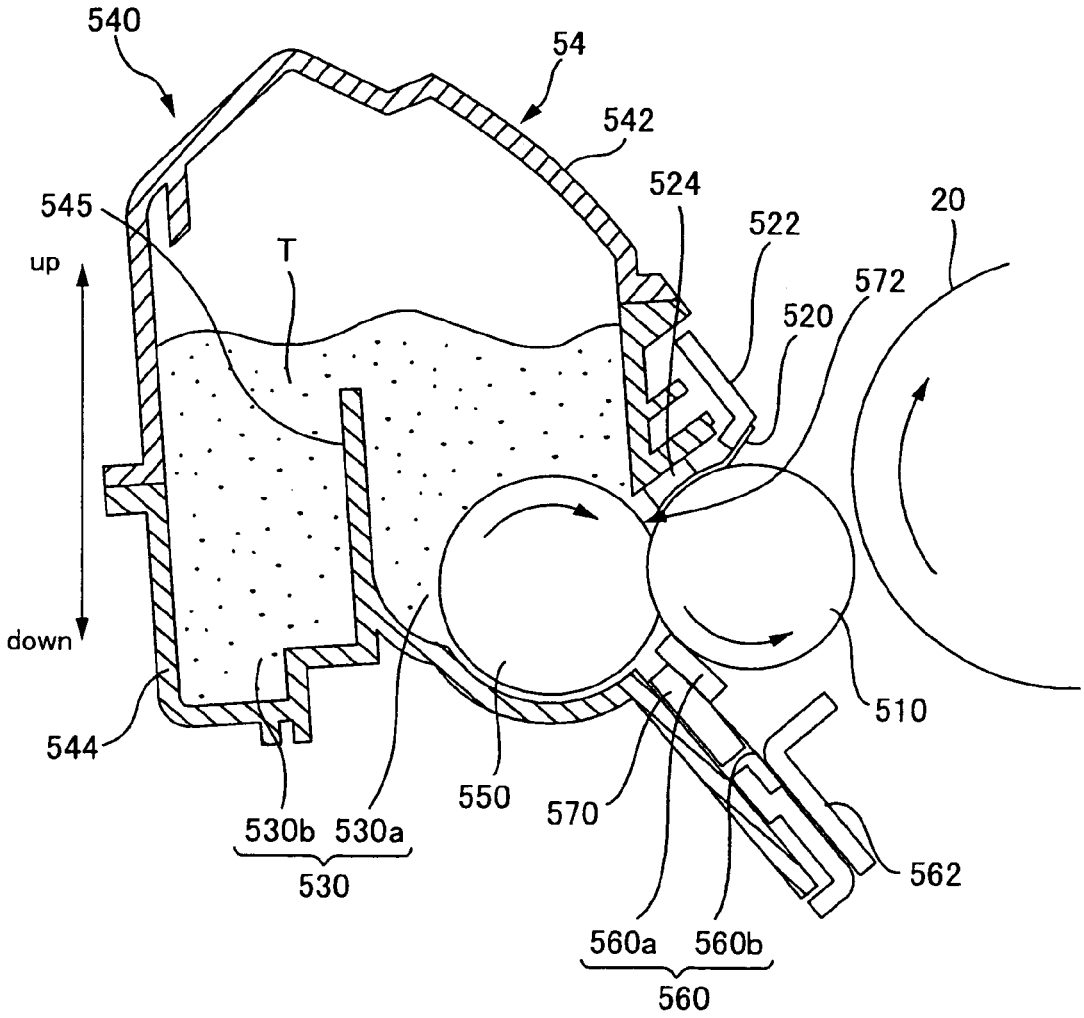
FIG. 4 is a section view showing main structural components of the developing unit.

Next, using FIG. 3 and FIG. 4, an example of a configuration of the developing units will be described. FIG. 3 is a conceptual diagram of a developing unit. FIG. 4 is a section view showing main structural components of the developing unit. Note that the section view shown in FIG. 4 is a section of the developing unit bisected by a plane perpendicular to the longitudinal direction shown in FIG. 3. Further, in FIG. 4, the arrow indicates the vertical direction as in FIG. 1, and, for example, the central axis of the developing roller 510 is located below the central axis of the photoconductor 20. Further, in FIG. 4, the yellow developing unit 54 is shown to be in a state in which it is positioned at the developing position opposing the photoconductor 20.

The YMCK developing device 50 comprises: the black developing unit 51 containing black (K) toner; the magenta developing unit 52 containing magenta (M) toner; the cyan developing unit 53 containing cyan (C) toner; and the yellow developing unit 54 containing yellow (Y) toner. Since the configuration of each of the developing units is the same, explanation will be made only about the yellow developing unit 54 below.

The yellow developing unit 54 has, for example, the developing roller 510, a sealing member 520, toner containing sections 530 serving as developer containing sections, a housing 540, a toner supplying roller 550 serving as a developer supplying member, and a restriction blade 560.

The developing roller 510 bears toner T and delivers it to the developing position opposing the photoconductor 20. The developing roller 510 is made of metal and manufactured from, for example, aluminum alloy such as aluminum alloy 5056 or aluminum alloy 6063, or iron alloy such as STKM, and the roller 510 is plated with, for example, nickel plating or chromium plating, as necessary.

Further, as shown in FIG. 3, the developing roller 510 is supported at both ends in its longitudinal direction and is rotatable about its central axis. As shown in FIG. 4, the developing roller 510 rotates in the opposite direction (counterclockwise in FIG. 4) to the rotating direction of the photoconductor 20 (clockwise in FIG. 4). The central axis of the roller 510 is located below the central axis of the photoconductor 20. Further, as shown in FIG. 4, in the state where the yellow developing unit 54 opposes the photoconductor 20, there is a gap between the developing roller 510 and the photoconductor 20. That is, the yellow developing unit 54 develops the latent image formed on the photoconductor 20 in a non-contacting state. Note that an alternating field is generated between the developing roller 510 and the photoconductor 20 upon development of the latent image formed on the photoconductor 20.

The sealing member 520 prevents the toner T in the yellow developing unit 54 from spilling out therefrom, and also collects the toner T, which is on the developing roller 510 that has passed the developing position, into the developing unit without scraping. The sealing member 520 is a seal made of, for example, polyethylene film. The sealing member 520 is supported by a seal-supporting metal plate 522, and is attached to the housing 540 via the seal-supporting metal plate 522. A seal-urging member 524 made of, for example, Moltoprene is provided on one side of the sealing member 520 opposite to the side of the developing roller 510. The sealing member 520 is pressed against the developing roller 510 by the elastic force of the seal-urging member 524. Note that the abutting position at which the sealing member 520 abuts against the developing roller 510 is situated above the central axis of the developing roller 510.

The housing 540 is manufactured by welding together a plurality of integrally-molded housing sections, that is, an upper housing section 542 and a lower housing section 544. The inside of the housing is divided into two toner containing sections 530, that is, the first toner containing section 530*a* and the second toner containing section 530*b* by a partitioning wall 545 that is for partitioning the toner T and that protrudes inward from the inner wall (in the up/down direction of FIG. 4). The upper sections of the first toner containing section 530*a* and the second toner containing section 530*b* are in communication, and the movement of the toner T between them is restricted by the partitioning wall 545 in the state shown in FIG. 4. However, when the YMCK developing device 50 rotates, the toner contained in the first toner containing section 530*a* and the second toner containing section 530*b* in the state shown in FIG. 4 is once gathered in the side of the communicated section, which is in the upper side when in the developing position, and when the device returns to the state shown in FIG. 4, the toner is mixed and then returned to the first toner containing section 530*a* and the second toner containing section 530*b*. That is, the toner T in the developing units is appropriately stirred by the rotation of the YMCK developing device 50.

For this reason, no stirring member is provided in the toner containing sections 530 in this embodiment, but a stirring member for stirring the toner T contained in the toner containing sections 530 may be provided. Further, as shown in FIG. 4, the housing 540 has an opening 572 at its lower section. The developing roller 510 is arranged in this opening 572 in such a state that a part of the roller 510 is exposed to the outside.

The toner supplying roller 550 is provided in the first toner containing section 530*a* described above and supplies the toner T contained in the first toner containing section 530*a* to the developing roller 510. The toner supplying roller 550 is made of, for example, polyurethane foam, and is made to abut against the developing roller 510 in an elastically deformed state. The toner supplying roller 550 is arranged at a lower section of the toner containing sections 530. The toner T contained in the toner containing sections 530 is supplied to the developing roller 510 by the toner supplying roller 550 at the lower section of the toner containing sections 530. The toner supplying roller 550 is rotatable about a central axis. The central axis of the toner supplying roller 550 is situated below the central axis of rotation of the developing roller 510. Further, the toner supplying roller 550 rotates in the opposite direction (clockwise in FIG. 4) to the rotating direction of the developing roller 510 (counterclockwise in FIG. 4). Note that the toner supplying roller 550 has the function of supplying the toner T contained in the toner containing sections 530 to the developing roller 510 as well as the function of stripping off the toner T remaining on the developing roller 510 after development from the developing roller 510.

The restriction blade 560 restricts the thickness of the layer of the toner T bore by the developing roller 510 and also gives charge to the toner T bore by the developing roller 510. This restriction blade 560 has a rubber section 560*a* and a rubber-supporting section 560*b*. The rubber section 560*a* is made of, for example, silicone rubber or urethane rubber. The rubber-supporting section 560*b* is a thin plate that is made of, for example, phosphor bronze or stainless steel, and that has a springy characteristic. The rubber section 560*a* is supported by the rubber-supporting section 560*b*. The rubber-supporting section 560*b* is attached to the housing 540 via a pair of blade-supporting metal plates 562 in a state that one end of the rubber-supporting section 560*b* is pinched between and supported by the blade-supporting metal plates 562. Further, a blade-backing member 570 made of, for example, Moltoprene is provided on one side of the restriction blade 560 opposite to the side of the developing roller 510.

The rubber section 560*a* is pressed against the developing roller 510 by the elastic force caused by the flexure of the rubber-supporting section 560*b*. Further, the blade-backing member 570 prevents the toner T from entering in between the rubber-supporting section 560*b* and the housing 540, stabilizes the elastic force caused by the flexure of the rubber-supporting section 560*b*, and also, applies force to the rubber section 560*a* from the back thereof towards the developing roller 510 to press the rubber section 560*a* against the developing roller 510. In this way, the blade-backing member 570 makes the rubber section 560*a* abut against the developing roller 510 more evenly.

The end of the restricting blade 560 opposite to the end that is being supported by the blade-supporting metal plates 562, i.e., the tip end, is not placed in contact with the developing roller 510; rather, a section at a predetermined distance from the tip end contacts, with some breadth, the developing roller 510. That is, the restriction blade 560 does not abut against the developing roller 510 at its edge, but abuts against the roller 510 near its central portion. Further, the restriction blade 560 is arranged so that its tip end faces towards the upper stream of the rotating direction of the developing roller 510, and thus, makes a so-called counter-abutment with respect to the roller 510. It should be noted that the abutting position at which the restriction blade 560 abuts against the developing roller 510 is below the central axis of the developing roller 510 and is also below the central axis of the toner supplying roller 550.

In the yellow developing unit 54 thus structured, the toner supplying roller 550 supplies the toner T contained in the toner containing sections 530 to the developing roller 510. With the rotation of the developing roller 510, the toner T, which has been supplied to the developing roller 510, reaches the abutting position of the restriction blade 560; then, as the toner T passes the abutting position, the toner is charged and its layer thickness is restricted. With further rotation of the developing roller 510, the toner T on the developing roller 510, whose layer thickness has been restricted, reaches the developing position opposing the photoconductor 20; then, under the alternating field, the toner T is used at the developing position for developing the latent image formed on the photoconductor 20. With further rotation of the developing roller 510, the toner T on the developing roller 510, which has passed the developing position, passes the sealing member 520 and is collected into the developing unit by the sealing member 520 without being scraped off. Then, the toner T that still remains on the developing roller 510 can be stripped off by the toner supplying roller 550.

===Overview of YMCK Developing Device===

Next, an overview of the YMCK developing device 50 will be described using FIG. 5.

The YMCK developing device 50 has a rotating shaft 50*a* positioned at the center. A support frame 55 for holding the developing units is fixed to the rotating shaft 50*a*. The rotating shaft 50*a* is provided extending between two frame side plates (not shown) which form a casing of the printer 10, and both ends of the shaft 50*a* are supported.

The support frame 55 includes the four holding sections 55*a*, 55*b*, 55*c*, and 55*d*, by which the above-described developing units 51, 52, 53, and 54 of the four colors are held in an attachable/detachable manner about the rotating shaft 50*a*, in the circumferential direction at an interval of 90°.

A pulse motor, which is not shown, is connected to the rotating shaft 50*a* via a clutch. By driving the pulse motor, it is possible to rotate the support frame 55 and position the four developing units 51, 52, 53, and 54 mentioned above at predetermined positions.

Figure 5A:
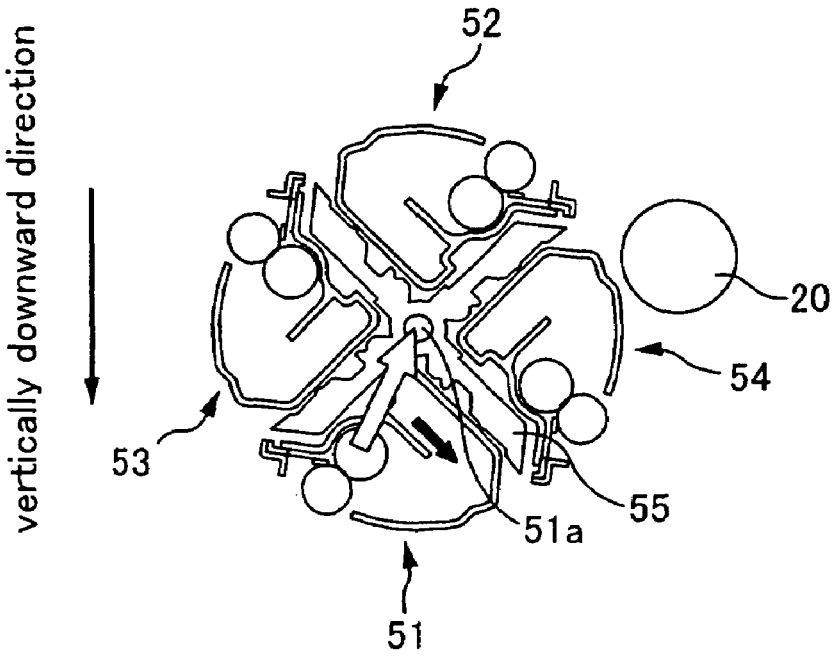
FIG. 5A is a diagram showing the home position which is the reference position in the rotating direction of a YMCK developing device 50.
Figure 5B:
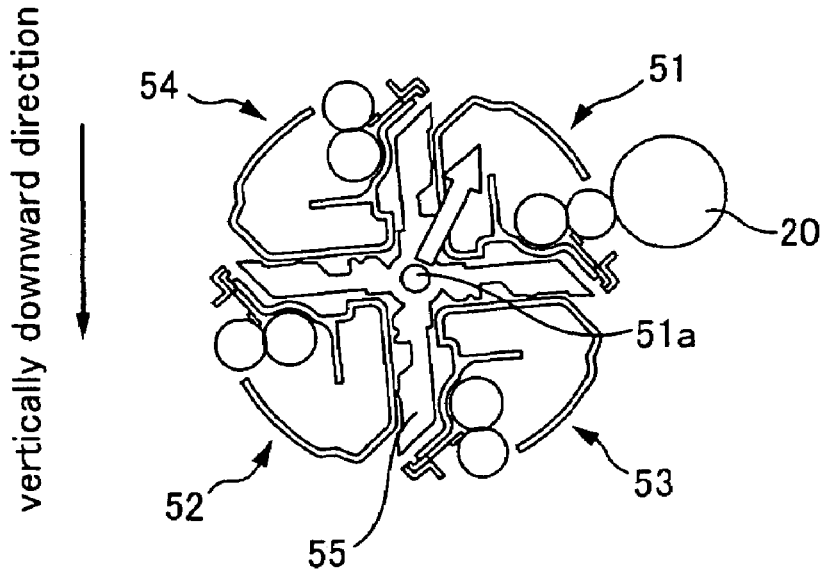
FIG. 5B is a diagram showing the developing position where a black developing unit 51, which is attached to the YMCK developing device 50, is in opposition to a photoconductor 20.

FIG. 5 are diagrams showing two halt positions of the rotating YMCK developing device 50. FIG. 5A shows the home position (referred to as "HP position" below) which is the reference position in the rotating direction of the YMCK developing device 50. FIG. 5B shows the developing position where the black developing unit 51, which is attached to the YMCK developing device 50, is in opposition to the photoconductor 20.

In FIG. 5B, the developing position is explained with regard to the black developing unit 51, but this position becomes the developing position for each of the other developing units when the YMCK developing device 50 is rotated at 90° intervals.

An HP detector (not shown) for detecting the HP position is provided on the side of one end of the rotating shaft 50*a* of the YMCK developing device 50. The HP detector is structured of a disk that is for generating signals and that is fixed to one end of the rotating shaft 50*a*, and an HP sensor that is made up of, for example, a photointerrupter having a light emitting section and a light receiving section. The peripheral section of the disk is arranged so that it is located between the light emitting section and the light receiving section of the HP sensor. When a slit formed in the disk moves to a detecting position of the HP sensor, the signal that is output from the HP sensor changes from "L" to "H". The device is constructed such that the HP position of the YMCK developing device 50 is detected based on this change in signal level and the number of pulses of the pulse motor, and by taking this HP position as a reference, each of the developing units can be positioned at, for example, the developing position.

FIG. 5B shows the developing position of the black developing unit 51 which is achieved by rotating the pulse motor for a predetermined number of pulses from the above-mentioned HP position. At this developing position, the developing roller 510 of the black developing unit 51 and the photoconductor 20 oppose each other, and development using black toner becomes possible. Further, when the pulse motor rotates the YMCK developing device 50 90° in the counterclockwise direction, this position becomes the developing position for the cyan developing unit 53, and every time the YMCK developing device 50 is rotated 90°, this position successively becomes the developing position for each developing unit.

Attention is now paid to the positions of the black developing unit 51 in FIG. 5A and FIG. 5B. The direction from the black developing unit 51 towards the rotating shaft 50*a* when in the HP position of the YMCK developing device 50 (shown by the white arrow in FIG. 5A) is in the direction of the direction from the rotating shaft 50*a* towards the black developing unit 51 when in the developing position of the black developing unit 51 (shown by the white arrow in FIG. 5B). That is, the position of the black developing unit 51 at the HP position and the position of the black developing unit 51 at the developing position of the black developing unit 51 are positioned approximately on opposite sides with respect to the rotating shaft 50*a*. Further, at the HP position of the YMCK developing device 50, the angle formed between the protruding direction of the above-described partitioning wall of the black developing unit 51 (shown by the bold black arrow in FIG. 5A) and the vertically downward direction (shown by the thin black arrow in FIG. 5A) is smaller than 90°.

One of the two frame side plates that support the YMCK developing device 50 and that form the casing of the printer 10 is provided with a not-shown attach/detach dedicated opening through which one of the developing units can pass. The attach/detach dedicated opening is formed at a position where only a relevant developing unit can be pulled out in the direction of the rotating shaft 50*a* when the YMCK developing device 50 is rotated and the relevant one of the developing units is halted at a developing unit attach/detach position which is set for each developing unit. Further, the attach/detach dedicated opening is formed slightly larger than the outer shape of a developing unit, and at the developing unit attach/detach position, it is possible to insert a new developing unit through this attach/detach dedicated opening in the direction of the rotating shaft 50*a* and attach the developing unit to the support frame 55. While the developing unit is positioned at positions other than the developing unit attach/detach position, the attached state of that developing unit is restricted by the frame side plates.

It should be noted that a lock mechanism, which is not shown, is provided for certainly positioning and fixing the YMCK developing device 50 at the developing position and the attach/detach dedicated position.

===Overview of Control Unit===

Next, with reference to FIG. 2, the configuration of the control unit 100 will be described. The main controller 101 of the control unit 100 is connected to the host computer through the interface 112 and includes an image memory 113 for storing image signals that have been input from the host computer. The unit controller 102 is electrically connected to each of the units of the main apparatus (i.e., the charging unit 30, the exposing unit 40, the first transferring unit 60, the cleaning unit 75, the second transferring unit 80, the fusing unit 90, and the displaying unit 95) and the YMCK developing device 50. By receiving signals from sensors provided on each of the units, the unit controller 102 detects the state of each unit and the YMCK developing device 50 and controls each unit and the YMCK developing device 50 according to the signals input from the main controller 101. Further, the HP detector described above is connected to the CPU 120 via an input/output port 123.

===About the Operation of the YMCK Developing Device when Images are Continuously Formed According to Monochrome Image-Forming Mode===

In the section of the "Overall configuration example of image forming apparatus", operations of the printer 10 when it forms a color image were described. The printer 10 according to the present embodiment, however, is also capable of forming single-color images using toner of a single color. Here, a procedure for continuously forming monochrome images on a plurality of number of sheets of media with black toner will be described using FIG. 6 and FIG. 7 and paying particular attention to the rotating operations of the YMCK developing device 50.

Figure 6A:
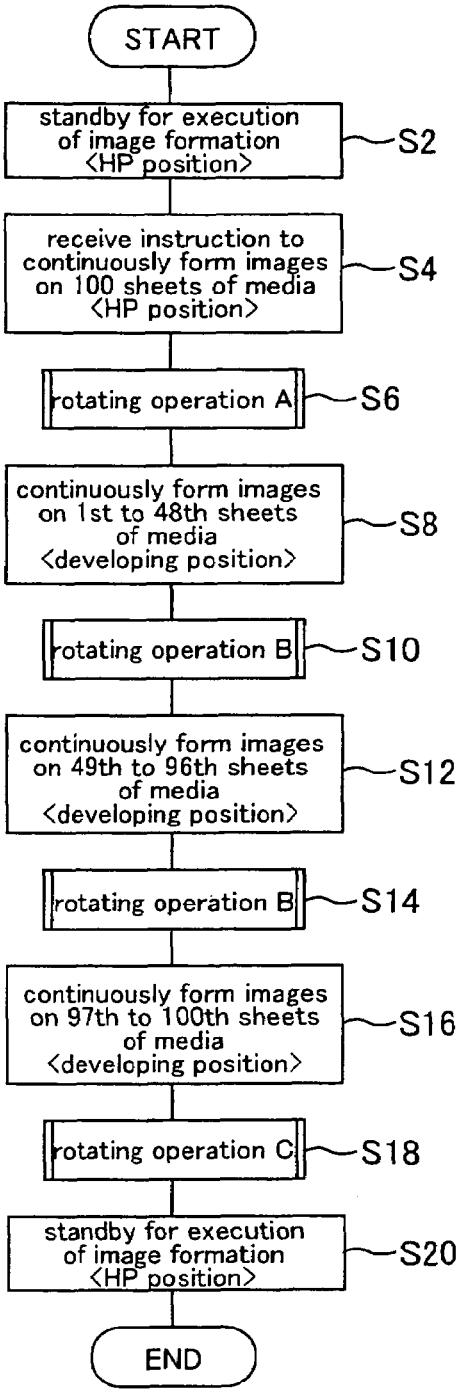
FIG. 6A is a flowchart showing a procedure for continuously forming monochrome images on 100 sheets of media using black toner.
Figure 6B:
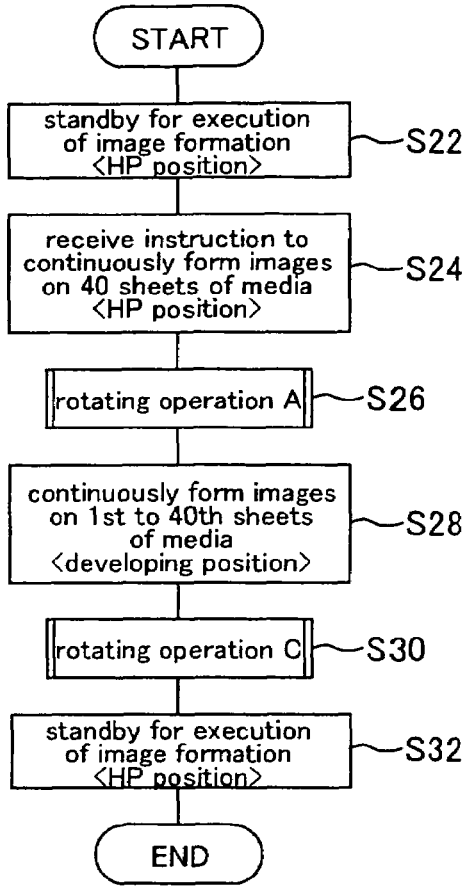
FIG. 6B is a flowchart showing a procedure for continuously forming monochrome images on 40 sheets of media using black toner.
Figure 7A:
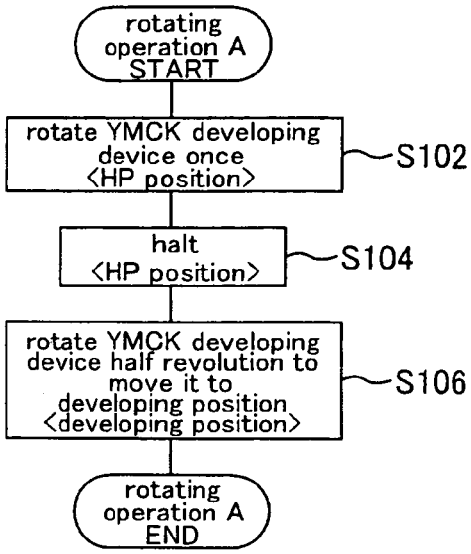
FIG. 7A is a flowchart showing the rotating operation A of a developing unit shown in the flowcharts of FIG. 6.
Figure 7B:
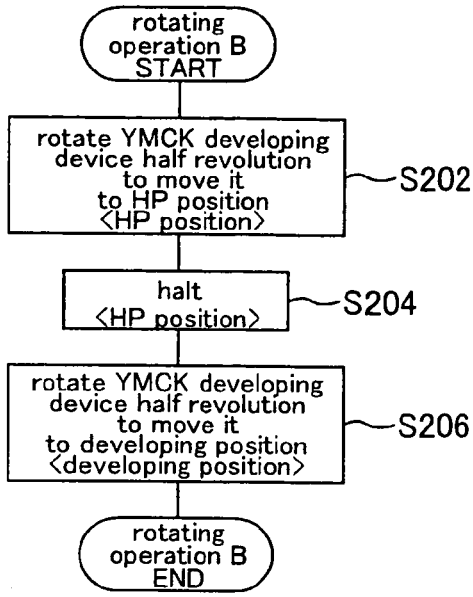
FIG. 7B is a flowchart showing the rotating operation B of the developing unit shown in the flowcharts of FIG. 6.
Figure 7C:
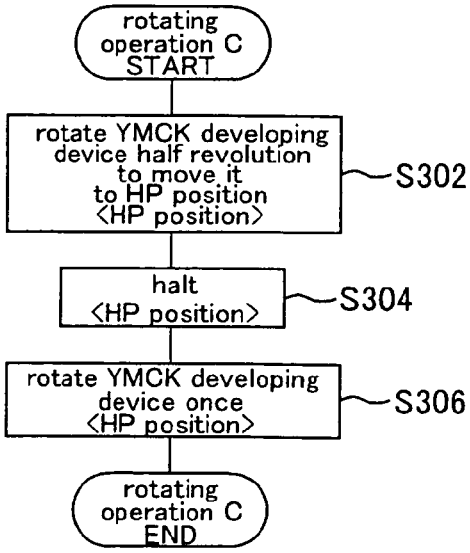
FIG. 7C is a flowchart showing the rotating operation C of a developing unit shown in the flowcharts of FIG. 6.

It should be noted that FIG. 6 are flowcharts showing a procedure for continuously forming monochrome images on a plurality of number of sheets of media with black toner. FIG. 6A shows a procedure for continuously forming monochrome images on 100 sheets of media. FIG. 6B shows a procedure for continuously forming monochrome images on 40 sheets of media. FIG. 7 are flowcharts showing rotating operations of a developing unit which are shown in the flowcharts of FIG. 6. FIG. 7A, FIG. 7B, and FIG. 7C are flowcharts showing the rotating operation A, the rotating operation B, and the rotating operation C, respectively.

During these procedures, the YMCK developing device 50 moves back and forth between the developing position for carrying out development with the black developing unit (which is also merely referred to below as "developing position" in the present embodiment) and the above-described HP position. The positions at which the YMCK developing device 50 is positioned are shown in angle brackets in the flowcharts of FIG. 6 and FIG. 7.

<<<About When Monochrome Images are Continuously Formed on 100 Sheets of Media>>>

First, an example of continuously forming monochrome images on 100 sheets of media will be described with reference to the flowchart of FIG. 6A.

This flowchart starts from a state in which the printer 10 is on standby for image formation to be carried out (step S2), with the power of the printer 10 already turned ON. The standby position of the YMCK developing device 50 at this time is at the HP position described above.

In this standby state, an image signal and a command instructing to continuously form monochrome images on 100 sheets of media are input from a not-shown host computer to the main controller 101 of the printer 10 via the interface (I/F) 112 (step S4). The printer 10 controls the unit controller 102 based on the command from the main controller 101 to change the position of the YMCK developing device 50 from the HP position to the developing position by rotating the YMCK developing device 50 (step S6).

This rotating operation of the YMCK developing device 50 (which is also referred to as "rotating operation A" in the present embodiment for convenience) will be described using FIG. 7A. First, the unit controller 102 controls a YMCK developing device drive control circuit to rotate the YMCK developing device 50 once by rotating the pulse motor for a predetermined amount of pulses (step S102). Then, at this position, that is, at the HP position, the YMCK developing device 50 is temporarily halted for a predetermined period of time (step S104). Next, the YMCK developing device 50 is rotated by approximately a half revolution by rotating the pulse motor for a predetermined amount of pulses, thereby changing the position of the YMCK developing device 50 to the developing position (step S106).

That is, the printer 10 rotates the YMCK developing device 50 at least once (approximately 1.5 turns in the present embodiment) when starting the continuous image formation. Further, during rotational movement of the YMCK developing device 50, the rotating body is temporarily halted at least once (once in the present embodiment).

The printer 10 starts the continuous image formation using the black toner after the position of the YMCK developing device 50 has been positioned at the developing position. When images are to be continuously formed on a plurality of number of sheets of media using toner of a single color, the printer 10 rotates the YMCK developing device 50 every time the number of sheets of media on which the images have been formed reaches a predetermined number of sheets. More specifically, in the present embodiment, the predetermined number of sheets is set to 48 sheets, and the YMCK developing device 50 is rotated every time the continuous image formation with respect to 48 sheets of media is finished.

Therefore, after the position of the YMCK developing device 50 has been positioned at the developing position, first, the printer 10 continuously forms images on the first through forty-eighth sheets of media (step S8). After finishing forming an image on the forty-eighth sheet of medium, the printer 10 rotates the YMCK developing device 50 once (step S10).

This rotating operation of the YMCK developing device 50 (which is also referred to as "rotating operation B" in the present embodiment for convenience) will be described using FIG. 7B. First, the unit controller 102 controls the YMCK developing device drive control circuit to rotate the YMCK developing device 50 by approximately a half revolution by rotating the pulse motor for a predetermined amount of pulses, thereby changing the position of the YMCK developing device 50 to the HP position (step S202). Then, at this position, that is, at the HP position, the YMCK developing device 50 is temporarily halted for a predetermined period of time (step S204). Next, the YMCK developing device 50 is rotated by approximately a half revolution by rotating the pulse motor for a predetermined amount of pulses, thereby changing the position of the YMCK developing device 50 to the developing position (step S206). That is, during rotational movement of the YMCK developing device 50, the rotating body is temporarily halted at least once (once in the present embodiment).

After the YMCK developing device 50 makes one revolution and the position of the YMCK developing device 50 is returned to the developing position, the printer 10 continuously forms images on the forty-ninth through ninety-sixth sheets of media (step S12) After finishing forming an image on the ninety-sixth sheet of medium, the printer 10 rotates the YMCK developing device 50 once (step S14). It should be noted that the rotating operation of the YMCK developing device 50 at this time is the same as the rotating operation B in step S10.

In the same way, after the YMCK developing device 50 makes one revolution and the position of the YMCK developing device 50 is returned to the developing position, the printer 10 continuously forms images on the ninety-seventh through the hundredth sheets of media and finishes forming images (step S16). Then, the printer 10 changes the position of the YMCK developing device 50 from the developing position to the HP position by rotating the YMCK developing device 50 (step S18).

This rotating operation of the YMCK developing device 50 (which is also referred to as "rotating operation C" in the present embodiment for convenience) will be described using FIG. 7C. First, the unit controller 102 controls the YMCK developing device drive control circuit to rotate the YMCK developing device 50 by approximately a half revolution by rotating the pulse motor for a predetermined amount of pulses, thereby changing the position of the YMCK developing device 50 to the HP position (step S302). Then, at this position, that is, at the HP position, the YMCK developing device 50 is temporarily halted for a predetermined period of time (step S304). Next, the YMCK developing device 50 is rotated once by rotating the pulse motor for a predetermined amount of pulses (step S306).

That is, the printer 10 rotates the YMCK developing device 50 at least once (approximately 1.5 turns in the present embodiment) when ending the continuous image formation. Further, during rotational movement of the YMCK developing device 50, the rotating body is temporarily halted at least once (once in the present embodiment).

Then, the printer 10 returns to the standby state in the end (step S20).

<<<About when Monochrome Images are Continuously Formed on 40 Sheets of Media>>>

Next, an example of continuously forming monochrome images on 40 sheets of media will be described with reference to the flowchart of FIG. 6B.

This flowchart starts from a state in which the printer 10 is on standby for image formation to be carried out (step S22), with the power of the printer 10 already turned ON. The standby position of the YMCK developing device 50 at this time is at the HP position described above.

In this standby state, an image signal and a command instructing to continuously form monochrome images on 40 sheets of media are input from a not-shown host computer to the main controller 101 of the printer 10 via the interface (I/F) 112 (step S24). The printer 10 controls the unit controller 102 based on the command from the main controller 101 to change the position of the YMCK developing device 50 from the HP position to the developing position by rotating the YMCK developing device 50 (step S26). It should be noted that the rotating operation of the YMCK developing device 50 at this time is the same as the rotating operation A in step S6.

The printer 10 starts the continuous image formation using the black toner after the position of the YMCK developing device 50 has been positioned at the developing position. The printer 10 is set so that when images are to be continuously formed on a plurality of number of sheets of media using toner of a single color, it rotates the YMCK developing device 50 every time the number of sheets of media on which the images have been formed reaches a predetermined number of sheets (which is 48 sheets as with the above-described example).

That is, the YMCK developing device 50 will be rotated every time the continuous image formation with respect to 48 sheets of media is finished. In the present embodiment, however, the number of sheets of media on which images are continuously formed is 40 sheets. Therefore, the YMCK developing device 50 will not rotate during the continuous image formation, in contrast to the above-described example.

Therefore, after the position of the YMCK developing device 50 has been positioned at the developing position, the printer 10 continuously forms images on 40 sheets of media and finishes forming images (step S28). Then, the printer 10 changes the position of the YMCK developing device 50 from the developing position to the HP position by rotating the YMCK developing device 50 (step S30). It should be noted that the rotating operation of the YMCK developing device 50 at this time is the same as the rotating operation C in step S18.

Then, the printer 10 returns to the standby state in the end (step S32).

===About the toner stirring effect obtained by the rotational movement of the YMCK developing device Next, the stirring effect of the toner T obtained by the rotational movement of the YMCK developing device 50 will be described using FIG. 8, taking a case where monochrome images are continuously formed on 100 sheets of media and a case where monochrome images are continuously formed on 40 sheets of media as examples and also making comparisons with comparative examples. FIG. 8 is an explanatory diagram for illustrating the toner stirring effect obtained by the rotational movement of the YMCK developing device 50.

As for the present embodiment, the toner stirring effect in the black developing unit obtained by the rotational movement of the YMCK developing device 50 is evaluated according to the number of times of rotations of the YMCK developing device 50 per one sheet of medium.

Further, examples in which the rotating operation A and the rotating operation C have been changed from the present examples are used as the comparative examples for comparison with the examples according to the present embodiment (which are also referred to as "present examples" below). That is, as for the comparative examples, in the steps of changing the position of the YMCK developing device 50 from the HP position to the developing position (step S6 and step S26), the YMCK developing device 50 is directly moved from the HP position to the developing position, and the YMCK developing device 50 is not halted during this process. Similarly, as for the comparative examples, in the steps of changing the position of the YMCK developing device 50 from the developing position to the HP position (step S18 and step S30), the YMCK developing device 50 is directly moved from the developing position to the HP position, and the YMCK developing device 50 is not halted during this process. That is, the configuration of the present examples that is different from the comparative examples is that the YMCK developing device 50 is rotated at least once when the continuous image formation is started and when the continuous image formation is ended.

Reference is now made to FIG. 8. FIG. 8 shows, for the present examples and the comparative examples, the number of times of rotations of the YMCK developing device 50 per one sheet of medium for when monochrome images are continuously formed on 100 sheets of media, and the number of times of rotations of the YMCK developing device 50 per one sheet of medium for when monochrome images are continuously formed on 40 sheets of media.

As described above, the numbers of times of rotations of the YMCK developing device 50 for the present examples are: 1.5 times for when the continuous monochrome-image formation is started; 1.5 times for when the continuous monochrome-image formation is ended; 2 times during the continuous monochrome-image formation for when monochrome images are continuously formed on 100 sheets of media; and 0 times for when monochrome images are continuously formed on 40 sheets of media. Therefore, the total number of times of rotations of the YMCK developing device 50 for when monochrome images are continuously formed on 100 sheets of media is 5 times, and the total number of times of rotations of the YMCK developing device 50 for when monochrome images are continuously formed on 40 sheets of media is 3 times.

On the contrary, the numbers of times of rotations of the YMCK developing device 50 for the comparative examples are: 0.5 times for when the continuous image formation is started; 0.5 times for when the continuous image formation is ended; 2 times during the continuous image formation for when monochrome images are continuously formed on 100 sheets of media; and 0 times for when monochrome images are continuously formed on 40 sheets of media. Therefore, the total number of times of rotations of the YMCK developing device 50 for when monochrome images are continuously formed on 100 sheets of media is 3 times, and the total number of times of rotations of the YMCK developing device 50 for when monochrome images are continuously formed on 40 sheets of media is 1 time.

Further, as shown in FIG. 8, the number of times of rotations of the YMCK developing device 50 per one sheet of medium is calculated based on the number of sheets of medium on which monochrome images are continuously formed (expressed as N in FIG. 8) and the total number of times of rotations of the YMCK developing device 50 (expressed as M in FIG. 8).

Below, consideration is made about the number of times of rotations of the YMCK developing device 50 per one sheet of medium, that is, about the toner stirring effect in the black developing unit obtained by the rotational movement of the YMCK developing device 50.

First, attention is paid to the comparative examples. The numbers of times of rotations of the YMCK developing device 50 per one sheet of medium is 0.03 times/sheet for when monochrome images are continuously formed on 100 sheets of media, and 0.025 times/sheet for when monochrome images are continuously formed on 40 sheets of media. This means that, compared to a case in which the number of sheets of media on which images are continuously formed (100 sheets) is larger than the predetermined number of sheets (48 sheets), a desirable toner stirring effect cannot be obtained if the number of sheets of media on which images are continuously formed (40 sheets) is smaller than the predetermined number of sheets (48 sheets) (and this is more significant particularly for cases in which the number of sheets of media on which images are continuously formed is close to the predetermined number of sheets). Therefore, if the operation of continuously forming images on 40 sheets of media is repeated for several times, then the toner flowability will deteriorate.

Attention is now paid to the present examples. The numbers of times of rotations of the YMCK developing device 50 per one sheet of medium is 0.05 times/sheet for when monochrome images are continuously formed on 100 sheets of media, and 0.075 times/sheet for when monochrome images are continuously formed on 40 sheets of media.

This result indicates that the toner stirring effect has improved. Further, the toner stirring effect is more significantly improved for the case in which the number of sheets of media on which images are continuously formed (40 sheets) is smaller than the predetermined number of sheets (48 sheets), compared to the case in which the number of sheets of media on which images are continuously formed (100 sheets) is larger than the predetermined number of sheets (48 sheets).

As described above, when images are to be continuously formed on a plurality of number of sheets of media using the toner T of the black color, the printer causes rotational movement of the YMCK developing device 50 at least once at least either when starting to continuously form the images, or when ending the continuous formation of the images. In this way, it is possible to obtain a desirable stirring effect particularly when the number of sheets of media on which images are continuously formed (40 sheets) is smaller than the predetermined number of sheets (48 sheets). Therefore, it becomes possible to reduce the deterioration in toner flowability, and thus, it becomes possible to avoid the problems caused thereby.

===Other Considerations===

In the foregoing, an image forming apparatus etc. according to the present invention was described according to the above-described embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing embodiment, an intermediate transferring type full-color laser beam printer was described as an example of the image forming apparatus, but the present invention is also applicable to various other types of image forming apparatuses, such as full-color laser beam printers that are not of the intermediate transferring type, monochrome laser beam printers, copying machines, and facsimiles.

Further, the photoconductor is not limited to the so-called photoconductive roller structured by providing a photoconductive layer on the outer peripheral surface of a cylindrical, conductive base. The photoconductor can be a so-called photoconductive belt structured by providing a photoconductive layer on a surface of a belt-like conductive base.

Further, in the foregoing embodiment, when the printer continuously forms images on a plurality of number of sheets of media using toner of a single color, the printer causes rotational movement of the YMCK developing device at least once both when the printer starts to continuously form the images and when the printer ends the continuous formation of the images. This, however, is not a limitation, and it is possible to rotate the YMCK developing device at least once either when the printer starts to continuously form the images, or when the printer ends the continuous formation of the images. Even in this way, it becomes possible to reduce the deterioration in toner flowability, which is caused because the developing units are not rotated during the continuous image formation when images are continuously formed on 40 sheets of media as described in the section of the "Description of the Related Art", and thus, it becomes possible to avoid the problems caused thereby.

Further, in the foregoing embodiment, the printer causes rotational movement of the YMCK developing device every time a number of sheets of media on which the images have been formed reaches a predetermined number of sheets when the printer continuously forms images on the plurality of number of sheets of media using the toner of the single color. This, however, is not a limitation. For example, the YMCK developing device does not have to be rotated during the continuous image formation when images are continuously formed on the plurality of number of sheets of media using the toner of the single color.

If, however, the YMCK developing device is rotated every time a number of sheets of media on which the images have been formed reaches a predetermined number of sheets when images are continuously formed on the plurality of number of sheets of media using the toner of the single color, then it is possible to obtain a more appropriate stirring effect in cooperation with the process of rotating the YMCK developing device at least once at least either when the printer starts to continuously form the images or when the printer ends the continuous formation of the images. Therefore, the foregoing embodiment is more preferable in terms that it becomes possible to reduce the deterioration in toner flowability more appropriately, and therefore, it is possible to avoid the problems caused by such deterioration more certainly.

Further, in the foregoing embodiment, the YMCK developing device is temporarily halted at least once while the YMCK developing device is rotated. This, however, is not a limitation. For example, the YMCK developing device does not have to be halted while the YMCK developing device is rotated.

If, however, the YMCK developing device is temporarily halted at least once while the YMCK developing device is rotated, then the toner in the developing unit will be rapidly accelerated before and after the halt. This acceleration causes a force that makes the toner move, and thus, stirring of the toner is carried out more effectively. Therefore, the foregoing embodiment is more preferable in terms that it becomes possible to reduce the deterioration in toner flowability more appropriately and that the problems caused thereby is avoided more certainly.

Further, in the foregoing embodiment, the developing unit includes: a developing roller for bearing the toner; and a toner supplying roller for supplying the toner to the developing roller. This, however, is not a limitation. For example, the developing unit does not have to be provided with a developing roller for bearing the toner and a toner supplying roller for supplying the toner to the developing roller.

As for the case in which the developing unit includes a developing roller and a toner supplying roller, when images are continuously formed on the plurality of number of sheets of media using the toner of the single color, development will be continuously carried out using the toner that is supplied to the developing roller by the toner supplying roller and that is bore by the developing roller, without the toner being stirred. As a result, only the toner, out of all the toner contained in the developing unit, that is positioned close to the developing roller and the toner supplying roller will deteriorate. That is, toner having significantly different characteristics will exist in the developing unit (i.e., the characteristics of the toner will be polarized into two). When toner having different characteristics is mixed, problems such as image fogging, toner scattering, and toner spilling will arise.

In such a situation, the toner-stirring effect, which is obtained by rotating the YMCK developing device at least once at least either when the continuous image formation is started or when the continuous image formation is ended, becomes more important in terms of preventing the occurrence of such problems. Therefore, the foregoing embodiment is more effective in terms that the object of the present invention is achieved more effectively.

Further, in the foregoing embodiment, the direction from the developing unit, which is attached to the YMCK developing device and which contains the toner of the single color, towards the rotating shaft of the YMCK developing device when the printer temporarily halts the YMCK developing device during rotational movement of the YMCK developing device is in the direction from the rotating shaft towards the developing unit that contains the toner of the single color when the YMCK developing device is positioned at a predetermined developing position for developing the latent image with the toner of the single color bore by the developing roller. This, however, is not a limitation.

In the present embodiment, however, the directions relative to the developing unit, i.e., the directions in which gravity acts on the single-color toner in the developing unit are approximately in opposite directions upon development and upon halt. Therefore, the foregoing embodiment is more preferable in terms that the toner, which has settled out in the direction of gravity upon development, will be dissolved more appropriately by the movement of the YMCK developing device to the halt position caused by the rotational movement of the YMCK developing device and the halt at the halt position.

Further, in the foregoing embodiment, the developing unit includes a partitioning wall that is for partitioning the toner and that protrudes inward from an inner wall of the developing unit, and two developer containing sections formed by partitioning the developing unit with the partitioning wall; and the toner supplying roller is provided in one of the two developer containing sections. This, however, is not a limitation. For example, the partitioning wall does not have to be provided, and there may only be one developer containing section. Further, the toner supplying roller does not have to be provided in either one of the two developer containing sections.

In a state in which the developing unit includes two developer containing sections formed by partitioning the developing unit with the partitioning wall and the toner supplying roller is provided in one of the two developer containing sections, since the toner in the developer containing section in which the toner supplying roller is provided and the toner in the other developer containing section are separated from each other, the above-described polarization in toner characteristics will occur more significantly.

In such a situation, the toner-stirring effect, which is obtained by rotating the YMCK developing device at least once at least either when the continuous image formation is started or when the continuous image formation is ended, becomes even more important. Therefore, the foregoing embodiment is more effective in terms that the object of the present invention is achieved more effectively.

Further, in the foregoing embodiment, an angle formed between a protruding direction of the partitioning wall of the developing unit, which is attached to the YMCK developing device and which contains the toner of the single color, and a vertically downward direction is smaller than 90° when the printer temporarily halts the YMCK developing device during rotational movement of the YMCK developing device. This, however, is not a limitation, and the angle formed between the above-mentioned protruding direction and the vertically downward direction may be 90° or above.

The foregoing embodiment, however, is more preferable in terms that, when the angle formed between the above-mentioned protruding direction and the vertically downward direction is smaller that 90°, the toner contained in both of the two developer containing sections will be mixed more easily when the YMCK developing device is temporarily halted, and therefore, stirring of the toner will be carried out appropriately.

Further, in the foregoing embodiment, the halt position of the YMCK developing device for when the printer temporarily halts the YMCK developing device during rotational movement of the YMCK developing device is the standby position, i.e., the HP position, of the YMCK developing device for when the printer is on standby for formation of an image to be carried out. This, however, is not a limitation, and other positions may be adopted.

The foregoing embodiment, however, is more preferable in terms that the toner that has settled out in the direction of gravity upon development is dissolved more appropriately, and that, if the above-mentioned halt position of the YMCK developing device, where the toner can be easily mixed, is the HP position, it becomes possible to obtain an appropriate toner-stirring effect even when the apparatus is on standby for image formation to be carried out.

Further, in the foregoing embodiment, the toner of the single color is black toner. This, however, is not a limitation, and other colors may be adopted.

The foregoing embodiment, however, is more preferable in terms that the importance of the present invention increases when the single-color toner is black toner, and therefore, the object of the present invention is achieved more effectively. This is because, in an overwhelming number of cases, black toner is used as the single-color toner when images are continuously formed on a plurality of number of sheets of media using single-color toner.

Further, in the foregoing embodiment, the developing unit is not provided with a stirring member for stirring the toner. This, however, is not a limitation, and a stirring member may be provided.

The foregoing embodiment, however, is more preferable in terms that the importance of the present invention increases and therefore, the object of the present invention is achieved more effectively when a stirring member is not provided.

Further, in the foregoing embodiment, an image forming apparatus to and from which developing units can be attached and detached was described as an example. The present invention, however, is of course applicable to image forming apparatuses in which the developing units are attached thereto and are not detachable.

Second Embodiment

===Overall Configuration Example of Image Forming Apparatus===

Figure 9:
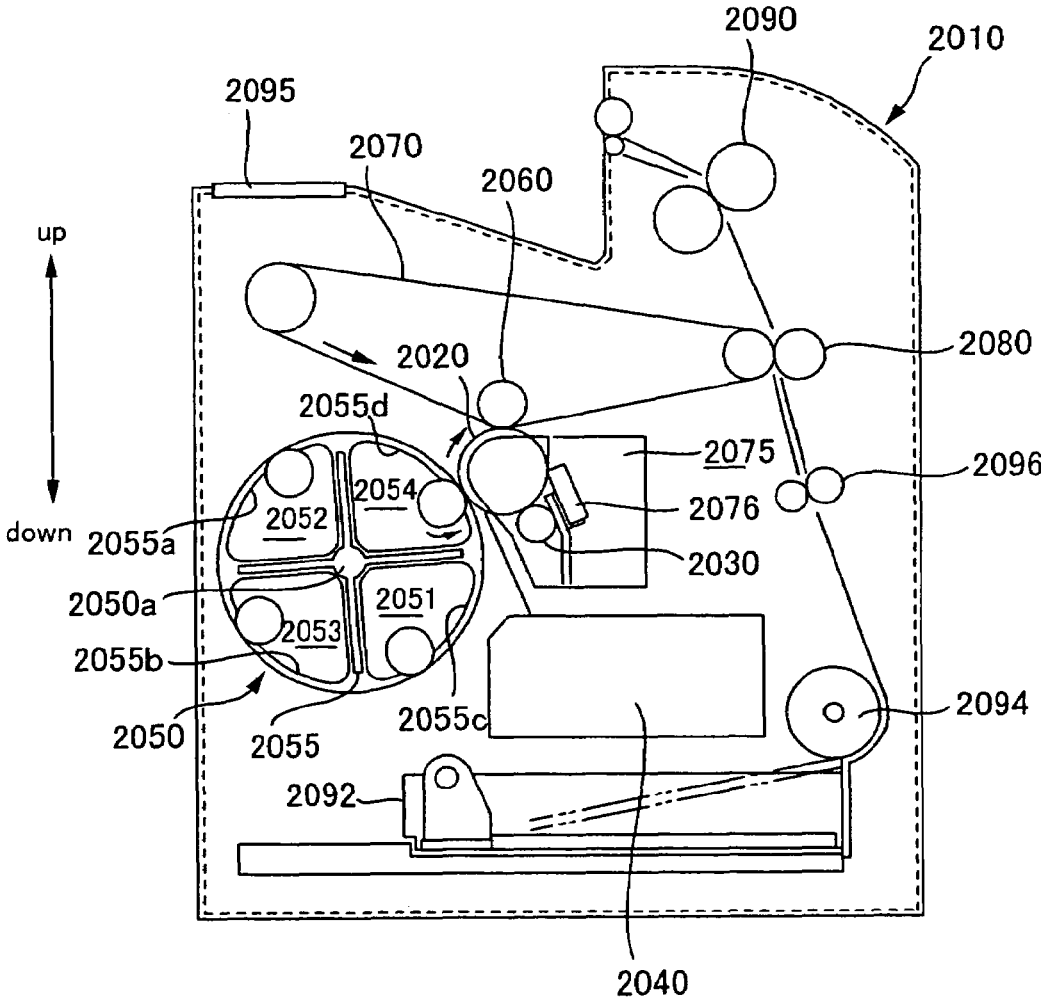
FIG. 9 is a diagram showing main structural components constructing an image forming apparatus according to another embodiment.

Next, using FIG. 9, an outline of an image-forming apparatus will be described, taking a laser-beam printer 2010 (hereinafter referred to also as "printer") as an example. FIG. 9 is a diagram showing main structural components constructing the printer 2010. Note that in FIG. 9, the vertical direction is shown by the arrow, and, for example, a paper supply tray 2092 is arranged at a lower section of the printer 2010, and a fusing unit 2090 is arranged at an upper section of the printer 2010.

As shown in FIG. 9, the printer 2010 according to the present embodiment includes a charging unit 2030, an exposing unit 2040, a YMCK developing device 2050 which serves as an example of a rotatable rotating body, a first transferring unit 2060, an intermediate transferring body 2070, and a cleaning unit 2075, all of which being arranged in the direction of rotation of a photoconductor 2020, which serves as an example of an image bearing body for bearing a latent image. The printer 2010 further includes a second transferring unit 2080, a fusing unit 2090, a displaying unit 2095 constructed of a liquid-crystal panel and serving as means for making notifications to a user, and a control unit (FIG. 10) for controlling these units etc. and managing the operations as a printer.

The photoconductor 2020 has a cylindrical conductive base and a photoconductive layer formed on the outer peripheral surface of the conductive base, and it is rotatable about a central axis. In the present embodiment, the photoconductor 2020 rotates clockwise, as shown by the arrow in FIG. 9.

The charging unit 2030 is a device for charging the photoconductor 2020. The exposing unit 2040 is a device for forming a latent image on the charged photoconductor 2020 by radiating laser thereon. The exposing unit 2040 has, for example, a semiconductor laser, a polygon mirror, and an F-θ lens, and radiates modulated laser onto the charged photoconductor 2020 according to image information having been input from a not-shown host computer such as a personal computer or a word processor.

The YMCK developing device 2050 is a device for developing the latent image formed on the photoconductor 2020 using toner T, that is, black (K) toner contained in a black developing unit 2051, magenta (M) toner contained in a magenta developing unit 2052, cyan (C) toner contained in a cyan developing unit 2053, and yellow (Y) toner contained in a yellow developing unit 2054. The toner T is an example of developer contained in each of the developing units, which serve as an example of a developer container.

In the present embodiment, the YMCK developing device 2050 can move the positions of the four developing units 2051, 2052, 2053, and 2054 by rotating. More specifically, the YMCK developing device 2050 holds the four developing units 2051, 2052, 2053, and 2054 with four holding sections 2055*a*, 2055*b*, 2055*c*, and 2055*d*. The four developing units 2051, 2052, 2053, and 2054 can be rotated about a rotating shaft 2050*a* while maintaining their relative positions. Every time an image forming process for one page is finished, each of the developing units selectively opposes the photoconductor 2020 to successively develop the latent image formed on the photoconductor 2020 using the toner T contained in each of the developing units 2051, 2052, 2053, and 2054. It should be noted that each of the four developing units 2051, 2052, 2053, and 2054 described above is attachable to and detachable from the respective holding sections of the YMCK developing device 2050. Further, details on the YMCK developing device 2050 and the developing units will be described later.

The first transferring unit 2060 is a device for transferring, onto the intermediate transferring body 2070, a single-color toner image formed on the photoconductor 2020. When the toners of all four colors are successively transferred in a superimposing manner, a full-color toner image will be formed on the intermediate transferring body 2070.

The intermediate transferring body 2070 is a laminated endless belt that is made by providing an aluminum layer on the surface of a PET film by vapor deposition, and then further applying semiconducting coating on the outer layer thereof. The intermediate transferring body 2070 is driven to rotate at substantially the same circumferential speed as the photoconductor 2020.

The second transferring unit 2080 is a device for transferring the single-color toner image or the full-color toner image formed on the intermediate transferring body 2070 onto a medium such as paper, film, and cloth.

The fusing unit 2090 is a device for fusing the single-color toner image or the full-color toner image, which has been transferred onto the medium, onto the medium to make it into a permanent image.

The cleaning unit 2075 is a device that is provided between the first transferring unit 2060 and the charging unit 2030, that has a rubber cleaning blade 2076 made to abut against the surface of the photoconductor 2020, and that is for removing the toner T remaining on the photoconductor 2020 by scraping it off with the cleaning blade 2076 after the toner image has been transferred onto the intermediate transferring body 2070 by the first transferring unit 2060.

Figure 10:
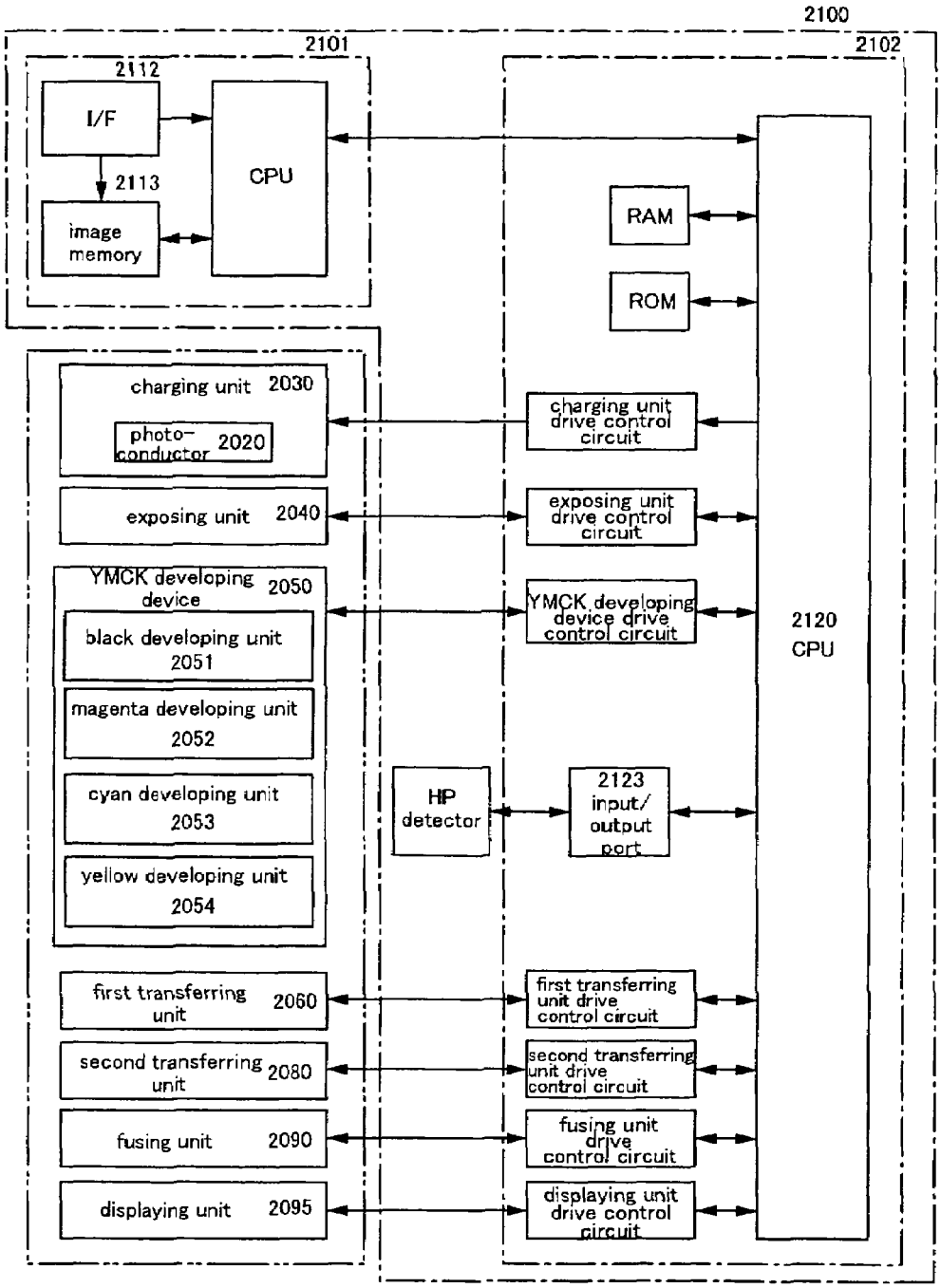
FIG. 10 is a block diagram showing a control unit of the image forming apparatus in FIG. 9.

The control unit 2100 comprises a main controller 2101 and a unit controller 2102 as shown in FIG. 10. An image signal is input to the main controller 2101, and according to instructions based on the image signal, the unit controller 2102 controls each of the above-mentioned units etc. to form an image.

Next, operations of the printer 2010 structured as above will be described with reference to other structural components.

First, when an image signal is input from the not-shown host computer to the main controller 2101 of the printer 2010 through an interface (I/F) 2112, the photoconductor 2020, a developing roller as an example of a developer bearing body, and the intermediate transferring body 2070 rotate under the control of the unit controller 2102 based on the instructions from the main controller 2101. While being rotated, the photoconductor 2020 is successively charged by the charging unit 2030 at a charging position.

With the rotation of the photoconductor 2020, the charged area of the photoconductor 2020 reaches an exposing position. A latent image that corresponds to the image information about the first color, for example, yellow Y, is formed in that area by the exposing unit 2040. The YMCK developing device 2050 positions the yellow developing unit 2054, which contains yellow (Y) toner, in the developing position opposing the photoconductor 2020.

With the rotation of the photoconductor 2020, the latent image formed on the photoconductor 2020 reaches the developing position, and is developed with the yellow toner by the yellow developing unit 2054. Thus, a yellow toner image is formed on the photoconductor 2020.

With the rotation of the photoconductor 2020, the yellow toner image formed on the photoconductor 2020 reaches a first transferring position, and is transferred onto the intermediate transferring body 2070 by the first transferring unit 2060. At this time, a first transferring voltage, which is in an opposite polarity to the polarity to which the toner T is charged, is applied to the first transferring unit 2060. It should be noted that, during this process, the photoconductor 2020 and the intermediate transferring body 2070 are placed in contact with each other, and the second transferring unit 2080 is kept separated from the intermediate transferring body 2070.

By subsequently performing the above-mentioned processes for the second, the third, and the fourth colors for each of the developing units, toner images in four colors corresponding to the respective image signals are transferred to the intermediate transferring body 2070 in a superimposed manner. As a result, a full-color toner image is formed on the intermediate transferring body 2070.

With the rotation of the intermediate transferring body 2070, the full-color toner image formed on the intermediate transferring body 2070 reaches a second transferring position, and is transferred onto a medium by the second transferring unit 2080. It should be noted that the medium is carried from the paper supply tray 2092 to the second transferring unit 2080 via the paper-feed roller 2094 and resisting rollers 2096. During transferring operations, a second transferring voltage is applied to the second transferring unit 2080 and also the unit 2080 is pressed against the intermediate transferring body 2070.

The full-color toner image transferred onto the medium is heated and pressurized by the fusing unit 2090 and fused to the medium.

On the other hand, after the photoconductor 2020 passes the first transferring position, the toner T adhering to the surface of the photoconductor 2020 is scraped off by the cleaning blade 2076 that is supported on the cleaning unit 2075, and the photoconductor 2020 is prepared for charging for forming the next latent image. The scraped-off toner T is collected in a remaining-toner collector that the cleaning unit 2075 comprises.

===Configuration Example of Developing Unit===

Figure 11:
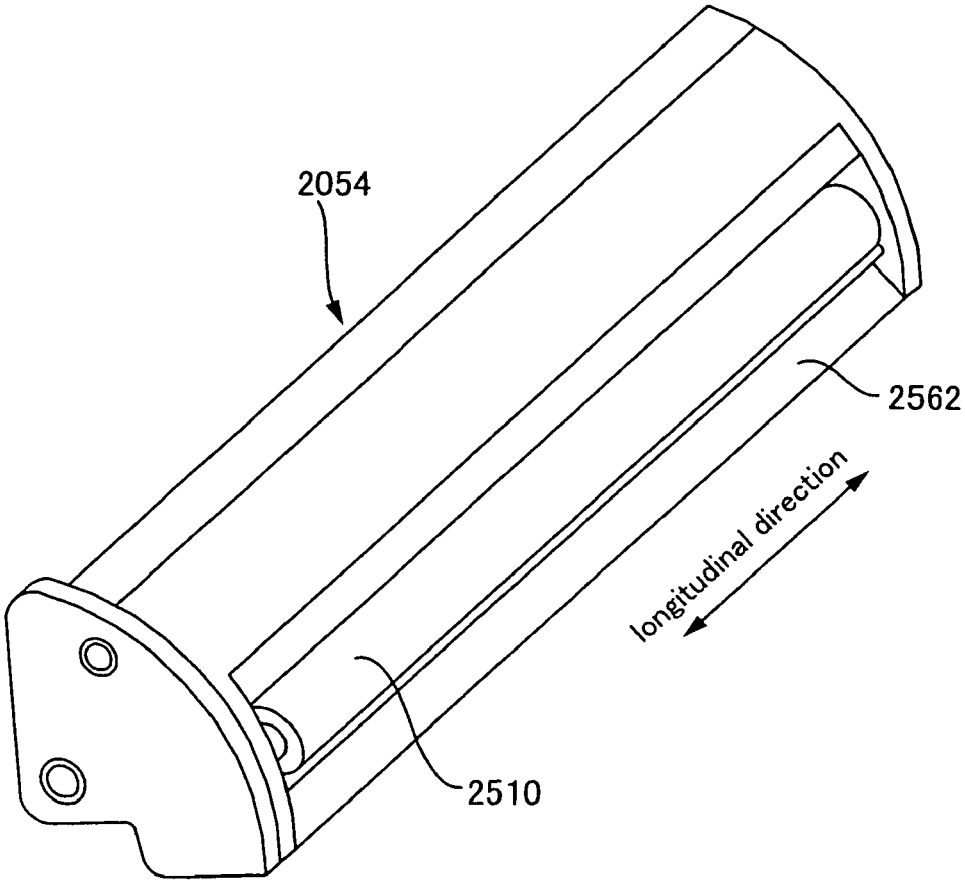
FIG. 11 is a conceptual diagram of a developing unit.
Figure 12:
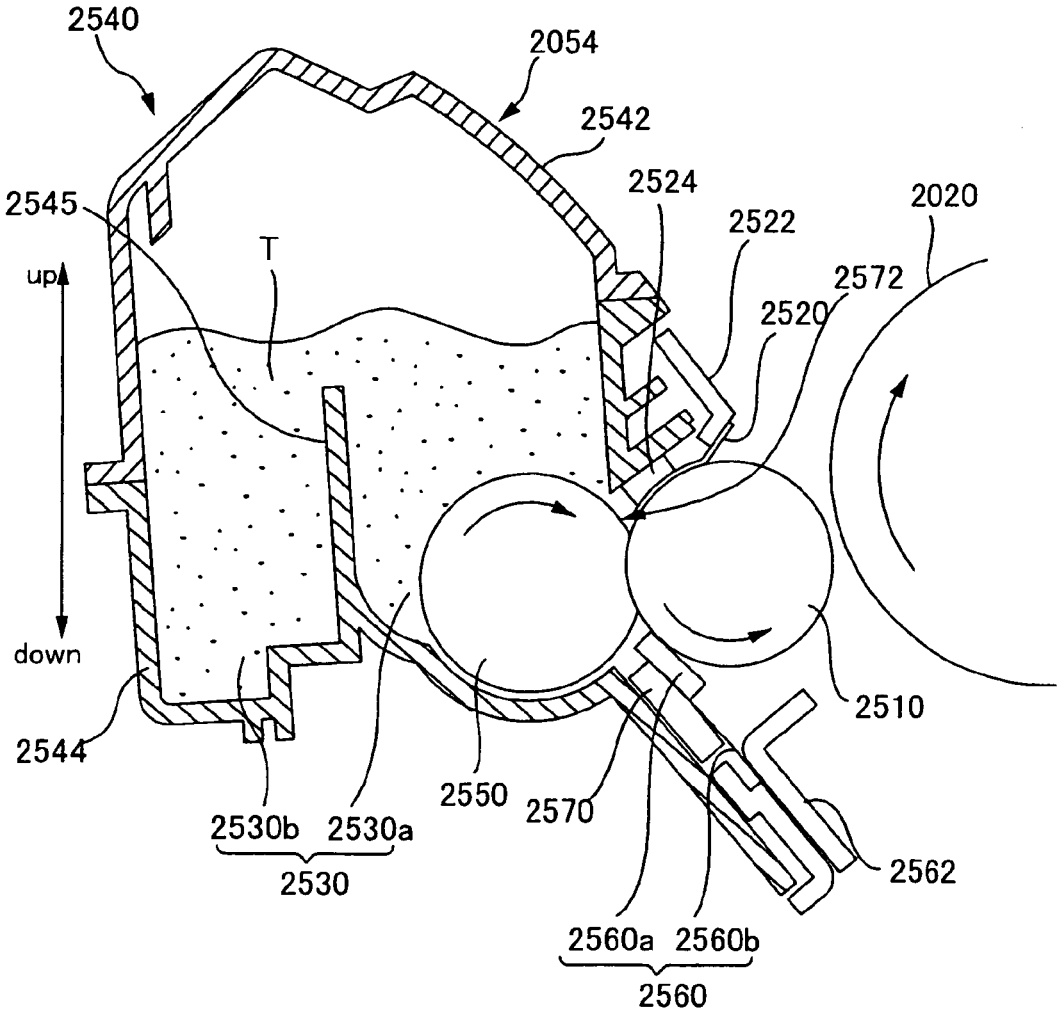
FIG. 12 is a section view showing main structural components of the developing unit.

Next, using FIG. 11 and FIG. 12, an example of a configuration of the developing units will be described. FIG. 11 is a conceptual diagram of a developing unit. FIG. 12 is a section view showing main structural components of the developing unit. Note that the section view shown in FIG. 12 is a section of the developing unit bisected by a plane perpendicular to the longitudinal direction shown in FIG. 11. Further, in FIG. 12, the arrow indicates the vertical direction as in FIG. 9, and, for example, the central axis of the developing roller 2510 is located below the central axis of the photoconductor 2020. Further, in FIG. 12, the yellow developing unit 2054 is shown to be in a state in which it is positioned at the developing position opposing the photoconductor 2020.

The YMCK developing device 2050 comprises: the black developing unit 2051 containing black (K) toner; the magenta partitioning wall 2545 in the state shown in FIG. 12. However, when the YMCK developing device 2050 rotates, the toner contained in the first toner containing section 2530*a* and the second toner containing section 2530*b* is once gathered in the side of the communicated section, which is in the upper side when in the developing position, and when the device returns to the state shown in FIG. 12, the toner is mixed and then returned to the first toner containing section 2530*a* and the second toner containing section 2530*b*. That is, the toner T in the developing units is appropriately stirred by the rotation of the YMCK developing device 2050.

For this reason, no stirring member is provided in the toner containing sections 2530 in this embodiment, but a stirring member for stirring the toner T contained in the toner containing sections 2530 may be provided. Further, as shown in FIG. 12, the housing 2540 has an opening 2572 at its lower section. The developing roller 2510 is arranged in this opening 2572 in such a state that a part of the roller 2510 is exposed to the outside.

The toner supplying roller 2550 is provided in the first toner containing section 2530*a* described above and supplies the toner T contained in the first toner containing section 2530*a* to the developing roller 2510. The toner supplying roller 2550 is made of, for example, polyurethane foam, and is made to abut against the developing roller 2510 in an elastically deformed state. The toner supplying roller 2550 is arranged at a lower section of the toner containing sections 2530. The toner T contained in the toner containing sections 2530 is supplied to the developing roller 2510 by the toner supplying roller 2550 at the lower section of the toner containing sections 2530. The toner supplying roller 2550 is rotatable about a central axis. The central axis of the toner supplying roller 2550 is situated below the central axis of rotation of the developing roller 2510. Further, the toner supplying roller 2550 rotates in the opposite direction (clockwise in FIG. 12) to the rotating direction of the developing roller 2510 (counterclockwise in FIG. 12). Note that the toner supplying roller 2550 has the function of supplying the toner T contained in the toner containing sections 2530 to the developing roller 2510 as well as the function of stripping off the toner T remaining on the developing roller 2510 after development from the developing roller 2510.

The restriction blade 2560 restricts the thickness of the layer of the toner T bore by the developing roller 2510 and also gives charge to the toner T bore by the developing roller 2510. This restriction blade 2560 has a rubber section 2560*a* and a rubber-supporting section 2560*b*. The rubber section 2560*a* is made of, for example, silicone rubber or urethane rubber. The rubber-supporting section 2560*b* is a thin plate that is made of, for example, phosphor bronze or stainless steel, and that has a springy characteristic. The rubber section 2560*a* is supported by the rubber-supporting section 2560*b*. The rubber-supporting section 2560*b* is attached to the housing 2540 via a pair of blade-supporting metal plates 2562 in a state that one end of the rubber-supporting section 2560*b* is pinched between and supported by the blade-supporting metal plates 2562. Further, a blade-backing member 2570 made of, for example, Moltoprene is provided on one side of the restriction blade 2560 opposite to the side of the developing roller 2510.

The rubber section 2560*a* is pressed against the developing roller 2510 by the elastic force caused by the flexure of the rubber-supporting section 2560*b*. Further, the blade-backing member 2570 prevents the toner T from entering in between the rubber-supporting section 2560*b* and the housing 2540, stabilizes the elastic force caused by the flexure of the rubber-supporting section 2560*b*, and also, applies force to the rubber section 2560*a* from the back thereof towards the developing roller 2510 to press the rubber section 2560*a* against the developing roller 2510. In this way, the blade-backing member 2570 makes the rubber section 2560*a* abut against the developing roller 2510 more evenly.

The end of the restricting blade 2560 opposite to the end that is being supported by the blade-supporting metal plates 2562, i.e., the tip end, is not placed in contact with the developing roller 2510; rather, a section at a predetermined distance from the tip end contacts, with some breadth, the developing roller 2510. That is, the restriction blade 2560 does not abut against the developing roller 2510 at its edge, but abuts against the roller 2510 near its central portion. Further, the restriction blade 2560 is arranged so that its tip end faces towards the upper stream of the rotating direction of the developing roller 2510, and thus, makes a so-called counter-abutment with respect to the roller 2510. It should be noted that the abutting position at which the restriction blade 2560 abuts against the developing roller 2510 is below the central axis of the developing roller 2510 and is also below the central axis of the toner supplying roller 2550.

In the yellow developing unit 2054 thus structured, the toner supplying roller 2550 supplies the toner T contained in the toner containing sections 2530 to the developing roller 2510. With the rotation of the developing roller 2510, the toner T, which has been supplied to the developing roller 2510, reaches the abutting position of the restriction blade 2560; then, as the toner T passes the abutting position, the toner is charged and its layer thickness is restricted. With further rotation of the developing roller 2510, the toner Ton the developing roller 2510, whose layer thickness has been restricted, reaches the developing position opposing the photoconductor 2020; then, under the alternating field, the toner T is used at the developing position for developing the latent image formed on the photoconductor 2020. With further rotation of the developing roller 2510, the toner T on the developing roller 2510, which has passed the developing position, passes the sealing member 2520 and is collected into the developing unit by the sealing member 2520 without being scraped off. Then, the toner T that still remains on the developing roller 2510 can be stripped off by the toner supplying roller 2550.

===Overview of YMCK Developing Device===

Next, an overview of the YMCK developing device 2050 will be described using FIG. 13.

The YMCK developing device 2050 has a rotating shaft 2050*a* positioned at the center. A support frame 2055 for holding the developing units is fixed to the rotating shaft 2050*a*. The rotating shaft 2050*a* is provided extending between two frame side plates (not shown) which form a casing of the printer 2010, and both ends of the shaft 2050*a* are supported.

The support frame 2055 includes the four holding sections 2055*a*, 2055*b*, 2055*c*, and 2055*d*, by which the above-described developing units 2051, 2052, 2053, and 2054 of the four colors are held in an attachable/detachable manner about the rotating shaft 2050*a*, in the circumferential direction at an interval of 90°.

A pulse motor, which is not shown, is connected to the rotating shaft 2050*a* via a clutch. By driving the pulse motor, it is possible to rotate the support frame 2055 and position the four developing units 2051, 2052, 2053, and 2054 mentioned above at predetermined positions.

Figure 13A:
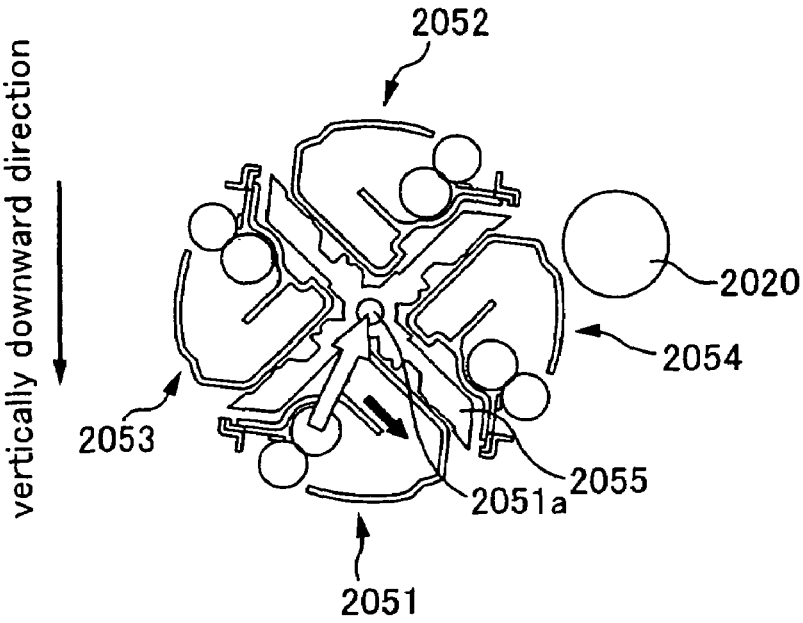
FIG. 13A is a diagram showing the home position which is the reference position in the rotating direction of a YMCK developing device 2050.
Figure 13B:
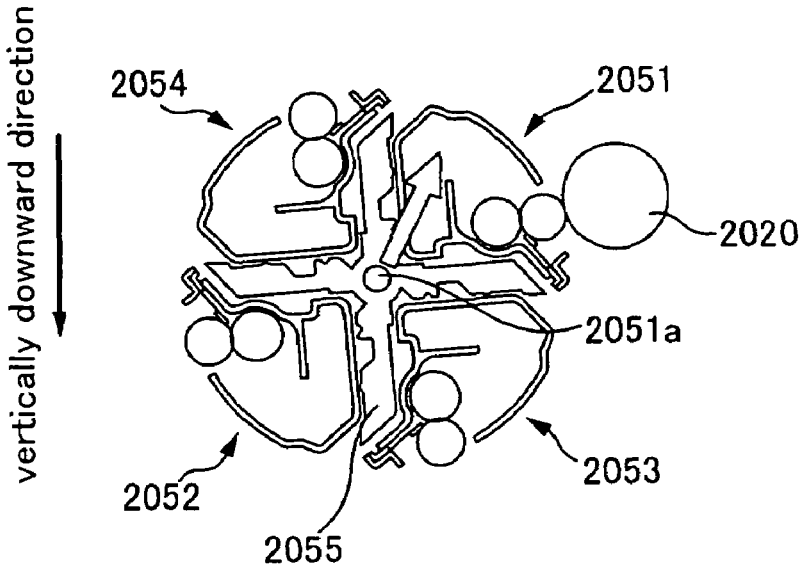
FIG. 13B is a diagram showing the developing position where a black developing unit 2051, which is attached to the YMCK developing device 2050, is in opposition to a photoconductor 2020.

FIG. 13 are diagrams showing two halt positions of the rotating YMCK developing device 2050. FIG. 13A shows the home position (referred to as "HP position" below) which is the reference position in the rotating direction of the YMCK developing device 2050. FIG. 13B shows the developing position where the black developing unit 2051, which is attached to the YMCK developing device 2050, is in opposition to the photoconductor 2020.

In FIG. 13B, the developing position is explained with regard to the black developing unit 2051, but this position becomes the developing position for each of the other developing units when the YMCK developing device 2050 is rotated at 90° intervals.

An HP detector (not shown) for detecting the HP position is provided on the side of one end of the rotating shaft 2050*a* of the YMCK developing device 2050. The HP detector is structured of a disk that is for generating signals and that is fixed to one end of the rotating shaft 2050*a*, and an HP sensor that is made up of, for example, a photointerrupter having a light emitting section and a light receiving section. The peripheral section of the disk is arranged so that it is located between the light emitting section and the light receiving section of the HP sensor. When a slit formed in the disk moves to a detecting position of the HP sensor, the signal that is output from the HP sensor changes from "L" to "H". The device is constructed such that the HP position of the YMCK developing device 2050 is detected based on this change in signal level and the number of pulses of the pulse motor, and by taking this HP position as a reference, each of the developing units can be positioned at, for example, the developing position.

FIG. 13B shows the developing position of the black developing unit 2051 which is achieved by rotating the pulse motor for a predetermined number of pulses from the above-mentioned HP position. At this developing position, the developing roller 2510 of the black developing unit 2051 and the photoconductor 2020 oppose each other, and development using black toner becomes possible. Further, when the pulse motor rotates the YMCK developing device 2050 90° in the counterclockwise direction, this position becomes the developing position for the cyan developing unit 2053, and every time the YMCK developing device 2050 is rotated 900, this position successively becomes the developing position for each developing unit.

Attention is now paid to the positions of the black developing unit 2051 in FIG. 13A and FIG. 13B. The direction from the black developing unit 2051 towards the rotating shaft 2050*a* when in the HP position of the YMCK developing device 2050 (shown by the white arrow in FIG. 13A) is in the direction of the direction from the rotating shaft 2050*a* towards the black developing unit 2051 when in the developing position of the black developing unit 2051 (shown by the white arrow in FIG. 13B). That is, the position of the black developing unit 2051 at the HP position and the position of the black developing unit 2051 at the developing position of the black developing unit 2051 are positioned approximately on opposite sides with respect to the rotating shaft 2050*a*. Further, at the HP position of the YMCK developing device 2050, the angle formed between the protruding direction of the above-described partitioning wall of the black developing unit 2051 (shown by the bold black arrow in FIG. 13A) and the vertically downward direction (shown by the thin black arrow in FIG. 13A) is smaller than 90°.

One of the two frame side plates that support the YMCK developing device 2050 and that form the casing of the printer 2010 is provided with a not-shown attach/detach dedicated opening through which one of the developing units can pass. The attach/detach dedicated opening is formed at a position where only a relevant developing unit can be pulled out in the direction of the rotating shaft 2050*a* when the YMCK developing device 2050 is rotated and the relevant one of the developing units is halted at a developing unit attach/detach position which is set for each developing unit. Further, the attach/detach dedicated opening is formed slightly larger than the outer shape of a developing unit, and at the developing unit attach/detach position, it is possible to insert a new developing unit through this attach/detach dedicated opening in the direction of the rotating shaft 2050*a* and attach the developing unit to the support frame 2055. While the developing unit is positioned at positions other than the developing unit attach/detach position, the attached state of that developing unit is restricted by the frame side plates.

It should be noted that a lock mechanism, which is not shown, is provided for certainly positioning and fixing the YMCK developing device 2050 at the developing position and the attach/detach dedicated position.

===Overview of Control Unit===

Next, with reference to FIG. 10, the configuration of the control unit 2100 will be described. The main controller 2101 of the control unit 2100 is connected to the host computer through the interface 2112 and includes an image memory 2113 for storing image signals that have been input from the host computer. The unit controller 2102 is electrically connected to each of the units of the main apparatus (i.e., the charging unit 2030, the exposing unit 2040, the first transferring unit 2060, the cleaning unit 2075, the second transferring unit 2080, the fusing unit 2090, and the displaying unit 2095) and the YMCK developing device 2050. By receiving signals from sensors provided on each of the units, the unit controller 2102 detects the state of each unit and the YMCK developing device 2050 and controls each unit and the YMCK developing device 2050 according to the signals input from the main controller 2101. Further, the HP detector described above is connected to the CPU 2120 via an input/output port 2123.

===About the Operation of the YMCK Developing Device when Images are Continuously Formed According to Monochrome Image-Forming Mode===

In the section of the "Overall configuration example of image forming apparatus", operations of the printer 2010 when it forms a color image were described. The printer 2010 according to the present embodiment, however, is also capable of forming single-color images using toner of a single color. Here, a procedure for continuously forming monochrome images on a plurality of number of sheets of media with black toner will be described using FIG. 14 and FIG. 15 and paying particular attention to the rotating operations of the YMCK developing device 2050.

Figure 14A:
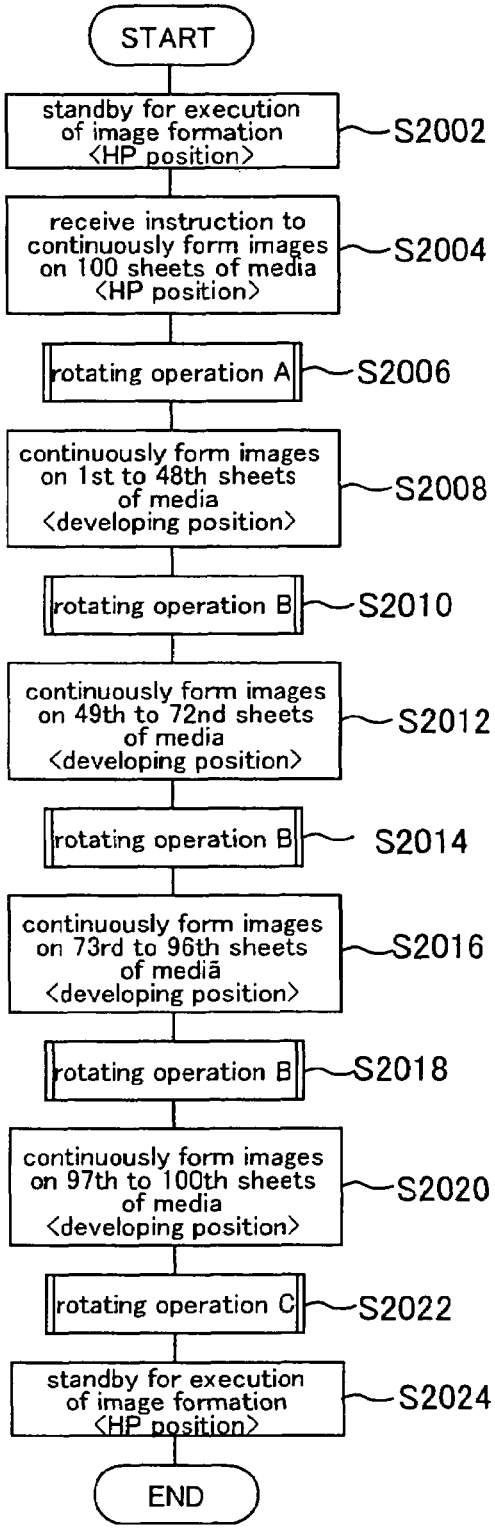
FIG. 14A is a flowchart showing a procedure for continuously forming monochrome images on 100 sheets of media using black toner.
Figure 14B:
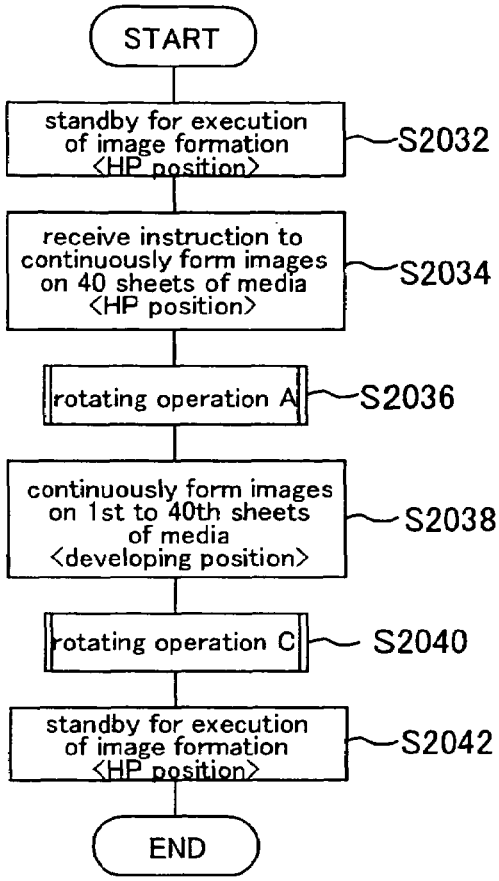
FIG. 14B is a flowchart showing a procedure for continuously forming monochrome images on 40 sheets of media using black toner.
Figure 15A:
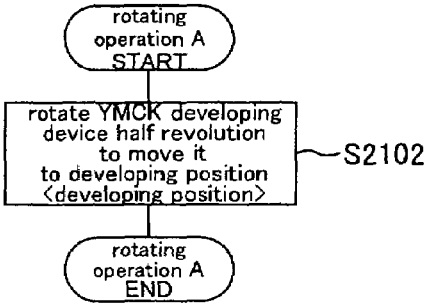
FIG. 15A is a flowchart showing the rotating operation A of a developing unit shown in the flowcharts of FIG. 14.
Figure 15B:
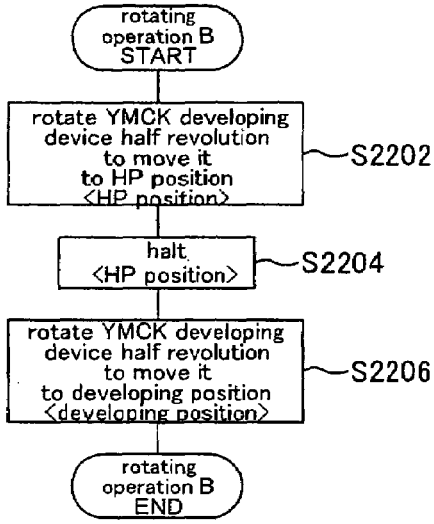
FIG. 15B is a flowchart showing the rotating operation B of the developing unit shown in the flowcharts of FIG. 14.
Figure 15C:
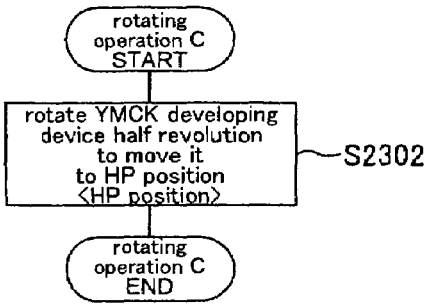
FIG. 15C is a flowchart showing the rotating operation C of a developing unit shown in the flowcharts of FIG. 14.

It should be noted that FIG. 14 are flowcharts showing a procedure for continuously forming monochrome images on a plurality of number of sheets of media with black toner. FIG. 14A shows a procedure for continuously forming monochrome images on 100 sheets of media. FIG. 14B shows a procedure for continuously forming monochrome images on 40 sheets of media. FIG. 15 are flowcharts showing rotating operations of a developing unit which are shown in the flowcharts of FIG. 14. FIG. 15A, FIG. 15B, and FIG. 15C are flowcharts showing the rotating operation A, the rotating operation B, and the rotating operation C, respectively.

During these procedures, the YMCK developing device 2050 moves back and forth between the developing position for carrying out development with the black developing unit (which is also merely referred to below as "developing position" in the present embodiment) and the above-described HP position. The positions at which the YMCK developing device 2050 is positioned are shown in angle brackets in the flowcharts of FIG. 14 and FIG. 15.

<<<About when Monochrome Images are Continuously Formed on 100 Sheets of Media>>>

First, an example of continuously forming monochrome images on 100 sheets of media will be described with reference to the flowchart of FIG. 14A.

This flowchart starts from a state in which the printer 2010 is on standby for image formation to be carried out (step S2002), with the power of the printer 2010 already turned ON. The standby position of the YMCK developing device 2050 at this time is at the HP position described above.

In this standby state, an image signal and a command instructing to continuously form monochrome images on 100 sheets of media are input from a not-shown host computer to the main controller 2101 of the printer 2010 via the interface (I/F) 2112 (step S2004). The printer 2010 controls the unit controller 2102 based on the command from the main controller 2101 to change the position of the YMCK developing device 2050 from the HP position to the developing position by rotating the YMCK developing device 2050 (step S2006).

This rotating operation of the YMCK developing device 2050 (which is also referred to as "rotating operation A" in the present embodiment for convenience) will be described using FIG. 15A. The unit controller 2102 controls a YMCK developing device drive control circuit to rotate the YMCK developing device 2050 by approximately a half revolution by rotating the pulse motor for a predetermined amount of pulses (step S2102). In this way, the position of the YMCK developing device 2050 is changed to the developing position.

The printer 2010 starts the continuous image formation using the black toner after the position of the YMCK developing device 2050 has been positioned at the developing position. When images are to be continuously formed on a plurality of number of sheets of media using toner of a single color, the printer 2010 rotates the YMCK developing device 2050 at a predetermined frequency, that is, every time the number of sheets of media on which the images have been formed reaches a unit number of sheets.

In addition, the predetermined frequency after the number of sheets of media on which the images have been continuously formed has reached the predetermined number of sheets is set higher than the predetermined frequency before the number of sheets reaches the predetermined number of sheets. In other words, the unit number of sheets after the number of sheets of media on which the images have been continuously formed has reached the predetermined number of sheets is set smaller than the unit number of sheets before the number of sheets reaches the predetermined number of sheets. In the present embodiment, the predetermined number of sheets is set to 48 sheets, the unit number of sheets before the number of sheets of media on which the images have been continuously formed reaches the predetermined number of sheets is set to 48 sheets, and the unit number of sheets after the number of sheets of media on which the images have been continuously formed has reached the predetermined number of sheets is set to 24 sheets. Therefore, the YMCK developing device 2050 rotates at timings described below.

After the position of the YMCK developing device 2050 has been positioned at the developing position, first, the printer 2010 continuously forms images on the first through forty-eighth sheets of media (step S2008). After finishing forming an image on the forty-eighth sheet of medium, the printer 2010 rotates the YMCK developing device 2050 once (step S2010).

This rotating operation of the YMCK developing device 2050 (which is also referred to as "rotating operation B" in the present embodiment for convenience) will be described using FIG. 15B. First, the unit controller 2102 controls the YMCK developing device drive control circuit to rotate the YMCK developing device 2050 by approximately a half revolution by rotating the pulse motor for a predetermined amount of pulses, thereby changing the position of the YMCK developing device 2050 to the HP position (step S2202). Then, at this position, that is, at the HP position, the YMCK developing device 2050 is temporarily halted for a predetermined period of time (step S2204). Next, the YMCK developing device 2050 is rotated by approximately a half revolution by rotating the pulse motor for a predetermined amount of pulses, thereby changing the position of the YMCK developing device 2050 to the developing position (step S2206). That is, during one revolution of the YMCK developing device 2050, the rotating body is temporarily halted at least once (once in the present embodiment).

After the YMCK developing device 2050 makes one revolution and the position of the YMCK developing device 2050 is returned to the developing position, the printer 2010 continuously forms images on the forty-ninth through seventy-second sheets of media (step S2012). After finishing forming an image on the seventy-second sheet of medium, the printer 2010 rotates the YMCK developing device 2050 once (step S2014). It should be noted that the rotating operation of the YMCK developing device 2050 at this time is the same as the rotating operation B in step S2010.

In the same way, after the YMCK developing device 2050 makes one revolution and the position of the YMCK developing device 2050 is returned to the developing position, the printer 2010 continuously forms images on the seventy-third through ninety-sixth sheets of media (step S2016). After finishing forming an image on the ninety-sixth sheet of medium, the printer 2010 rotates the YMCK developing device 2050 once (step S2018). It should be noted that the rotating operation of the YMCK developing device 2050 at this time is the same as the rotating operation B in step S2010.

In the same way, after the YMCK developing device 2050 makes one revolution and the position of the YMCK developing device 2050 is returned to the developing position, the printer 2010 continuously forms images on the ninety-seventh through the hundredth sheets of media and finishes forming images (step S2020) Then, the printer 2010 changes the position of the YMCK developing device 2050 from the developing position to the HP position by rotating the YMCK developing device 2050 (step S2022).

This rotating operation of the YMCK developing device 2050 (which is also referred to as "rotating operation C" in the present embodiment for convenience) will be described using FIG. 15C. The unit controller 2102 controls the YMCK developing device drive control circuit to rotate the YMCK developing device 2050 by approximately a half revolution by rotating the pulse motor for a predetermined amount of pulses (step S2302). In this way, the position of the YMCK developing device 2050 is changed to the HP position.

Then, the printer 2010 returns to the standby state in the end (step S2024).

<<<About when Monochrome Images are Continuously Formed on 40 Sheets of Media>>>

Next, an example of continuously forming monochrome images on 40 sheets of media will be described with reference to the flowchart of FIG. 14B.

This flowchart starts from a state in which the printer 2010 is on standby for image formation to be carried out (step S2032), with the power of the printer 2010 already turned ON. The standby position of the YMCK developing device 2050 at this time is at the HP position described above.

In this standby state, an image signal and a command instructing to continuously form monochrome images on 40 sheets of media are input from a not-shown host computer to the main controller 2101 of the printer 2010 via the interface (I/F) 2112 (step S2034). The printer 2010 controls the unit controller 2102 based on the command from the main controller 2101 to change the position of the YMCK developing device 2050 from the HP position to the developing position by rotating the YMCK developing device 2050 (step S2036). It should be noted that the rotating operation of the YMCK developing device 2050 at this time is the same as the rotating operation A in step S2006.

The printer 2010 starts the continuous image formation using the black toner after the position of the YMCK developing device 2050 has been positioned at the developing position. When images are to be continuously formed on a plurality of number of sheets of media using toner of a single color, the printer 2010 rotates the YMCK developing device 2050 at a predetermined frequency, that is, every time the number of sheets of media on which the images have been formed reaches a unit number of sheets.

In addition, the predetermined frequency after the number of sheets of media on which the images have been continuously formed has reached the predetermined number of sheets is set higher than the predetermined frequency before the number of sheets reaches the predetermined number of sheets. In other words, the unit number of sheets after the number of sheets of media on which the images have been continuously formed has reached the predetermined number of sheets is set smaller than the unit number of sheets before the number of sheets reaches the predetermined number of sheets. In the present embodiment, the predetermined number of sheets is set to 48 sheets, the unit number of sheets before the number of sheets of media on which the images have been continuously formed reaches the predetermined number of sheets is set to 48 sheets, and the unit number of sheets after the number of sheets of media on which the images have been continuously formed has reached the predetermined number of sheets is set to 24 sheets.

In the present embodiment, however, the number of sheets of media on which images are continuously formed is 40 sheets. Therefore, the YMCK developing device 2050 will not rotate during the continuous image formation, in contrast to the above-described example.

Therefore, after the position of the YMCK developing device 2050 has been positioned at the developing position, the printer 2010 continuously forms images on 40 sheets of media and finishes forming images (step S2038). Then, the printer 2010 changes the position of the YMCK developing device 2050 from the developing position to the HP position by rotating the YMCK developing device 2050 (step S2040). It should be noted that the rotating operation of the YMCK developing device 2050 at this time is the same as the rotating operation C in step S2018.

Then, the printer 2010 returns to the standby state in the end (step S2042).

===About the Change in the Amount of Electrical Charge of Toner===

Next, the change in the amount of electrical charge of toner T for when monochrome images are continuously formed on the media according to the procedures described above will be described using FIG. 16, taking a case where monochrome images are continuously formed on 100 sheets of media and a case where monochrome images are continuously formed on 40 sheets of media as examples and also making comparisons with two comparative examples.

It should be noted that examples in which the above-described frequency for rotating the YMCK developing device 2050, that is, the number of sheets to be reached by the number of sheets of media on which the images have been formed to trigger the rotational movement of the YMCK developing device 2050, has been changed are used as the comparative examples for comparison with the example according to the present embodiment (which are also referred to as "present example" below).

More specifically, in the present example, the predetermined number of sheets is set to 48 sheets, the unit number of sheets before the number of sheets of media on which the images have been continuously formed reaches the predetermined number of sheets is set to 48 sheets, and the unit number of sheets after the number of sheets of media on which the images have been continuously formed has reached the predetermined number of sheets is set to 24 sheets. Therefore, if, for example, monochrome images are to be continuously formed on 100 sheets of media, then between each rotating action of the YMCK developing device 2050, the image-forming process for 48 sheets from the first to forty-eighth sheets, the image-forming process for 24 sheets from the forty-ninth to seventy-second sheets, the image-forming process for 24 sheets from the seventy-third to ninety-sixth sheets, and the image-forming process for 4 sheets from the ninety-seventh to the hundredth sheets are performed. On the contrary, in the first comparative example, the image-forming process for 48 sheets from the first to forty-eighth sheets, the image-forming process for 48 sheets from the forty-ninth to ninety-sixth sheets, and the image-forming process for 4 sheets from the ninety-seventh to the hundredth sheets are performed between each rotating action of the YMCK developing device 2050. Further, in the second comparative example, the image-forming process for 24 sheets from the first to twenty-fourth sheets, the image-forming process for 48 sheets from the twenty-fifth to seventy-second sheets, the image-forming process for 24 sheets from the seventy-third to ninety-sixth sheets, and the image-forming process for 4 sheets from the ninety-seventh to the hundredth sheets are performed between each rotating action of the YMCK developing device 2050.

Figure 16A:
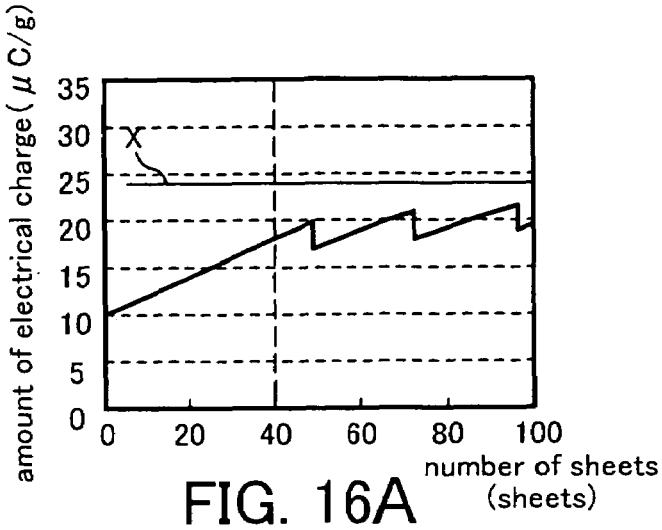
FIG. 16A is a diagram that is relevant to the present example and that shows changes in an amount of electrical charge of toner T when monochrome images are continuously formed on media.
Figure 16B:
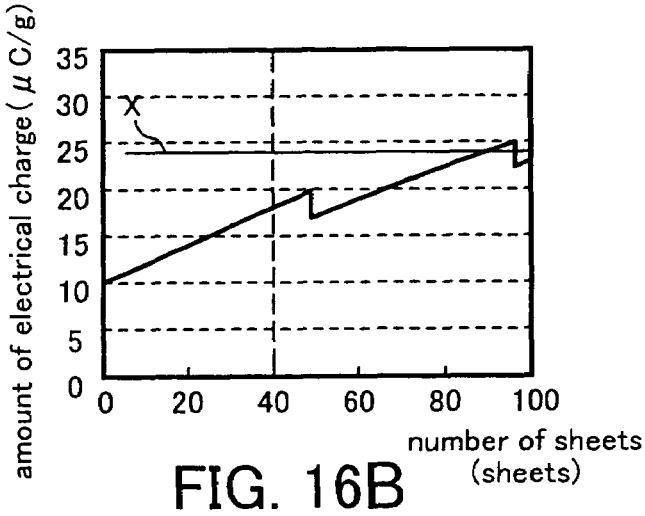
FIG. 16B and FIG. 16C are diagrams that are relevant to comparative examples and that show changes in the amount of electrical charge of toner T when monochrome images are continuously formed on media.
Figure 16C:
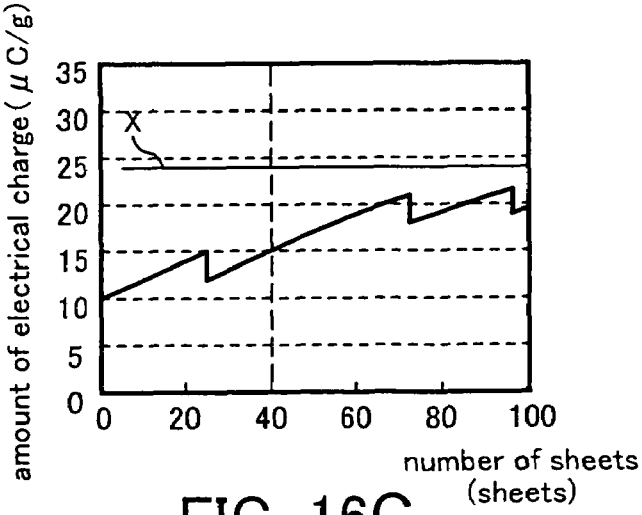

Reference is now made to FIG. 16. The changes in the amount of electrical charge of toner T for when monochrome images are continuously formed on the media are shown in FIG. 16. FIG. 16A illustrates the present example, FIG. 16B illustrates the first comparative example, and FIG. 16C illustrates the second comparative example.

First, the change in the amount of electrical charge of toner T according to the present example will be described. The amount of electrical charge of toner T becomes larger the longer the development operations are executed, and becomes smaller the longer the development operations are set aside. Therefore, basically, the amount of electrical charge of toner T (shown by the vertical axis) increases with the increase in the number of sheets (shown by the horizontal axis). On the other hand, during rotation of the YMCK developing device 2050, the development operations are temporarily halted, and therefore, the amount of electrical charge drops at three points where the numbers of sheets are at 48 sheets, 72 sheets, and 96 sheets. Further, since there is a sufficient development-operation rest period before starting to form images, the amount of electrical charge of toner T at the time when image formation is started is sufficiently small.

Further, in FIG. 16A, a straight line accompanied with the mark X is shown. The straight line X indicates the amount of electrical charge at which occurrence of problems such as image fogging, toner scattering, and toner spilling, which have been described in the section of the "Description of the Related Art" becomes significant. The amount of electrical charge of toner T is kept lower than the straight line X with a sufficient margin, and therefore, the occurrence of the above-described problems is avoided. This is because the development operation is stopped when the YMCK developing device 2050 is rotating during the continuous image formation.

Next, the change in the amount of electrical charge of toner T according to the first comparative example will be described. As with the present example, the amount of electrical charge of toner T increases with the increase in the number of sheets. On the other hand, when the YMCK developing device 2050 is rotating, the development operations are stopped, and therefore, the amount of electrical charge drops at two points where the numbers of sheets are at 48 sheets and 96 sheets. Further, as with the present example, since there is a sufficient development-operation rest period before starting to form images, the amount of electrical charge of toner T at the time when image formation is started is sufficiently small.

Further, a straight line accompanied with the mark X is also shown in FIG. 16B. As in FIG. 16A, the straight line X indicates the amount of electrical charge at which occurrence of the above-described problems becomes significant. The amount of electrical charge of toner T reaches the amount of electrical charge indicated by the straight line X at a point where the number of sheets is around 90 sheets. Therefore, the above-described problems arise.

Next, the change in the amount of electrical charge of toner T according to the second comparative example will be described. As with the present example, the amount of electrical charge of toner T increases with the increase in the number of sheets. On the other hand, when the YMCK developing device 2050 is rotating, the development operations are stopped, and therefore, the amount of electrical charge drops at three points where the numbers of sheets are at 24 sheets, 72 sheets, and 96 sheets. Further, as with the present example, since there is a sufficient development-operation rest period before starting to form images, the amount of electrical charge of toner T at the time when image formation is started is sufficiently small.

Further, a straight line accompanied with the mark X is also shown in FIG. 16C. As in FIG. 16A, the straight line X indicates the amount of electrical charge at which occurrence of the above-described problems becomes significant. In contrast to the first comparative example, in this example (the second comparative example), the amount of electrical charge of toner T is kept lower than the straight line X with a sufficient margin, and therefore, the occurrence of the above-described problems is avoided. Below, comparison between the present example and the second comparative example is made, paying attention to the number of times of rotations for which the YMCK developing device 2050 rotates when monochrome images are continuously formed on the media.

In the present example, the YMCK developing device 2050 rotates 3 times while monochrome images are continuously formed on 100 sheets of media, whereas the YMCK developing device 2050 does not rotate while monochrome images are continuously formed on 40 sheets of media. On the other hand, in the second comparative example, the number of times of rotations while monochrome images are continuously formed on 100 sheets of media is 3 times, which is the same as the present example, whereas the number of times of rotations while monochrome images are continuously formed on 40 sheets of media is 1 time, which is different from the present example. An increase in the number of times of rotations for rotating the YMCK developing device 2050 indicates a decrease in image-forming speed. Therefore, this means that the image-forming speed is faster for the present example when monochrome images are continuously formed on 40 sheets of media, compared to the second comparative example.

Therefore, the present example is superior to both the first and second comparative examples in terms that it maintains the toner T in an appropriate state (that is, at an appropriate amount of electrical charge) while reducing the decrease in image-forming speed.

When the present example and the second comparative example are compared, it can be noted that the timing for rotating the YMCK developing device 2050, which is the only difference between the two, is the cause of the difference in superiority/inferiority between both examples. The timing for the present example is determined according to the following viewpoint.

As described above, since there is a sufficient development-operation rest period before starting to form images, the amount of electrical charge of toner T at the time when image formation is started is sufficiently small. Therefore, at the initial stage of starting the image formation, there is quite a margin until the amount of electrical charge of toner T reaches the amount of electrical charge at which occurrence of the above-described problems becomes significant. In view of this, the frequency for rotating the YMCK developing device 2050 is kept low until the number of sheets of media reaches the predetermined number of sheets, placing importance on image-forming speed. Then, as the amount of electrical charge of toner T comes close to the amount of electrical charge at which occurrence of the above-described problems becomes significant, the frequency for rotating the YMCK developing device 2050 is increased, placing importance on avoidance of the above-described problems. It should be noted that, as apparent from the description above, it is preferable to determine the predetermined number of sheets in consideration of the value of the amount of electrical charge at which occurrence of the above-described problems becomes significant.

By setting the predetermined frequency after a number of sheets of media on which the images have been continuously formed has reached a predetermined number of sheets to be higher than the predetermined frequency before the number of sheets reaches the predetermined number of sheets as described above, it becomes possible to maintain the toner in an appropriate state while reducing the decrease in image-forming speed.

Further, the rotating operation of the YMCK developing device 2050 not only achieves an effect of reducing the amount of electrical charge of toner T, but also achieves an effect of reducing deterioration in flowability of toner that has settled out. Therefore, it becomes possible to maintain the toner in an appropriate state even further.

===Other Considerations===

In the foregoing, an image forming apparatus etc. according to the present invention was described according to the above-described embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing embodiment, an intermediate transferring type full-color laser beam printer was described as an example of the image forming apparatus, but the present invention is also applicable to various other types of image forming apparatuses, such as full-color laser beam printers that are not of the intermediate transferring type, monochrome laser beam printers, copying machines, and facsimiles.

Further, the photoconductor is not limited to the so-called photoconductive roller structured by providing a photoconductive layer on the outer peripheral surface of a cylindrical, conductive base. The photoconductor can be a so-called photoconductive belt structured by providing a photoconductive layer on a surface of a belt-like conductive base.

Further, in the foregoing embodiment, when the printer continuously forms the images on the plurality of number of sheets of media using the toner of the single color, the printer rotates the YMCK developing device every time the number of sheets of media on which the images have been continuously formed reaches a unit number of sheets; and the unit number of sheets after the number of sheets of media on which the images have been continuously formed has reached the predetermined number of sheets is set to be smaller than the unit number of sheets before the number of sheets reaches the predetermined number of sheets. This, however, is not a limitation.

The foregoing embodiment, however, is more preferable in terms that, by managing the predetermined frequency according to the number of sheets of media on which the images have been continuously formed in the case where the predetermined frequency after the number of sheets of media on which the images have been continuously formed has reached the predetermined number of sheets is set to be higher than the predetermined frequency before the number of sheets reaches the predetermined number of sheets, it becomes easy to manage the predetermined frequency.

Further, in the foregoing embodiment, the rotational movement of the YMCK developing device is one revolution, and the YMCK developing device is temporarily halted at least once during one revolution of the YMCK developing device. This, however, is not a limitation. For example, the YMCK developing device does not have to be halted while the YMCK developing device is rotated.

If, however, the YMCK developing device is temporarily halted at least once during one revolution of the YMCK developing device, then the toner in the developing unit will be rapidly accelerated before and after the halt. This acceleration causes a force that makes the toner move, and thus, stirring of the toner is carried out more effectively. Therefore, the foregoing embodiment is more preferable in terms that it becomes possible to reduce the deterioration in toner flowability more appropriately and that it becomes possible to maintain the toner in an appropriate state even further.

Further, in the foregoing embodiment, the developing unit includes: a developing roller for bearing the toner; and a toner supplying roller for supplying the toner to the developing roller. This, however, is not a limitation. For example, the developing unit does not have to be provided with a developing roller for bearing the toner and a toner supplying roller for supplying the toner to the developing roller.

As for the case in which the developing unit includes a developing roller and a toner supplying roller, when images are continuously formed on the plurality of number of sheets of media using the toner of the single color, development will be continuously carried out using the toner that is supplied to the developing roller by the toner supplying roller and that is bore by the developing roller, without the toner being stirred. As a result, only the toner, out of all the toner contained in the developing unit, that is positioned close to the developing roller and the toner supplying roller will deteriorate. That is, toner having significantly different characteristics will exist in the developing unit (i.e., the characteristics of the toner will be polarized into two). When toner having different characteristics is mixed, problems such as image fogging, toner scattering, and toner spilling will arise.

In such a situation, the stirring of toner caused by the rotational movement of the YMCK developing device becomes more important in terms of preventing the occurrence of such problems. Therefore, the foregoing embodiment is more effective in terms that the object of the present invention is achieved more effectively.

Further, in the foregoing embodiment, the direction from the developing unit, which is attached to the YMCK developing device and which contains the toner of the single color, towards the rotating shaft of the YMCK developing device when the printer temporarily halts the YMCK developing device during one revolution of the YMCK developing device is in the direction from the rotating shaft towards the developing unit that contains the toner of the single color when the YMCK developing device is positioned at a predetermined developing position for developing the latent image with the toner of the single color bore by the developing roller. This, however, is not a limitation.

In the present embodiment, however, the directions relative to the developing unit, i.e., the directions in which gravity acts on the single-color toner in the developing unit are approximately in opposite directions upon development and upon halt. Therefore, the foregoing embodiment is more preferable in terms that the toner, which has settled out in the direction of gravity upon development, will be dissolved more appropriately by the movement of the YMCK developing device to the halt position caused by the rotational movement of the YMCK developing device and the halt at the halt position.

Further, in the foregoing embodiment, the developing unit includes a partitioning wall that is for partitioning the toner and that protrudes inward from an inner wall of the developing unit, and two developer containing sections formed by partitioning the developing unit with the partitioning wall; and the toner supplying roller is provided in one of the two developer containing sections. This, however, is not a limitation. For example, the partitioning wall does not have to be provided, and there may only be one developer containing section. Further, the toner supplying roller does not have to be provided in either one of the two developer containing sections.

In a state in which the developing unit includes two developer containing sections formed by partitioning the developing unit with the partitioning wall and the toner supplying roller is provided in one of the two developer containing sections, since the toner in the developer containing section in which the toner supplying roller is provided and the toner in the other developer containing section are separated from each other, the above-described polarization in toner characteristics will occur more significantly.

In such a situation, the stirring of toner caused by the rotational movement of the YMCK developing device becomes even more important. Therefore, the foregoing embodiment is more effective in terms that the object of the present invention is achieved more effectively.

Further, in the foregoing embodiment, an angle formed between a protruding direction of the partitioning wall of the developing unit, which is attached to the YMCK developing device and which contains the toner of the single color, and a vertically downward direction is smaller than 90° when the printer temporarily halts the YMCK developing device during one revolution of the YMCK developing device. This, however, is not a limitation, and the angle formed between the above-mentioned protruding direction and the vertically downward direction may be 90° or above.

The foregoing embodiment, however, is more preferable in terms that, when the angle formed between the above-mentioned protruding direction and the vertically downward direction is smaller that 90°, the toner contained in both of the two developer containing sections will be mixed more easily when the YMCK developing device is temporarily halted, and therefore, stirring of the toner will be carried out appropriately.

Further, in the foregoing embodiment, the halt position of the YMCK developing device for when the printer temporarily halts the YMCK developing device during one revolution of the YMCK developing device is the standby position, i.e., the HP position, of the YMCK developing device for when the printer is on standby for formation of an image to be carried out. This, however, is not a limitation, and other positions may be adopted.

The foregoing embodiment, however, is more preferable in terms that the toner that has settled out in the direction of gravity upon development is dissolved more appropriately, and that, if the above-mentioned halt position of the YMCK developing device, where the toner can be easily mixed, is the HP position, it becomes possible to obtain an appropriate toner-stirring effect even when the apparatus is on standby for image formation to be carried out.

Further, in the foregoing embodiment, the toner of the single color is black toner. This, however, is not a limitation, and other colors may be adopted.

The foregoing embodiment, however, is more preferable in terms that the importance of the present invention increases when the single-color toner is black toner, and therefore, the object of the present invention is achieved more effectively. This is because, in an overwhelming number of cases, black toner is used as the single-color toner when images are continuously formed on a plurality of number of sheets of media using single-color toner.

Further, in the foregoing embodiment, the developing unit is not provided with a stirring member for stirring the toner. This, however, is not a limitation, and a stirring member may be provided.

The foregoing embodiment, however, is more preferable in terms that the importance of the present invention increases and therefore, the object of the present invention is achieved more effectively when a stirring member is not provided.

Further, in the foregoing embodiment, an image forming apparatus to and from which developing units can be attached and detached was described as an example. The present invention, however, is of course applicable to image forming apparatuses in which the developing units are attached thereto and are not detachable.

Third Embodiment

===Overall Configuration Example of Image Forming Apparatus===

Figure 17:
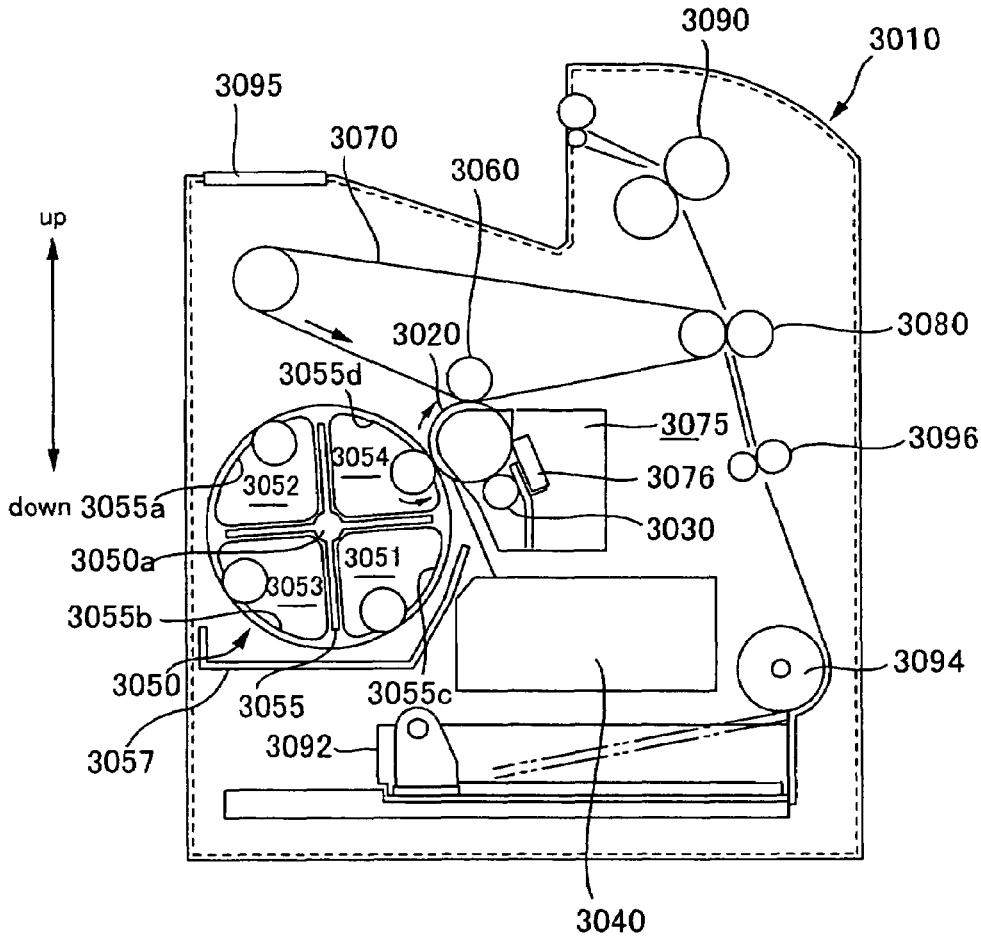
FIG. 17 is a diagram showing main structural components constructing an image forming apparatus according to another embodiment.

Next, using FIG. 17, an outline of an image-forming apparatus will be described, taking a laser-beam printer 3010 (hereinafter referred to also as "printer") as an example. FIG. 17 is a diagram showing main structural components constructing the printer 3010. Note that in FIG. 17, the vertical direction is shown by the arrow, and, for example, a paper supply tray 3092 is arranged at a lower section of the printer 3010, and a fusing unit 3090 is arranged at an upper section of the printer 3010.

As shown in FIG. 17, the printer 3010 according to the present embodiment includes a charging unit 3030, an exposing unit 3040, a YMCK developing device 3050 which serves as an example of a movable moving body, a first transferring unit 3060, an intermediate transferring body 3070, and a cleaning unit 3075, all of which being arranged in the direction of rotation of a photoconductor 3020. The printer 3010 further includes a second transferring unit 3080, a fusing unit 3090, a displaying unit 3095 constructed of a liquid-crystal panel and serving as means for making notifications to the operator, and a control unit (FIG. 18) for controlling these units etc. and managing the operations as a printer.

The photoconductor 3020 has a cylindrical conductive base and a photoconductive layer formed on the outer peripheral surface of the conductive base, and it is rotatable about a central axis. In the present embodiment, the photoconductor 3020 rotates clockwise, as shown by the arrow in FIG. 17.

The charging unit 3030 is a device for charging the photoconductor 3020. The exposing unit 3040 is a device for forming a latent image on the charged photoconductor 3020 by radiating laser thereon. The exposing unit 3040 has, for example, a semiconductor laser, a polygon mirror, and an F-θ lens, and radiates modulated laser onto the charged photoconductor 3020 according to image information having been input from a not-shown host computer such as a personal computer or a word processor.

The YMCK developing device 3050 is a device for developing the latent image formed on the photoconductor 3020 using toner T, that is, black (K) toner contained in a black developing unit 3051, magenta (M) toner contained in a magenta developing unit 3052, cyan (C) toner contained in a cyan developing unit 3053, and yellow (Y) toner contained in a yellow developing unit 3054. The toner T is an example of developer contained in each of the developing units, which serve as an example of a developer container.

In the present embodiment, the YMCK developing device 3050 can move the positions of the four developing units 3051, 3052, 3053, and 3054 by rotating. More specifically, the YMCK developing device 3050 holds the four developing units 3051, 3052, 3053, and 3054 with four holding sections 3055*a*, 3055*b*, 3055*c*, and 3055*d*. The four developing units 3051, 3052, 3053, and 3054 can be rotated about a rotating shaft 3050*a* while maintaining their relative positions. Every time an image forming process for one page is finished, each of the developing units selectively opposes the photoconductor 3020 to successively develop the latent image formed on the photoconductor 3020 using the toner T contained in each of the developing units 3051, 3052, 3053, and 3054. It should be noted that a toner receiving tray 3057, which serves as an example of a developer receiving member for receiving developer, is provided at the lower side, in the vertical direction, of the YMCK developing device 3050. Further, each of the four developing units 3051, 3052, 3053, and 3054 described above is attachable to and detachable from the respective holding sections of the YMCK developing device 3050. Further, details on the YMCK developing device 3050 and the developing units will be described later.

The first transferring unit 3060 is a device for transferring, onto the intermediate transferring body 3070, a single-color toner image formed on the photoconductor 3020. When the toners of all four colors are successively transferred in a superimposing manner, a full-color toner image will be formed on the intermediate transferring body 3070.

The intermediate transferring body 3070 is a laminated endless belt that is made by providing an aluminum layer on the surface of a PET film by vapor deposition, and then further applying semiconducting coating on the outer layer thereof. The intermediate transferring body 3070 is driven to rotate at substantially the same circumferential speed as the photoconductor 3020.

The second transferring unit 3080 is a device for transferring the single-color toner image or the full-color toner image formed on the intermediate transferring body 3070 onto a medium such as paper, film, and cloth.

The fusing unit 3090 is a device for fusing the single-color toner image or the full-color toner image, which has been transferred onto the medium, onto the medium to make it into a permanent image.

The cleaning unit 3075 is a device that is provided between the first transferring unit 3060 and the charging unit 3030, that has a rubber cleaning blade 3076 made to abut against the surface of the photoconductor 3020, and that is for removing the toner T remaining on the photoconductor 3020 by scraping it off with the cleaning blade 3076 after the toner image has been transferred onto the intermediate transferring body 3070 by the first transferring unit 3060.

Figure 18:
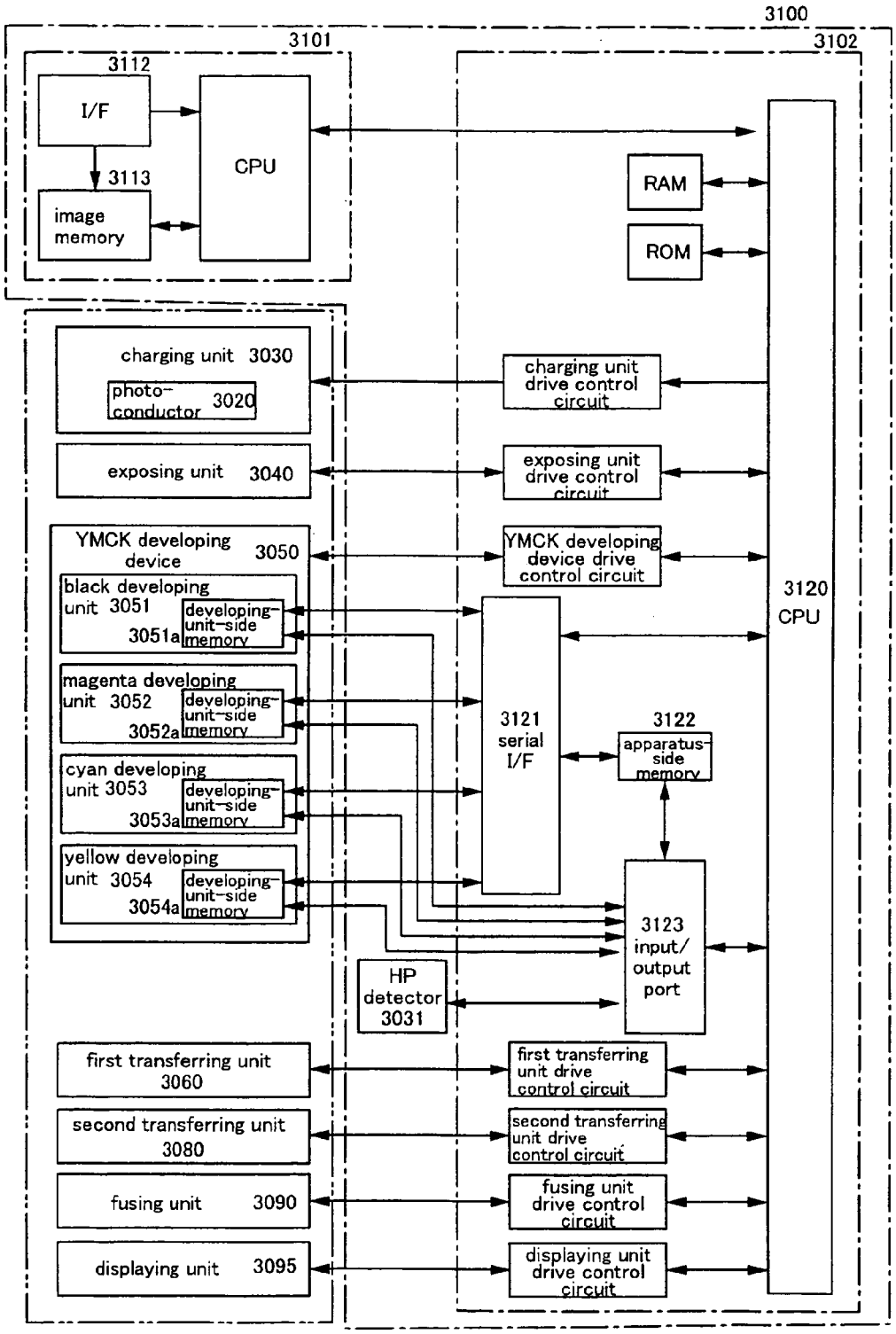
FIG. 18 is a block diagram showing a control unit of the image forming apparatus in FIG. 17.

The control unit 3100 comprises a main controller 3101 and a unit controller 3102 as shown in FIG. 18. An image signal is input to the main controller 3101, and according to instructions based on the image signal, the unit controller 3102 controls each of the above-mentioned units etc. to form an image.

Next, operations of the printer 3010 structured as above will be described with reference to other structural components.

First, when an image signal is input from the not-shown host computer to the main controller 3101 of the printer 3010 through an interface (I/F) 3112, the photoconductor 3020, a developing roller as an example of a developer bearing body, and the intermediate transferring body 3070 rotate under the control of the unit controller 3102 based on the instructions from the main controller 3101. While being rotated, the photoconductor 3020 is successively charged by the charging unit 3030 at a charging position.

With the rotation of the photoconductor 3020, the charged area of the photoconductor 3020 reaches an exposing position. A latent image that corresponds to the image information about the first color, for example, yellow Y, is formed in that area by the exposing unit 3040. The YMCK developing device 3050 positions the yellow developing unit 3054, which contains yellow (Y) toner, in the developing position opposing the photoconductor 3020.

With the rotation of the photoconductor 3020, the latent image formed on the photoconductor 3020 reaches the developing position, and is developed with the yellow toner by the yellow developing unit 3054. Thus, a yellow toner image is formed on the photoconductor 3020.

With the rotation of the photoconductor 3020, the yellow toner image formed on the photoconductor 3020 reaches a first transferring position, and is transferred onto the intermediate transferring body 3070 by the first transferring unit 3060. At this time, a first transferring voltage, which is in an opposite polarity to the polarity to which the toner T is charged, is applied to the first transferring unit 3060. It should be noted that, during this process, the photoconductor 3020 and the intermediate transferring body 3070 are placed in contact with each other, and the second transferring unit 3080 is kept separated from the intermediate transferring body 3070.

By subsequently performing the above-mentioned processes for the second, the third, and the fourth colors for each of the developing units, toner images in four colors corresponding to the respective image signals are transferred to the intermediate transferring body 3070 in a superimposed manner. As a result, a full-color toner image is formed on the intermediate transferring body 3070.

With the rotation of the intermediate transferring body 3070, the full-color toner image formed on the intermediate transferring body 3070 reaches a second transferring position, and is transferred onto a medium by the second transferring unit 3080. It should be noted that the medium is carried from the paper supply tray 3092 to the second transferring unit 3080 via the paper-feed roller 3094 and resisting rollers 3096. During transferring operations, a second transferring voltage is applied to the second transferring unit 3080 and also the unit 3080 is pressed against the intermediate transferring body 3070.

The full-color toner image transferred onto the medium is heated and pressurized by the fusing unit 3090 and fused to the medium.

On the other hand, after the photoconductor 3020 passes the first transferring position, the toner T adhering to the surface of the photoconductor 3020 is scraped off by the cleaning blade 3076 that is supported on the cleaning unit 3075, and the photoconductor 3020 is prepared for charging for forming the next latent image. The scraped-off toner T is collected in a remaining-toner collector that the cleaning unit 3075 comprises.

===Configuration Example of Developing Unit===

Figure 19:
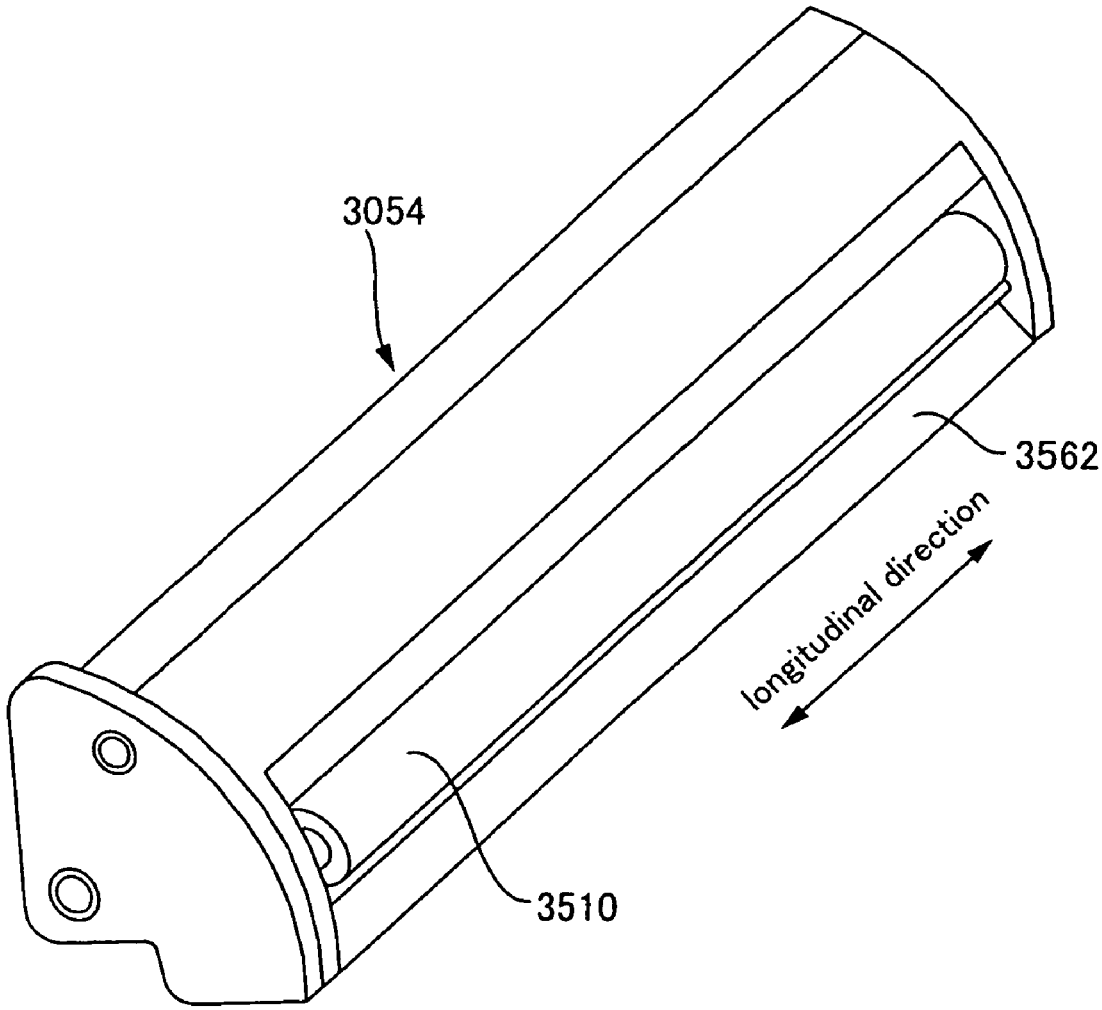
FIG. 19 is a conceptual diagram of a developing unit.
Figure 20:
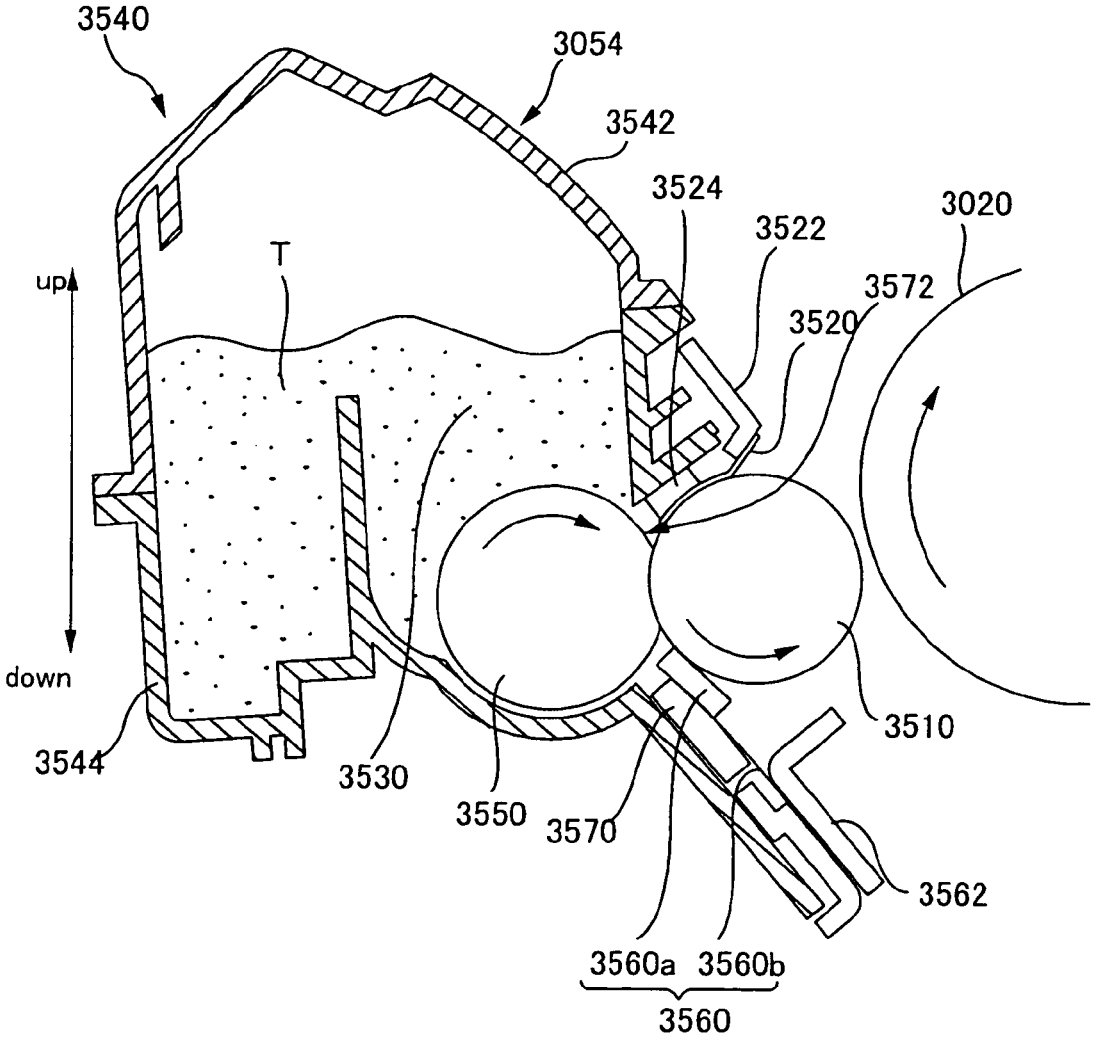
FIG. 20 is a section view showing main structural components of the developing unit.

Next, using FIG. 19 and FIG. 20, an example of a configuration of the developing units will be described. FIG. 19 is a conceptual diagram of a developing unit. FIG. 20 is a section view showing main structural components of the developing unit. Note that the section view shown in FIG. 20 is a section of the developing unit bisected by a plane perpendicular to the longitudinal direction shown in FIG. 19. Further, in FIG. 20, the arrow indicates the vertical direction as in FIG. 17, and, for example, the central axis of the developing roller 3510 is located below the central axis of the photoconductor 3020. Further, in FIG. 20, the yellow developing unit 3054 is shown to be in a state in which it is positioned at the developing position opposing the photoconductor 3020.

The YMCK developing device 3050 comprises: the black developing unit 3051 containing black (K) toner; the magenta developing unit 3052 containing magenta (M) toner; the cyan developing unit 3053 containing cyan (C) toner; and the yellow developing unit 3054 containing yellow (Y) toner. Since the configuration of each of the developing units is the same, explanation will be made only about the yellow developing unit 3054 below.

The yellow developing unit 3054 has, for example, the developing roller 3510, a sealing member 3520, a toner containing section 3530, a housing 3540, a toner supplying roller 3550, and a restriction blade 3560 which serves as a developer charging member.

The developing roller 3510 bears toner T and delivers it to the developing position opposing the photoconductor 3020. The developing roller 3510 is made of metal and manufactured from, for example, aluminum alloy such as aluminum alloy 5056 or aluminum alloy 6063, or iron alloy such as STKM, and the roller 3510 is plated with, for example, nickel plating or chromium plating, as necessary.

Further, as shown in FIG. 19, the developing roller 3510 is supported at both ends in its longitudinal direction and is rotatable about its central axis. As shown in FIG. 20, the developing roller 3510 rotates in the opposite direction (counterclockwise in FIG. 20) to the rotating direction of the photoconductor 3020 (clockwise in FIG. 20). The central axis of the roller 3510 is located below the central axis of the photoconductor 3020. Further, as shown in FIG. 20, in the state where the yellow developing unit 3054 opposes the photoconductor 3020, there is a gap between the developing roller 3510 and the photoconductor 3020. That is, the yellow developing unit 3054 develops the latent image formed on the photoconductor 3020 in a non-contacting state. Note that an alternating field is generated between the developing roller 3510 and the photoconductor 3020 upon development of the latent image formed on the photoconductor 3020.

The sealing member 3520 prevents the toner T in the yellow developing unit 3054 from spilling out therefrom, and also collects the toner T, which is on the developing roller 3510 that has passed the developing position, into the developing unit without scraping. The sealing member 3520 is a seal made of, for example, polyethylene film. The sealing member 3520 is supported by a seal-supporting metal plate 3522, and is attached to the housing 3540 via the seal-supporting metal plate 3522. A seal-urging member 3524 made of, for example, Moltoprene is provided on one side of the sealing member 3520 opposite to the side of the developing roller 3510. The sealing member 3520 is pressed against the developing roller 3510 by the elastic force of the seal-urging member 3524. Note that the abutting position at which the sealing member 3520 abuts against the developing roller 3510 is situated above the central axis of the developing roller 3510.

The housing 3540 is manufactured by welding together a plurality of integrally-molded housing sections, that is, an upper housing section 3542 and a lower housing section 3544. As shown in FIG. 20, the housing 3540 has an opening 3572 opening toward the outside of the housing 3540. The above-mentioned developing roller 3510 is arranged from the outside of the housing 3540 with its peripheral surface facing the opening 3572 in such a state that a part of the roller 3510 is exposed to the outside. The restriction blade 3560, which is described in detail below, is also arranged from the outside of the housing 3540 facing the opening 3572.

Further, the housing 3540 forms a toner containing section 3530 that is capable of containing toner T. The toner containing section 3530 may be provided with a stirring member for stirring the toner T. In the present embodiment, however, a stirring member is not provided in the toner containing section 3530 because each of the developing units (i.e., the black developing unit 3051, the magenta developing unit 3052, the cyan developing unit 3053, and the yellow developing unit 3054) is rotated with the rotation of the YMCK developing device 3050 and thereby the toner T in each developing unit is stirred.

The toner supplying roller 3550 is provided in the toner containing section 3530 described above and supplies the toner T contained in the toner containing section 3530 to the developing roller 3510. The toner supplying roller 3550 is made of, for example, polyurethane foam, and is made to abut against the developing roller 3510 in an elastically deformed state. The toner supplying roller 3550 is arranged at a lower section of the toner containing section 3530. The toner T contained in the toner containing section 3530 is supplied to the developing roller 3510 by the toner supplying roller 3550 at the lower section of the toner containing section 3530. The toner supplying roller 3550 is rotatable about a central axis. The central axis of the toner supplying roller 3550 is situated below the central axis of rotation of the developing roller 3510. Further, the toner supplying roller 3550 rotates in the opposite direction (clockwise in FIG. 20) to the rotating direction of the developing roller 3510 (counterclockwise in FIG. 20). Note that the toner supplying roller 3550 has the function of supplying the toner T contained in the toner containing section 3530 to the developing roller 3510 as well as the function of stripping off the toner T remaining on the developing roller 3510 after development from the developing roller 3510.

The restriction blade 3560 restricts the thickness of the layer of the toner T bore by the developing roller 3510 and also gives charge to the toner T bore by the developing roller 3510. This restriction blade 3560 has a rubber section **3560*a*, which serves as an example of an abutting member that abuts against the developing roller, and a rubber-supporting section 3560*b*, which serves as an example of a supporting member for supporting the a butting member. The rubber section 3560*a* is made of, for example, silicone rubber or urethane rubber. The rubber-supporting section 3560*b* is a thin plate that is made of, for example, phosphor bronze or stainless steel, and that has a springy characteristic. The rubber section 3560*a* is supported by the rubber-supporting section 3560*b*. The rubber-supporting section 3560*b* is attached to the housing 3540 via a pair of blade-supporting metal plates 3562 in a state that one end of the rubber-supporting section 3560***b* is pinched between and supported by the blade-supporting metal plates 3562. Further, a blade-backing member 3570 made of, for example, Moltoprene is provided on one side of the restriction blade 3560 opposite to the side of the developing roller 3510.

The rubber section 3560*a* is pressed against the developing roller 3510 by the elastic force caused by the flexure of the rubber-supporting section 3560*b*. Further, the blade-backing member 3570 prevents the toner T from entering in between the rubber-supporting section 3560*b* and the housing 3540, stabilizes the elastic force caused by the flexure of the rubber-supporting section 3560*b*, and also, applies force to the rubber section 3560*a* from the back thereof towards the developing roller 3510 to press the rubber section 3560*a* against the developing roller 3510. In this way, the blade-backing member 3570 makes the rubber section 3560*a* abut against the developing roller 3510 more evenly.

The end of the restricting blade 3560 opposite to the end that is supported by the blade-supporting metal plates 3562, i.e., the tip end, is not placed in contact with the developing roller 3510; rather, a section at a predetermined distance from the tip end contacts, with some breadth, the developing roller 3510. That is, the restriction blade 3560 does not abut against the developing roller 3510 at its edge, but abuts against the roller 3510 near its central portion. Further, the restriction blade 3560 is arranged so that its tip end faces towards the upper stream of the rotating direction of the developing roller 3510, and thus, makes a so-called counter-abutment with respect to the roller 3510. It should be noted that the abutting position at which the restriction blade 3560 abuts against the developing roller 3510 is below the central axis of the developing roller 3510 and is also below the central axis of the toner supplying roller 3550.

In the yellow developing unit 3054 thus structured, the toner supplying roller 3550 supplies the toner T contained in the toner containing section 3530 to the developing roller 3510. With the rotation of the developing roller 3510, the toner T, which has been supplied to the developing roller 3510, reaches the abutting position of the restriction blade 3560; then, as the toner T passes the abutting position, the toner is electrically charged and its layer thickness is restricted. With further rotation of the developing roller 3510, the toner T on the developing roller 3510, whose layer thickness has been restricted, reaches the developing position opposing the photoconductor 3020; then, under the alternating field, the toner T is used at the developing position for developing the latent image formed on the photoconductor 3020. With further rotation of the developing roller 3510, the toner T on the developing roller 3510, which has passed the developing position, passes the sealing member 3520 and is collected into the developing unit by the sealing member 3520 without being scraped off. Then, the toner T that still remains on the developing roller 3510 can be stripped off by the toner supplying roller 3550.

Each developing unit 3051, 3052, 3053, and 3054 is also provided with a non-volatile storage memory 3051*a*, 3052*a*, 3053*a*, and 3054*a* (which is also referred to below as a "developing-unit-side memory") that is a storage element for storing various kinds of information about the developing unit, such as color information about the color of the toner contained in each developing unit and toner consumption amount, and that may be, for example, a serial EEPROM.

Developing-unit-side connectors 3051*b*, 3052*b*, 3053*b*, and 3054*b*, which are provided on one end surface of the respective developing units, come into connection, as necessary, with an apparatus-side connector 3034, which is provided on the apparatus side (i.e., the printer side), and in this way, the developing-unit-side memories 3051*a*, 3052*a*, 3053*a*, and 3054*a* are electrically connected to the unit controller 3102 of the control unit 3100 of the apparatus.

===Overview of YMCK Developing Device===

Next, an overview of the YMCK developing device 3050 will be described using FIG. 21.

The YMCK developing device 3050 has a rotating shaft 3050*a* positioned at the center. A support frame 3055 for holding the developing units is fixed to the rotating shaft 3050*a*. The rotating shaft 3050*a* is provided extending between two frame side plates (not shown) which form a casing of the printer 3010, and both ends of the shaft 3050*a* are supported. It should be noted that the axial direction of the rotating shaft 3050*a* intersects with the vertical direction.

The support frame 3055 includes the four holding sections 3055*a*, 3055*b*, 3055*c*, and 3055*d*, by which the above-described developing units 3051, 3052, 3053, and 3054 of the four colors are held in an attachable/detachable manner about the rotating shaft 3050*a*, in the circumferential direction at an interval of 90°.

A pulse motor, which is not shown, is connected to the rotating shaft 3050*a* via a clutch. By driving the pulse motor, it is possible to rotate the support frame 3055 and position the four developing units 3051, 3052, 3053, and 3054 mentioned above at predetermined positions.

Figure 21A:
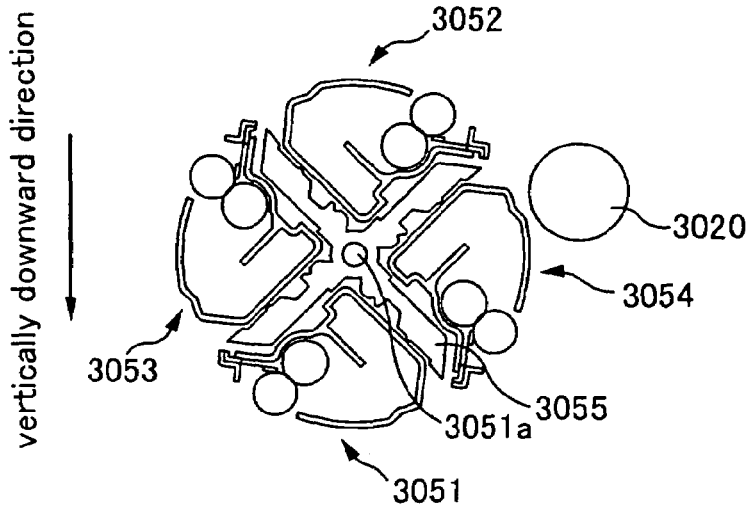
FIG. 21A is a diagram showing the home position that is the standby position for when the printer is on standby for image formation to be carried out, and that is also the halt position serving as the reference position in the rotating direction of a YMCK developing device 3050.
Figure 21B:
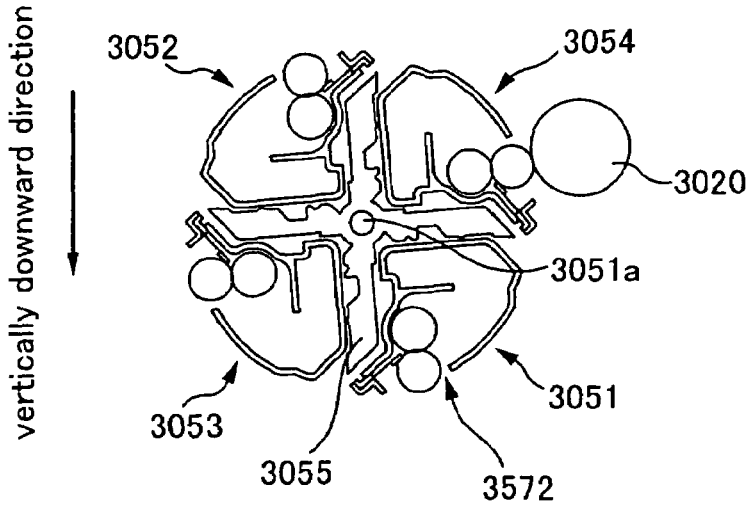
FIG. 21B is a diagram showing the connector attach/detach position where a developing-unit-side connector 3051*b* of a black developing unit 3051, which is attached to the YMCK developing device 3050, and an apparatus-side connector 3034, which is provided on the apparatus side, come into opposition.
Figure 21C:
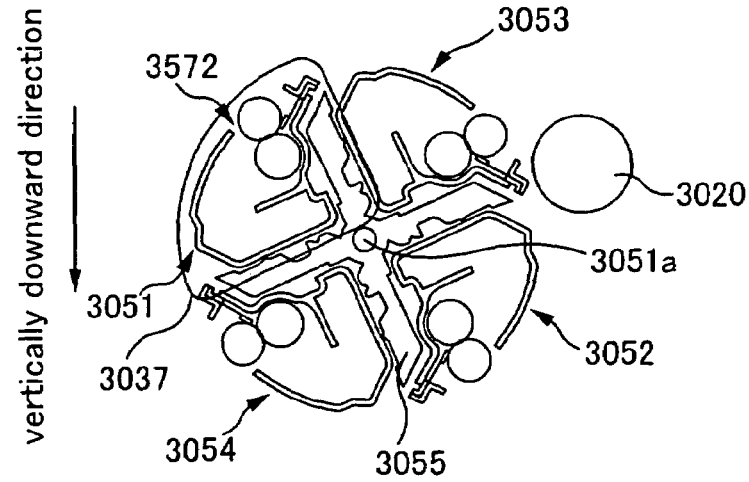
FIG. 21C is a diagram showing the detachment position where the black developing unit 3051 attached to the YMCK developing device 3050 is detached.

FIG. 21 are diagrams showing three stop positions of the rotating YMCK developing device 3050. FIG. 21A shows the home position (referred to as "HP position" below) that is the standby position for when the printer is on standby for image formation to be carried out, and that is also the halt position serving as the reference position in the rotating direction of the YMCK developing device 3050. FIG. 21B shows the connector attach/detach position where the developing-unit-side connector 3051*b* of the black developing unit 3051, which is attached to the YMCK developing device 3050, and the apparatus-side connector 3034, which is provided on the apparatus side, come into opposition. FIG. 21C shows the detachment position where the black developing unit 3051 attached to the YMCK developing device 3050 is detached.

In FIG. 21B and FIG. 21C, the connector attach/detach position and the developing unit detachment position are explained with regard to the black developing unit 3051, but these positions become the connector attach/detach position and the developing unit detachment position for each of the other developing units when the YMCK developing device 3050 is rotated at 90° intervals.

First, the HP position shown in FIG. 21A will be described. An HP detector 3031 (FIG. 18) for detecting the HP position is provided on the side of one end of the rotating shaft 3050*a* of the YMCK developing device 3050. The HP detector 3031 is structured of a disk that is for generating signals and that is fixed to one end of the rotating shaft 3050*a*, and an HP sensor that is made up of, for example, a photointerrupter having a light emitting section and a light receiving section. The peripheral section of the disk is arranged so that it is located between the light emitting section and the light receiving section of the HP sensor. When a slit formed in the disk moves to a detecting position of the HP sensor, the signal that is output from the HP sensor changes from "L" to "H". The device is constructed such that the HP position of the YMCK developing device 3050 is detected based on this change in signal level and the number of pulses of the pulse motor, and by taking this HP position as a reference, each of the developing units can be positioned at, for example, the developing position. It should be noted that, at the HP position of the YMCK developing device 3050, the black developing unit 3051 is positioned lower, in the vertical direction, than the rotating shaft 3050*a* of the YMCK developing device 3050, as shown in FIG. 21A.

FIG. 21B shows the connector attach/detach position of the black developing unit 3051 which is achieved by rotating the pulse motor for a predetermined number of pulses from the above-mentioned HP position. At this connector attach/detach position, the developing-unit-side connector 3051*b* of the black developing unit 3051, which is attached to the YMCK developing device 3050, and the apparatus-side connector 3034, which is provided on the apparatus side, come into opposition, and it becomes possible to connect or separate these connecters.

Figure 22A:
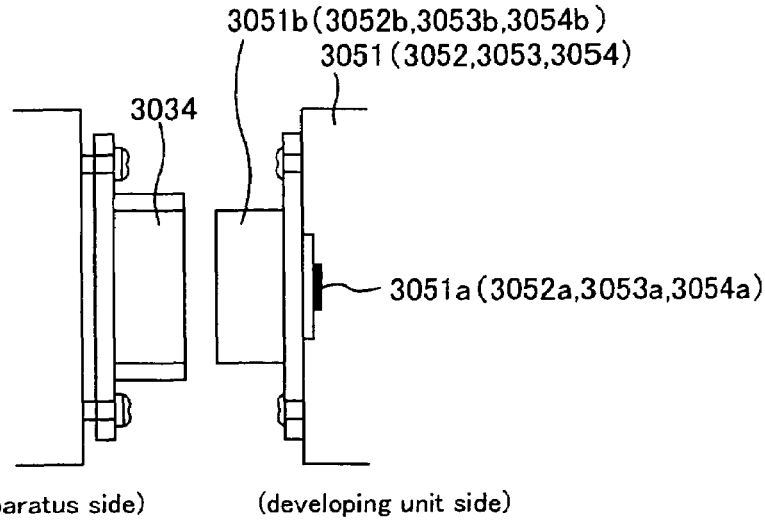
FIG. 22A is a diagram showing the separated position in which the developing-unit-side connector 3051*b* of the black developing unit 3051 and the apparatus-side connector 3034 are separated.
Figure 22B:
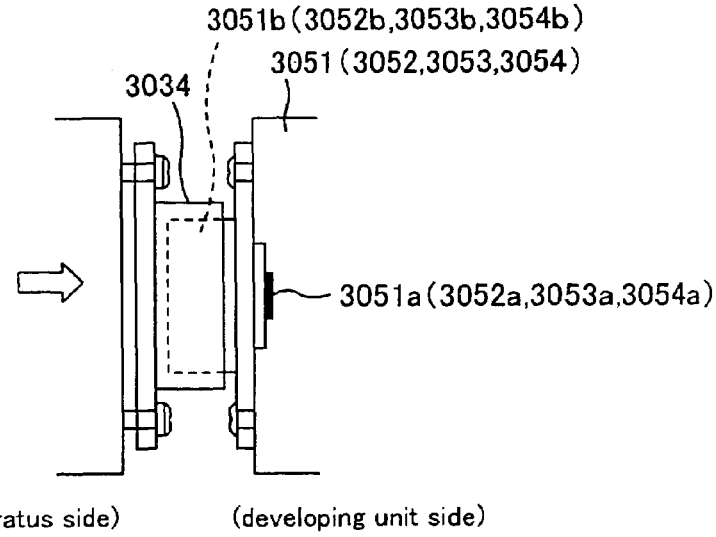
FIG. 22B is a diagram showing the abutting position in which the developing-unit-side connector 3051*b* of the black developing unit 3051 and the apparatus-side connector 3034 are in abutment.

Further explanation is given using FIG. 22. FIG. 22 are diagrams showing the separated position and the abutting position for the apparatus-side connector 3034 and the developing-unit-side connector 3051*b* of the black developing unit 3051. FIG. 22A is a diagram showing the separated position, and FIG. 22B is a diagram showing the abutting position.

FIG. 22A shows a state in which the apparatus-side connector 3034 and the developing-unit-side connector 3051*b* of the black developing unit 3051 are separated from each other. The apparatus-side connector 3034 is structured so that it can move close to, and move away from, the black developing unit 3051. When necessary, the apparatus-side connector 3034 moves in the direction towards the black developing unit 3051 (the direction of the arrow shown in FIG. 22B). In this way, the apparatus-side connector 3034 abuts against the developing-unit-side connector 3051*b* of the black developing unit 3051 as shown in FIG. 22B. Thus, the developing-unit-side memory 3051*a* attached to the black developing unit 3051 is electrically connected to the unit controller 3102 of the control unit 3100, and communication between the developing-unit-side memory 3051 and the apparatus is carried out.

On the contrary, the apparatus-side connector 3034 moves, from the state shown in FIG. 22B in which the apparatus-side connector 3034 and the developing-unit-side connector 3051*b* of the black developing unit 3051 abut against each other, in the direction moving away from the black developing unit 3051 (the direction opposite to the direction of the arrow shown in FIG. 22B). In this way, the apparatus-side connector 3034 is separated from the developing-unit-side connector 3051*b* of the black developing unit 3051, as shown in FIG. 22A.

It should be noted that the movement of the apparatus-side connector 3034 is achieved by, for example, a not-shown mechanism structured of a pulse motor, a plurality of gears connected to the pulse motor, and an eccentric cam connected to the gears. More specifically, by rotating the pulse motor for a predetermined number of pulses, the above-mentioned mechanism moves the common connector 3034 from the predetermined separated position for a distance that corresponds to the above-mentioned number of pulses to position the common connector 3034 at the predetermined abutting position. On the contrary, by rotating the pulse motor backwards for a predetermined number of pulses, the above-mentioned mechanism moves the common connector 3034 from the predetermined abutting position for a distance that corresponds to the above-mentioned number of pulses to position the common connector 3034 at the predetermined separated position.

Further, the connector attach/detach position for the black developing unit 3051 becomes the developing position for the yellow developing unit 3054 where the developing roller 3510 of the yellow developing unit 3054 and the photoconductor 3020 oppose each other. That is, the connector attach/detach position of the YMCK developing device 3050 for the black developing unit 3051 is the developing position of the YMCK developing device 3050 for the yellow developing unit 3054. Further, the position achieved when the pulse motor rotates the YMCK developing device 3050 counterclockwise by 90° becomes the connector attach/detach position for the cyan developing unit 3053 and the developing position for the black developing unit 3051, and by rotating the YMCK developing device 3050 at 90° intervals, the connector attach/detach position and the developing position for each of the developing units are successively achieved.

It should be noted that, as shown in FIG. 21B, at the connector attach/detach position of the YMCK developing device 3050 for the black developing unit 3051, the black developing unit 3051 is positioned lower, in the vertical direction, than the rotating shaft 3050*a* of the YMCK developing device 3050. Further, at this connector attach/detach position, the opening 3572 of the black developing unit 3051 is positioned at the lower side, in the vertical direction, of the black developing unit 3051.

One of the two frame side plates that support the YMCK developing device 3050 and that form the casing of the printer 3010 is provided with an attach/detach dedicated opening 3037 through which one of the developing units can pass. The attach/detach dedicated opening 3037 is formed at a position where only a relevant developing unit (here, the black developing unit 3051) can be pulled out and be detached in the direction of the rotating shaft 3050*a*, as shown in FIG. 21C, when the YMCK developing device 3050 is rotated and the relevant one of the developing units is stopped at a developing unit detachment position which is set for each developing unit. Further, the attach/detach dedicated opening 3037 is formed slightly larger than the outer shape of a developing unit. At the developing unit detachment position, not only is it possible to detach the developing unit, it is also possible to insert a new developing unit through this attach/detach dedicated opening 3037 in the direction of the rotating shaft 3050*a* and attach the developing unit to the support frame 3055. While the YMCK developing device 3050 is positioned at positions other than the developing unit detachment position, the attachment/detachment of that developing unit is restricted by the frame side plates.

It should be noted that, as shown in FIG. 21C, at the black-developing-unit detachment position of the YMCK developing device 3050, the above-described opening 3572 of the black developing unit 3051 is positioned at the upper side, in the vertical direction, of the black developing unit 3051.

Further, a lock mechanism, which is not shown, is provided for certainly positioning and fixing the YMCK developing device 3050 at the positions described above.

==Overview of Control Unit===

Next, with reference to FIG. 18, the configuration of the control unit 3100 will be described. The main controller 3101 of the control unit 3100 is connected to the host computer through the interface 3112 and includes an image memory 3113 for storing image signals that have been input from the host computer. The unit controller 3102 is electrically connected to each of the units of the main apparatus (i.e., the charging unit 3030, the exposing unit 3040, the first transferring unit 3060, the cleaning unit 3075, the second transferring unit 3080, the fusing unit 3090, and the displaying unit 3095) and the YMCK developing device 3050. By receiving signals from sensors provided on each of the units, the unit controller 3102 detects the state of each unit and the YMCK developing device 3050 and controls each unit and the YMCK developing device 3050 according to the signals input from the main controller 3101.

Further, the CPU 3120 of the unit controller 3102 is connected, via a serial interface (I/F) 3121, to a non-volatile storage element 3122 (which is referred to below as "apparatus-side memory") which is, for example, a serial EEPROM. The CPU 3120 is not only connected to the apparatus-side memory 3122, but is also connected to the developing-unit-side memories 3051*a*, 3052*a*, 3053*a*, and 3054*a*, which are provided on the respective developing units 3051, 3052, 3053, and 3054, via the serial interface 3121. Therefore, data can be exchanged between the apparatus-side memory 3122 and the developing-unit-side memories 3051*a*, 3052*a*, 3053*a*, and 3054*a*, and also, it is possible to input chip-select signals CS to the developing-unit-side memories 3051*a*, 3052*a*, 3053*a*, and 3054*a* via the input/output port 3123. The CPU 3120 is also connected to the HP detector 3031 via the input/output port 3123.

===About the toner adhering to the developing unit===

Figure 23:
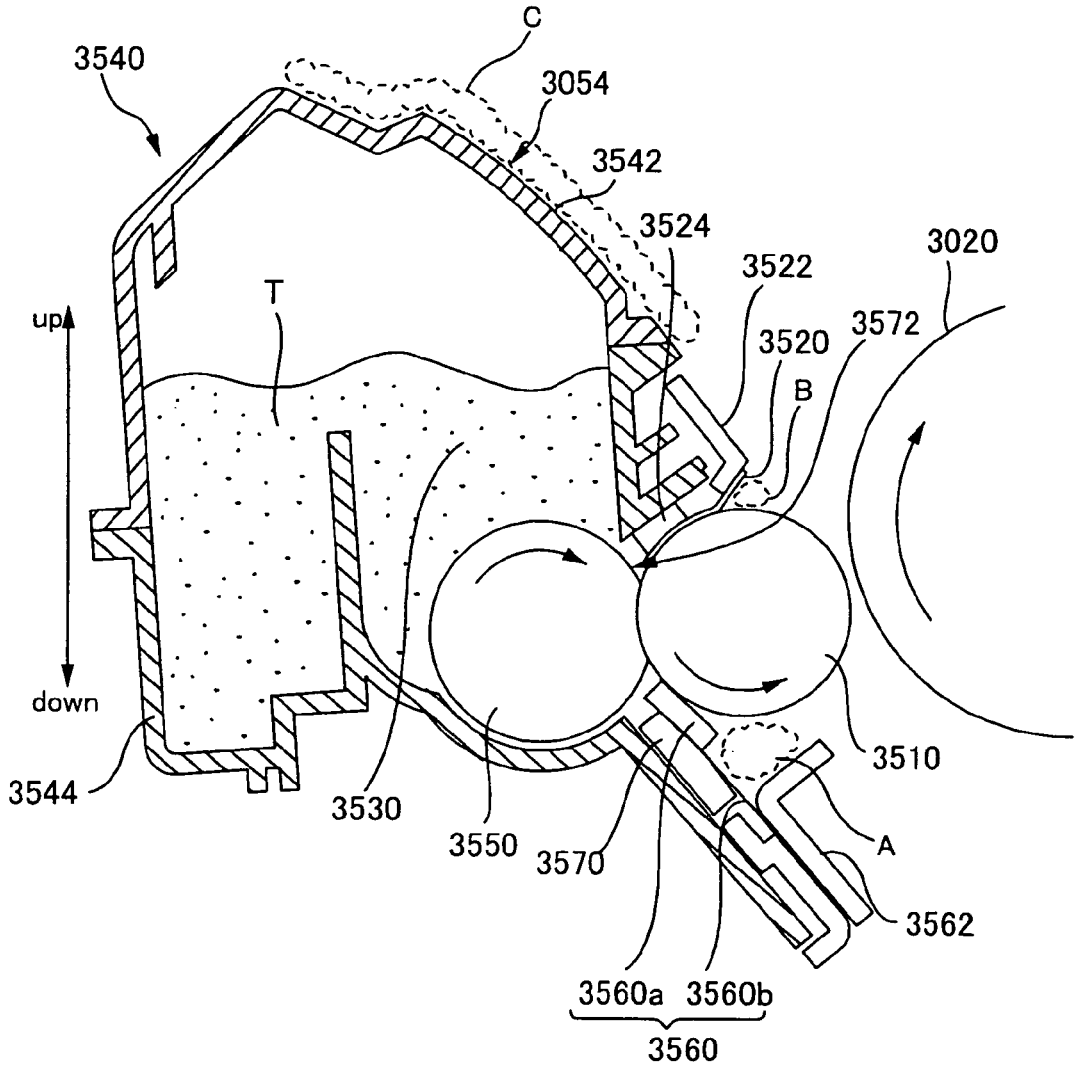
FIG. 23 is a section view showing the position on the developing unit where toner T adheres.

As described in the section of the "Description of the Related Art", there are cases in which the toner T, which is contained in each developing unit, spills from the developing unit and adheres to it. Below, the mechanism in which the toner T spills from a developing unit and adheres thereto, and the positions on the developing unit where the toner T adheres are described using FIG. 23. FIG. 23 is a section view showing the position on the developing unit where the toner T adheres.

As described above, the toner T that has been supplied by the toner supplying roller 3550 and bore by the developing roller 3510 reaches the abutting position of the restriction blade 3560 with the rotation of the developing roller 3510, and as the toner passes the abutting position, it is electrically charged and its layer thickness is restricted. As a result of the toner thickness of the toner T being restricted, the toner T that has reached the abutting position is divided into: toner T that is carried, with further rotation of the developing roller 3510, to the developing position opposing the photoconductor 3020; and toner T that is returned to the toner containing section 3530. The toner T that has been carried to the developing position is used at the developing position, under an alternating field, for developing a latent image formed on the photoconductor 3020.

If, however, the toner T is agglomerated for some reason, the toner T will be in an agglomeration and make the restriction blade 3560 rise. As a result, a phenomenon in which the agglomeration of toner spills out from between the restriction blade 3560 and the developing roller 3510 will occur. The toner T that has spilled will therefore adhere to the section accompanied with the mark A in FIG. 23.

The agglomeration of toner T described above could, for example, occur more significantly in the following case. Printers are sometimes used for forming images on media using toner T of a single color (for example, monochrome). In this image-forming process according to the single-color image-forming mode, development is carried out using the same developing unit for a long time. Therefore, the developing units will not be subjected to rotation for a long time, in contrast to the case in which color images are formed. In such a situation, the toner T contained in the developing units settles out in the direction of gravity. The settlement of toner T causes deterioration in flowability of toner T. This deterioration in the flowability of toner T accelerates agglomeration of toner T. For example, the deterioration in toner flowability gives rise to insufficient charging of toner, and as a consequence, it causes a problem that desired images cannot be obtained. Further, in the state where the developing units are not rotated for a long time such as in the single-color image-forming mode, development will be continuously carried out using the toner T that is supplied to the developing roller 3510 by the toner supplying roller 3550 and that is bore by the developing roller 3510, without the toner T being stirred. As a result, only the toner T, out of all the toner T contained in the developing unit, that is positioned close to the developing roller 3510 and the toner supplying roller 3550 will deteriorate. The toner T that has deteriorated accelerates agglomeration of toner T.

Further, as describe above, the toner T that has been carried to the developing position is used at the developing position, under an alternating field, for developing a latent image formed on the photoconductor 3020. On the other hand, the toner T that was not used for developing the latent image passes the sealing member 3520 according to further rotation of the developing roller 3510. The toner T is then collected into the developing unit by the sealing member 3520.

However, if, for example, the amount of toner T that was not used for developing the latent image is large, then a situation in which the sealing member 3520 cannot sufficiently collect the toner T will occur. In this situation, the toner T will adhere to the section accompanied with the mark B in FIG. 23. It should be noted that the situation in which the amount of toner T that was not used for developing the latent image becomes large occurs when, for example, an image with a low printing rate is formed (i.e., when the ratio in area of the image-containing section with respect to the medium is low).

It should be noted that, although the toner T will adhere to sections around the opening of the developing unit as described above (refer to the section A and the section B in FIG. 23), there also are cases where the toner adheres to other sections. For example, scattered toner may adhere to the section accompanied with the mark C in FIG. 23.

Figure 24:
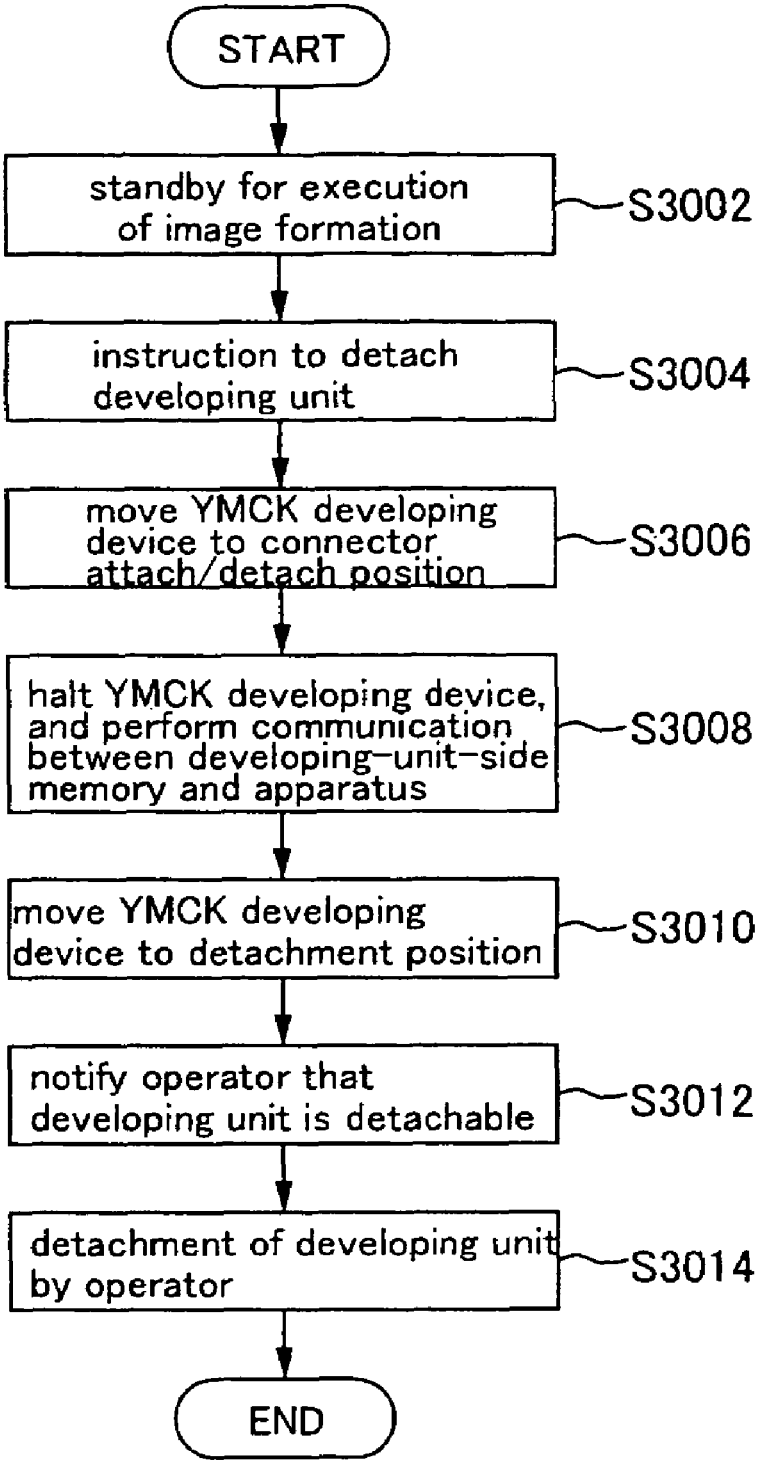
FIG. 24 is a flowchart for illustrating an operation of the image forming apparatus for when a developing unit is detached.

Operation of image forming apparatus for when developing unit is detached. Next, an operation of the image forming apparatus for when a developing unit is detached will be described using FIG. 24, paying attention particularly to the rotating operations of the YMCK developing device 3050. FIG. 24 is a flowchart for illustrating the operation of the image forming apparatus for when a developing unit is detached. The various operations of the printer 3010 described below are achieved mainly by the unit controller 3102 of the printer 3010. Particularly, in the present embodiment, these operations are achieved by the CPU 3120 processing a program stored in a ROM. The program contains codes for realizing the various operations described below. It should be noted that, in the present embodiment, an example in which the black developing unit 3051 is employed as the developing unit to be detached will be described. However, the operations are applicable for detaching the other developing units.

This flowchart starts from a state in which the printer 3010 is on standby for image formation to be carried out (step S3002), with the power of the printer 3010 already turned ON. The standby position of the YMCK developing device 3050 at this time is at the HP position shown in FIG. 21A.

In the above-mentioned state, the operator, such as the user, instructs the printer 3010 to perform detachment of a developing unit by operating menu buttons provided on the displaying unit 3095 etc. to select a detach command instructing detachment of a developing unit (step S3004). The user designates the developing unit to be detached (in this example, the black developing unit 3051) when he/she makes the instruction.

The unit controller 3102 interprets this command with a displaying unit drive control circuit. More specifically, the unit controller 3102 determines whether the developing unit to be detached is the black developing unit 3051, the magenta developing unit 3052, the cyan developing unit 3053, or the yellow developing unit 3054. In the present embodiment, the developing unit to be detached is the black developing unit 3051. Therefore, the unit controller 3102 rotates the YMCK developing device 3050 by rotating the pulse motor for a predetermined amount of pulses to move the position of the YMCK developing device 3050 from the HP position to the connector attach/detach position for the black developing unit 3051 shown in FIG. 21B (step S3006).

The unit controller 3102 then halts the YMCK developing device 3050 at the connector attach/detach position, and in this halted state, moves the apparatus-side connector 3034 to make the apparatus-side connector 3034 and the developing-unit-side connector 3051*b* of the black developing unit 3051 abut against each other. In this state, the developing-unit-side memory 3051*a* attached to the black developing unit 3051 is electrically connected to the unit controller 3102 of the control unit 3100, and communication is possible between the developing-unit-side memory 3051*a* and the apparatus (step S3008).

After communication is finished and the apparatus-side connector 3034 is separated from the developing-unit-side connector 3051*b*, the unit controller 3102 rotates the YMCK developing device 3050 by rotating the pulse motor for a predetermined amount of pulses to move the position of the YMCK developing device 3050 from the connector attach/detach position for the black developing unit 3051 to the detachment position for the black developing unit 3051 shown in FIG. 21C (step S3010).

In this state, the unit controller 3102 displays a notification indicating that the black developing unit 3051 is now detachable on, for example, a displaying section provided on the displaying unit 3095 to thereby make a notification to the operator (step S3012).

Having confirmed the display, the operator opens an outer cover of the printer 3010 and detaches the black developing unit 3051, which is located behind the attach/detach dedicated opening 3037, from the YMCK developing device 3050 through this attach/detach dedicated opening 3037 (step S3014).

It should be noted that the movement speed at which the YMCK developing device 3050 moves to the detachment position for the black developing unit 3051 reaches its maximum right before the YMCK developing device 3050 is temporarily halted at least once at step S3008.

Further, the movement speed that has reached its maximum right before the YMCK developing device 3050 is temporarily halted at least once is the same as the movement speed at which the YMCK developing device 3050 rotationally moves when a plural-color image-forming mode, in which images are formed on media using toner T of a plurality of colors contained in the plurality of developing units that are attached to the YMCK developing device 3050, is executed. It should be noted that these speeds do not have to be exactly the same, but need only be approximately the same.

In the procedure described above, the YMCK developing device 3050 is temporarily halted once (step S3006) before moving it to the detachment position for the black developing unit 3051 (step S3010). By temporarily halting the YMCK developing device 3050 at least once while the YMCK developing device 3050 moves to the predetermined detachment position in this way, it is possible to prevent contamination caused by the toner T upon detachment of a developing unit.

That is, as described, for example, in the "Description of the Related Art", there are cases in which the toner T, which is contained in each developing unit, spills from the developing unit and the toner T that has spilled adheres to the developing unit, and if the operator detaches the developing unit with the toner T adhering to it, then the toner T on the developing unit may get on the hands of the operator and contaminate his/her hands, or the toner T on the developing unit may spill and contaminate the operator or the places around him/her.

In view of the above, the YMCK developing device 3050 is temporarily halted at least once while the YMCK developing device 3050 moves to a predetermined detachment position. In this way, the toner T adhering to the developing unit will be rapidly accelerated before and after the halt. This acceleration causes a force that makes the toner T move, and thus, the toner T adhering to the developing unit will be stripped off from the developing unit and fall in the printer 3010. When the operator detaches the developing unit after the YMCK developing device 3050 moves to the predetermined detachment position, the toner T that was on the developing unit will be appropriately removed. Therefore, the possibility at which the toner T on the developing unit gets on the hands of the operator and contaminates his/her hands, or the possibility at which the toner T on the developing unit spills and contaminates the operator or the places around him/her becomes small. That is, it becomes possible to prevent contamination caused by the toner T upon detachment of a developing unit.

===Other Considerations===

In the foregoing, an image forming apparatus etc. according to the present invention was described according to the above-described embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing embodiment, an intermediate transferring type full-color laser beam printer was described as an example of the image forming apparatus, but the present invention is also applicable to various other types of image forming apparatuses, such as full-color laser beam printers that are not of the intermediate transferring type, monochrome laser beam printers, copying machines, and facsimiles.

Further, in the foregoing embodiment, an image forming apparatus provided with a rotary-type developing device was described as an example. This, however, is not a limitation, and the present invention is applicable to, for example, image forming apparatuses provided with tandem-type developing devices.

Further, in the foregoing embodiment, developing units were described as an example of a developer container. The developer container, however, does not necessarily have to be provided with the function of developing latent images, and the present invention is application even to such a configuration.

Further, in the foregoing embodiment, a plurality of developing units containing toner of different colors were made attachable to and detachable from the YMCK developing device. This, however, is not a limitation, and the present invention is applicable to a configuration in which, for example, only one developing unit can be attached to and detached from the YMCK developing device. Further, the present invention is also applicable to a configuration in which only one developing unit is attached to the YMCK developing device even though a plurality of developing units can be attached to and detached from the YMCK developing device.

Further, a situation in which another developing unit is to be attached after detaching a developing unit, a situation in which the same developing unit is to be attached again after detaching it, and a situation in which a developing unit is to be simply detached can be exemplified as the situation in which a developing unit is detached. The present invention is applicable to any of the situations described above. Further, in the foregoing embodiment, the developing-unit detachment operation of the image forming apparatus was started according to a request from a user. This, however, is not a limitation, and, for example, the developing-unit detachment operation may be started automatically.

Further, in the foregoing embodiment, the apparatus-side connector was brought into abutment with the developing-unit-side connector to establish communication between the developing-unit-side memory and the apparatus. This, however, is not a limitation, and, for example, communication can be achieved without bringing the members of the developing unit and the members of the apparatus into contact.

Further, the photoconductor is not limited to the so-called photoconductive roller structured by providing a photoconductive layer on the outer peripheral surface of a cylindrical, conductive base. The photoconductor can be a so-called photoconductive belt structured by providing a photoconductive layer on a surface of a belt-like conductive base.

Further, in the foregoing embodiment, the printer carried out communication with the storage element when the printer temporarily halts the YMCK developing device while the YMCK developing device moves to the predetermined detachment position. This, however, is not a limitation.

For example, communication may be carried out at other timings, without the communication between the storage element and the apparatus being carried out when the printer temporarily halts the YMCK developing device while the YMCK developing device moves to the predetermined detachment position. Further, communication does not have to be carried out at all.

If, however, the printer carries out communication with the storage element when the printer temporarily halts the YMCK developing device while the YMCK developing device moves to the predetermined detachment position, then it becomes possible to achieve two objects at the same timing, and time can be used efficiently. The foregoing embodiment is therefore more preferable in terms that it becomes possible to reduce the amount of time for which the operator has to wait in order to carry out his/her developing-unit detachment task.

Further, in the foregoing embodiment, the movement speed at which the YMCK developing device moves to the detachment position reached its maximum right before the printer temporarily halts the YMCK developing device at least once. This, however, is not a limitation. For example, the movement speed at which the YMCK developing device moves to the detachment position may reach its maximum at a different timing.

However, by causing the movement speed at which the YMCK developing device moves to the detachment position to reach its maximum right before the printer temporarily halts the YMCK developing device at least once, the acceleration that is imparted on the toner adhering to the developing unit when the YMCK developing device is temporarily halted while it moves to the detachment position becomes larger. The foregoing embodiment is therefore more preferable in terms that it becomes easier to strip off, from the developing unit, the toner adhering to the developing unit.

Further, in the foregoing embodiment, the movement speed that reached its maximum right before the printer temporarily halts the YMCK developing device at least once was approximately the same as the movement speed at which the YMCK developing device moves when an image is formed on a medium using the toners of the plurality of the different colors that are contained in the plurality of developing units attached to the YMCK developing device. This, however, is not a limitation. For example, the movement speed that reached its maximum right before the printer temporarily halts the YMCK developing device at least once may be slower than the movement speed at which the YMCK developing device moves when an image is formed on a medium using the toners of the plurality of the different colors that are contained in the plurality of developing units attached to the YMCK developing device.

The foregoing embodiment, however, is more preferable in terms that the acceleration that is imparted on the toner adhering to the developing unit when the YMCK developing device is temporarily halted while it moves to the detachment position becomes larger, and therefore, it becomes easier to strip off, from the developing unit, the toner adhering to the developing unit.

Further, in the foregoing embodiment, the developing unit that is to be detached was positioned lower, in the vertical direction, than the rotating shaft of the YMCK developing device when the printer temporarily halts the YMCK developing device while the YMCK developing device rotationally moves to the detachment position, as shown in FIG. 21B. This, however, is not a limitation. For example, the developing unit that is to be detached may be positioned higher, in the vertical direction, than the rotating shaft of the YMCK developing device.

The foregoing embodiment, however, is more preferable in terms that, by positioning the developing unit that is to be detached lower, in the vertical direction, than the rotating shaft of the YMCK developing device when the printer temporarily halts the YMCK developing device while it rotationally moves to the detachment position, it is possible to certainly cause the toner that has been stripped off to fall towards the lower section, in the vertical direction, in the printer when the toner adhering to the developing unit is stripped off from the developing unit.

Further, in the foregoing embodiment, the printer further included a toner receiving tray that is for receiving the toner and that is positioned at a lower side, in the vertical direction, of the YMCK developing device, as shown in FIG. 17. This, however, is not a limitation. For example, the printer does not have to include a toner receiving tray.

The foregoing embodiment, however, is more preferable in terms that, by providing a toner receiving tray at the lower side, in the vertical direction, of the YMCK developing device, the toner that has been stripped off from the developing unit and that has fallen downwards in the printer is received by the toner receiving member, and thus a user or a service person can easily remove the fallen toner from the printer.

Further, in the foregoing embodiment, the opening of the developing unit that is to be detached was positioned at a lower side, in the vertical direction, of the developing unit when the printer temporarily halts the YMCK developing device while the YMCK developing device rotationally moves to the detachment position, as shown in FIG. 21B. This, however, is not a limitation. For example, the opening of the developing unit that is to be detached may be positioned at the upper side, in the vertical direction, of the developing unit.

The foregoing embodiment, however, is more preferable in terms that, by positioning the opening of the developing unit that is to be detached at a lower side, in the vertical direction, of the developing unit when the printer temporarily halts the YMCK developing device while the YMCK developing device rotationally moves to the detachment position, it is possible to certainly cause the toner that has been stripped off to fall towards the lower section, in the vertical direction, in the printer when the toner adhering to the developing unit near its opening (for example, at the sections A and B in FIG. 23) is stripped off from the developing unit.

Further, the opening of the developing unit that is to be detached was positioned at an upper side, in the vertical direction, of the developing unit when the YMCK developing device has rotationally moved to the detachment position, as shown in FIG. 21C. This, however, is not a limitation. For example, the opening of the developing unit that is to be detached may be positioned at the lower side, in the vertical direction, of the developing unit.

The foregoing embodiment, however, is more preferable in terms that, by positioning the opening of the developing unit that is to be detached at the upper side, in the vertical direction, of the developing unit when the YMCK developing device has rotationally moved to the detachment position, it is possible to detach the developing unit without spilling the toner adhering to the developing unit near its opening, even if the toner adhering to the developing unit is not sufficiently stripped off therefrom and remains on the developing unit.

Figure 25:
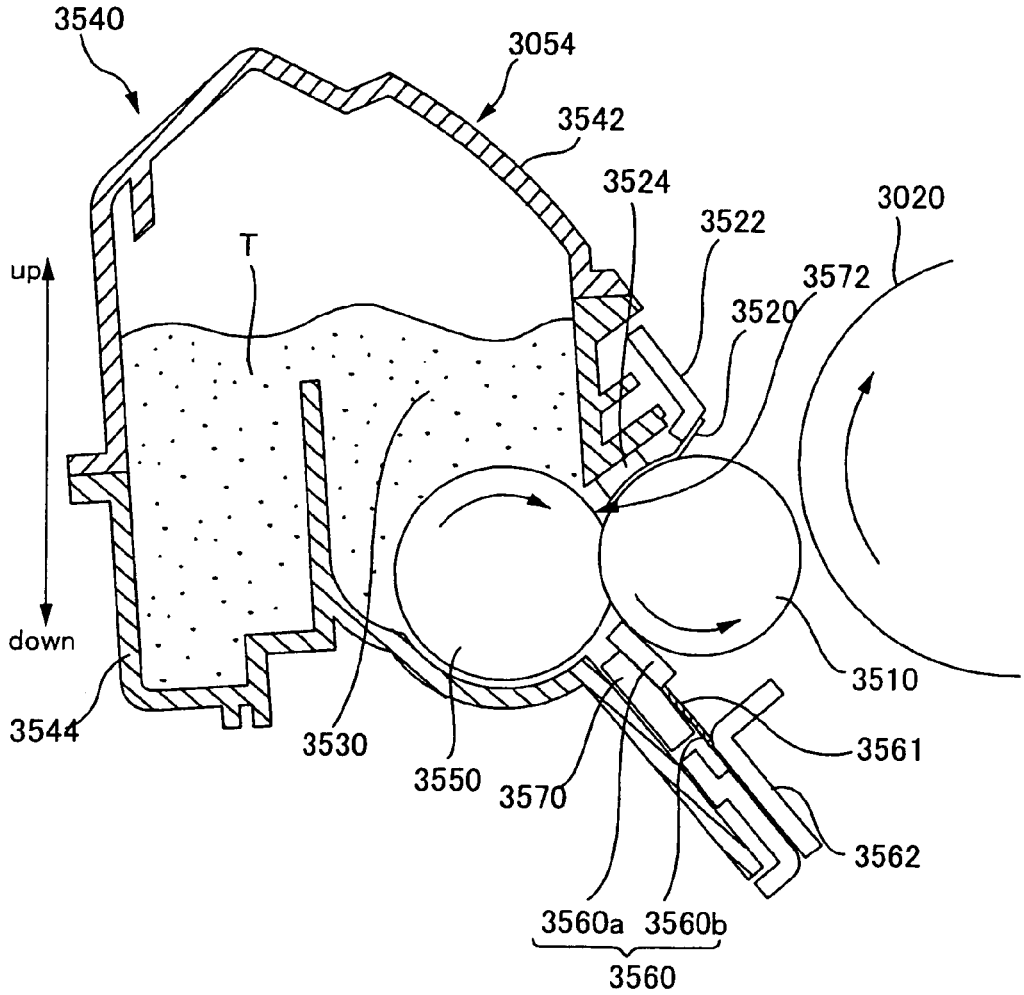
FIG. 25 is a section view showing a slide member 3561 provided on the surface of a rubber-supporting section 3560*b* of the restriction blade 3560.

Further, as shown in FIG. 25, it is possible to provide a slide member 3561, on the surface of the rubber-supporting section 3560*b* of the restriction blade 3560 described above, for causing the toner to slide. This embodiment is more preferable in terms that, in this way, it becomes easy to strip off, from the developing unit, the toner adhering to the section A of the developing unit. It should be noted that it is preferable to use PET etc. as the material for the slide member 3561. Further, note that FIG. 25 is a section view showing the slide member 3561 provided on the surface of the rubber-supporting section 3560*b* of the restriction blade 3560.

Further, the halt position of the YMCK developing device for when the printer temporarily halts the YMCK developing device while the YMCK developing device moves to the detachment position may be the standby position of the YMCK developing device for when the printer is on standby for formation of an image to be carried out.

Figure 26:
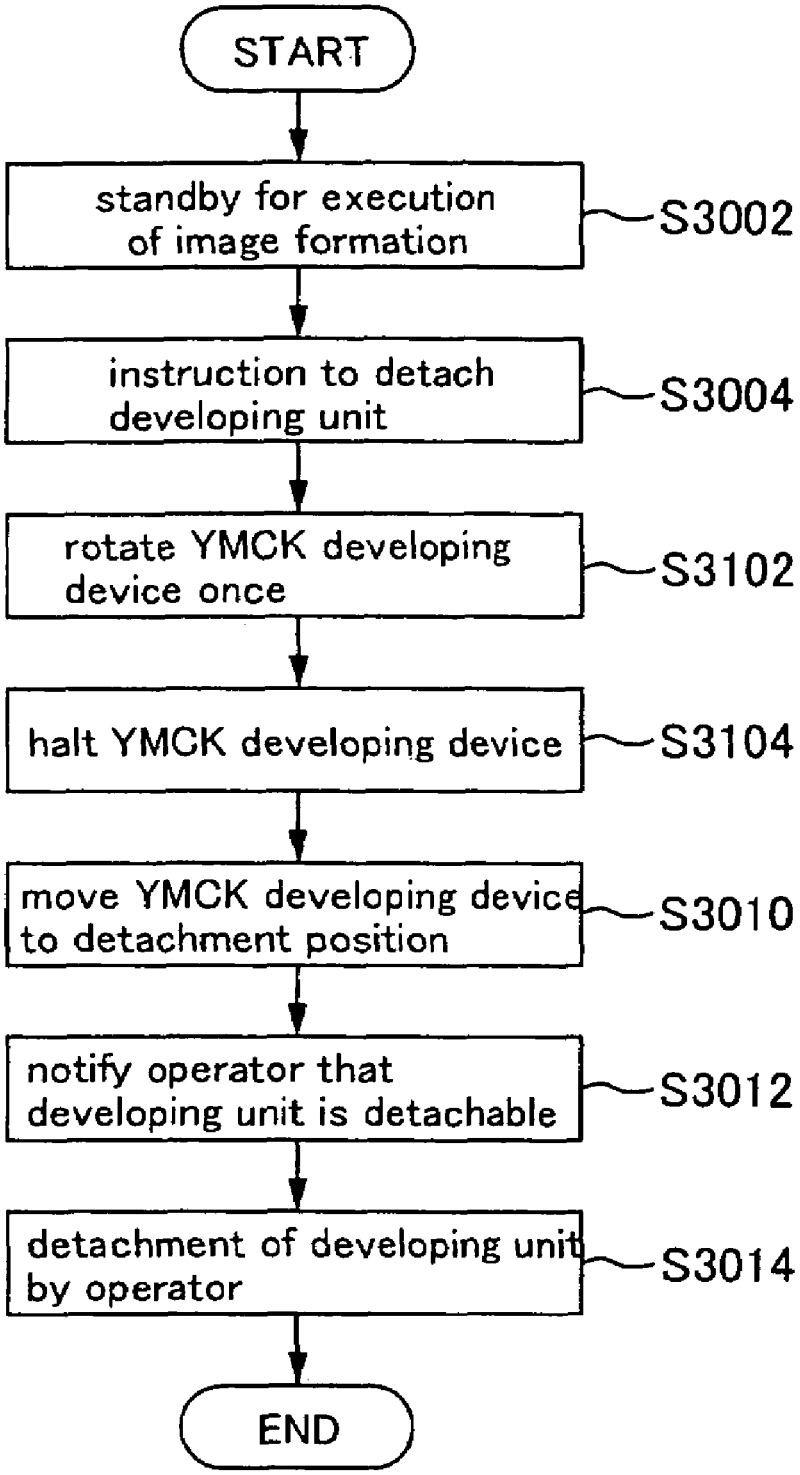
FIG. 26 is a flowchart for illustrating another operation of the image forming apparatus for when a developing unit is detached.

An example of an operation of the image forming apparatus for the above-described situation will be described below using the flowchart of FIG. 26. FIG. 26 is a flowchart for illustrating the operation of the image forming apparatus for when a developing unit is detached. It should be noted that, the various operations of the printer 3010 described below are achieved mainly by the unit controller 3102 of the printer 3010. Particularly, in the present embodiment, these operations are achieved by the CPU 3120 processing a program stored in a ROM. The program contains codes for realizing the various operations described below. Further, in the description below, an example in which the black developing unit 3051 is employed as the developing unit to be detached will be described. However, the operations are applicable for detaching the other developing units.

This flowchart starts from a state in which the printer 3010 is on standby for image formation to be carried out (step S3002), with the power of the printer 3010 already turned ON. The standby position of the YMCK developing device 3050 at this time is at the HP position shown in FIG. 21A.

In the above-mentioned state, the operator, such as the user, instructs the printer 3010 to perform detachment of a developing unit by operating menu buttons etc. provided on the displaying unit 3095 to select a detach command instructing detachment of a developing unit (step S3004). The user designates the developing unit to be detached (in this example, the black developing unit 3051) when he/she makes the instruction.

The unit controller 3102 interprets this command with a displaying unit drive control circuit. More specifically, the unit controller 3102 determines whether the developing unit to be detached is the black developing unit 3051, the magenta developing unit 3052, the cyan developing unit 3053, or the yellow developing unit 3054. The unit controller 3102 then rotates the YMCK developing device 3050 once by rotating the pulse motor for a predetermined amount of pulses (step S3102), and temporarily halts the YMCK developing device 3050 for a predetermined amount of time at this position, i.e., at the HP position (step S3104). Then, the unit controller 3102 changes the position of the YMCK developing device 3050 from the HP position to the detachment position for the black developing unit 3051 shown in FIG. 21C (step S3010), because in the present embodiment, the black developing unit 3051 is determined to be the developing unit to be detached.

The other procedures that follow (i.e., step S3012 and step S3014) are the same as those shown in the flowchart of FIG. 24.

As described above, by setting the halt position of the YMCK developing device, for when the printer temporarily halts the YMCK developing device while the YMCK developing device moves to the detachment position, to be the standby position, i.e., the HP position shown in FIG. 21A, of the YMCK developing device for when the printer is on standby for formation of an image to be carried out, the HP position will also be used as the halt position of the YMCK developing device where the toner is stripped off from the developing unit, and thus, it becomes possible to avoid complication in structure of the printer caused by providing a halt position anew.

Further, as shown in FIG. 21A, the black developing unit is positioned lower, in the vertical direction, than the rotating shaft of the YMCK developing device when the printer temporarily halts the YMCK developing device at the HP position. Further, as described above, when images are formed according to the single-color image-forming mode, toner tends to spill from the developing unit, and also, black toner is often used in this single-color image-forming mode. With the above-mentioned configuration, it is therefore possible to certainly cause the black toner that has been stripped off to fall towards the lower section, in the vertical direction, in the printer when the black toner, for which the possibility of adhering to the developing unit is highest among the toner of the four colors, is stripped off from the developing unit.

Figure 27:
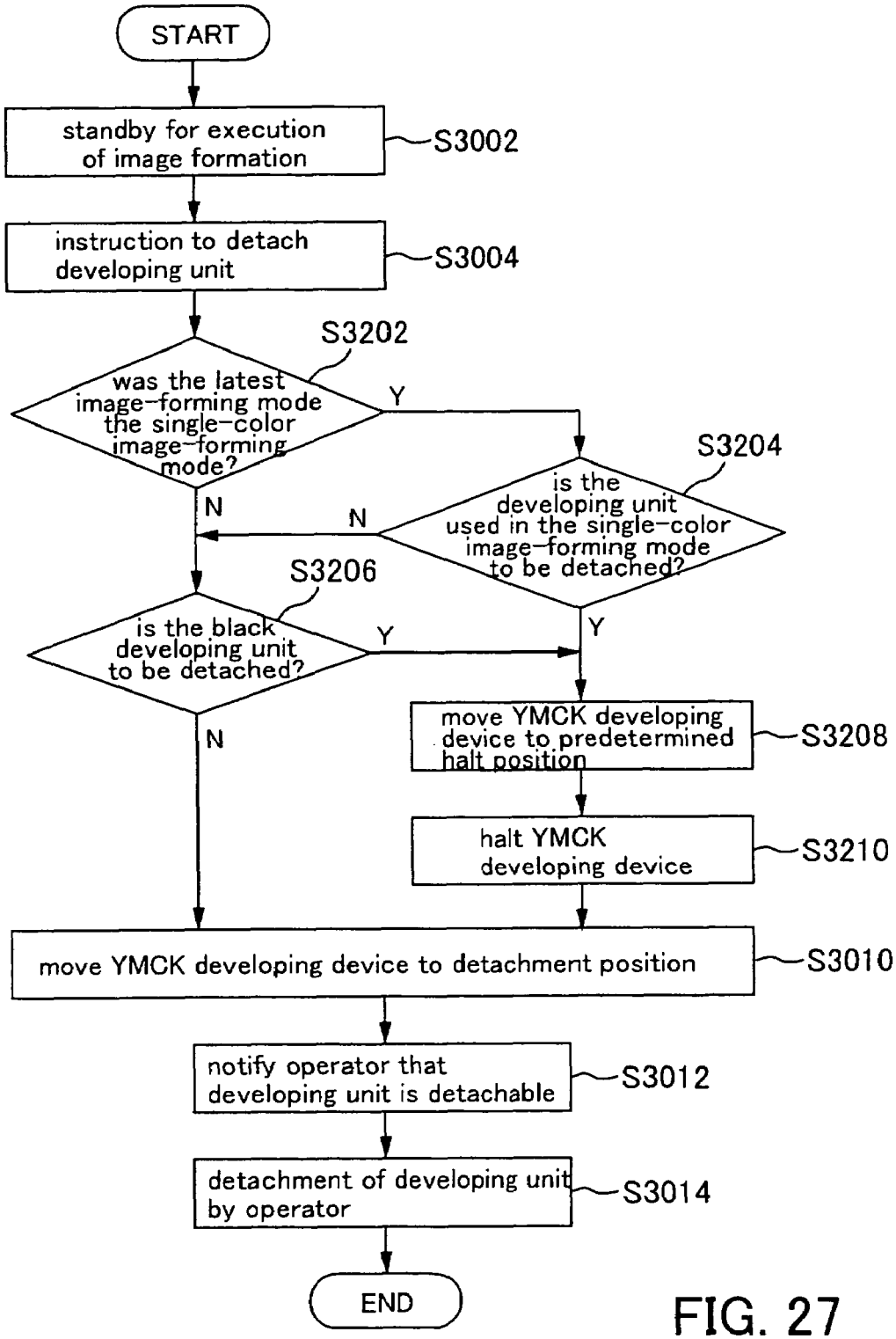
FIG. 27 is a flowchart for illustrating another operation of the image forming apparatus for when a developing unit is detached.

Further, it is possible to temporarily halt the YMCK developing device at least once while the YMCK developing device moves to the detachment position, only when certain conditions are met. An example of an operation of the image forming apparatus for the above-described situation will be described below using the flowchart of FIG. 27. FIG. 27 is a flowchart for illustrating the operation of the image forming apparatus for when a developing unit is detached. It should be noted that the various operations of the printer 3010 described below are achieved mainly by the unit controller 3102 of the printer 3010. Particularly, in the present embodiment, these operations are achieved by the CPU 3120 processing a program stored in a ROM. The program contains codes for realizing the various operations described below.

This flowchart starts from a state in which the printer 3010 is on standby for image formation to be carried out (step S3002), with the power of the printer 3010 already turned ON. The standby position of the YMCK developing device 3050 at this time is at the HP position shown in FIG. 21A.

In the above-mentioned state, the operator, such as the user, instructs the printer 3010 to perform detachment of a developing unit by operating menu buttons etc. provided on the displaying unit 3095 to select a detach command instructing detachment of a developing unit (step S3004). The user designates the developing unit to be detached when he/she makes the instruction.

The unit controller 3102 interprets this command with a displaying unit drive control circuit. More specifically, the unit controller 3102 determines whether the developing unit to be detached is the black developing unit 3051, the magenta developing unit 3052, the cyan developing unit 3053, or the yellow developing unit 3054.

Further, the unit controller 3102 determines whether the image-forming mode that has been selected the latest is either the plural-color image-forming mode in which the printer forms an image on a medium using the toners T of the plurality of the different colors that are contained in the plurality of developing units, or the single-color image-forming mode in which the printer forms an image on a medium using toner T that is of a single color and that is contained in one of the plurality of developing units. Information about the image-forming modes are, for example, input from the host computer into the unit controller 3102 via the main controller 3101 of the printer 3010 and are stored in the RAM of the unit controller 3102.

If the image-forming mode that has been selected the latest is the single-color image-forming mode (step S3202), then the unit controller 3102 determines whether the developing unit that is to be detached is the developing unit that is used in the single-color image-forming mode (step S3204). If the developing unit that is to be detached is the developing unit that is used in the single-color image-forming mode, then the operation in which the YMCK developing device 3050 is temporarily halted at least once while the YMCK developing device 3050 moves to the detachment position is executed, as described below.

On the other hand, if the image-forming mode that has been selected the latest is not the single-color image-forming mode (step S3202) or if the developing unit that is to be detached is not the developing unit that is used in the single-color image-forming mode (step S3204), then the unit controller 3102 determines whether the developing unit that is to be detached is the black developing unit 3051 (step S3206). If the developing unit that is to be detached is the black developing unit 3051, then the operation of temporarily halting the YMCK developing device 3050 at least once while the YMCK developing device 3050 moves to the detachment position is executed, as described below. On the other hand, if the developing unit that is to be detached is not the black developing unit 3051, then the operation of temporarily halting the YMCK developing device 3050 at least once while the YMCK developing device 3050 moves to the detachment position is not executed.

For the cases where it is determined in step S3204 that the developing unit that is to be detached is the developing unit that is used in the single-color image-forming mode, and where it is determined in step S3206 that the developing unit that is to be detached is the black developing unit 3051, the unit controller 3102 moves the YMCK developing device 3050 to a predetermined halt position (step S3208) and halts it temporarily for a predetermined amount of time (step S3210). The unit controller 3102 then changes the position of the YMCK developing device 3050 from the predetermined halt position to the developing-unit detachment position (step S3010).

On the other hand, for the case where it is determined in step S3206 that the developing unit that is to be detached is not the black developing unit 3051, the unit controller 3102 changes the position of the YMCK developing device 3050 to the developing-unit detachment position, without temporarily halting the YMCK developing device 3050 (step S3010).

The other procedures that follow (i.e., step S3012 and step S3014) are the same as those shown in the flowchart of FIG. 24.

As described above, the printer temporarily halts the YMCK developing device at least once while the YMCK developing device moves to the detachment position if the image-forming mode of the printer right before the detachment of the developing unit is the single-color image-forming mode, and the developing unit that is to be detached is the developing unit that is used in the single-color image-forming mode. Accordingly, the operation for stripping off the toner from the developing unit is executed only if the possibility that the toner will adhere to the developing unit is high, in view of the fact that the toner tends to spill from the developing unit when images are formed according to the single-color image-forming mode. In this way, it is therefore possible to appropriately prevent contamination caused by the toner upon detachment of the developing unit while taking into consideration the reduction in the amount of time for which the operator has to wait in order to carry out his/her developing-unit detachment task.

Further, as described above, the printer temporarily halts the YMCK developing device at least once while the YMCK developing device moves to the detachment position if the developing unit that is to be detached is the black developing unit. Accordingly, the operation for stripping off the toner from the developing unit is executed only if the possibility that the toner will adhere to the developing unit is high, in view of the fact that the toner tends to spill from the developing unit when images are formed according to the single-color image-forming mode and the fact that black toner is often used for the single-color image-forming mode. In this way, it is therefore possible to appropriately prevent contamination caused by the toner upon detachment of the developing unit while taking into consideration the reduction in the amount of time for which the operator has to wait in order to carry out his/her developing-unit detachment task.

Further, in the foregoing embodiment, an image forming apparatus to and from which developing units can be attached and detached was described as an example. The present invention, however, is of course applicable to image forming apparatuses in which the developing units are already attached thereto and new developing units cannot be attached.

Further, in the foregoing embodiment, the YMCK developing device was temporarily halted only once while it moved to the detachment position. This, however, is not a limitation, and it may be temporarily halted more than once.

<<<Fourth Embodiment>>>

===Overall Configuration Example of Image Forming Apparatus===

Figure 28:
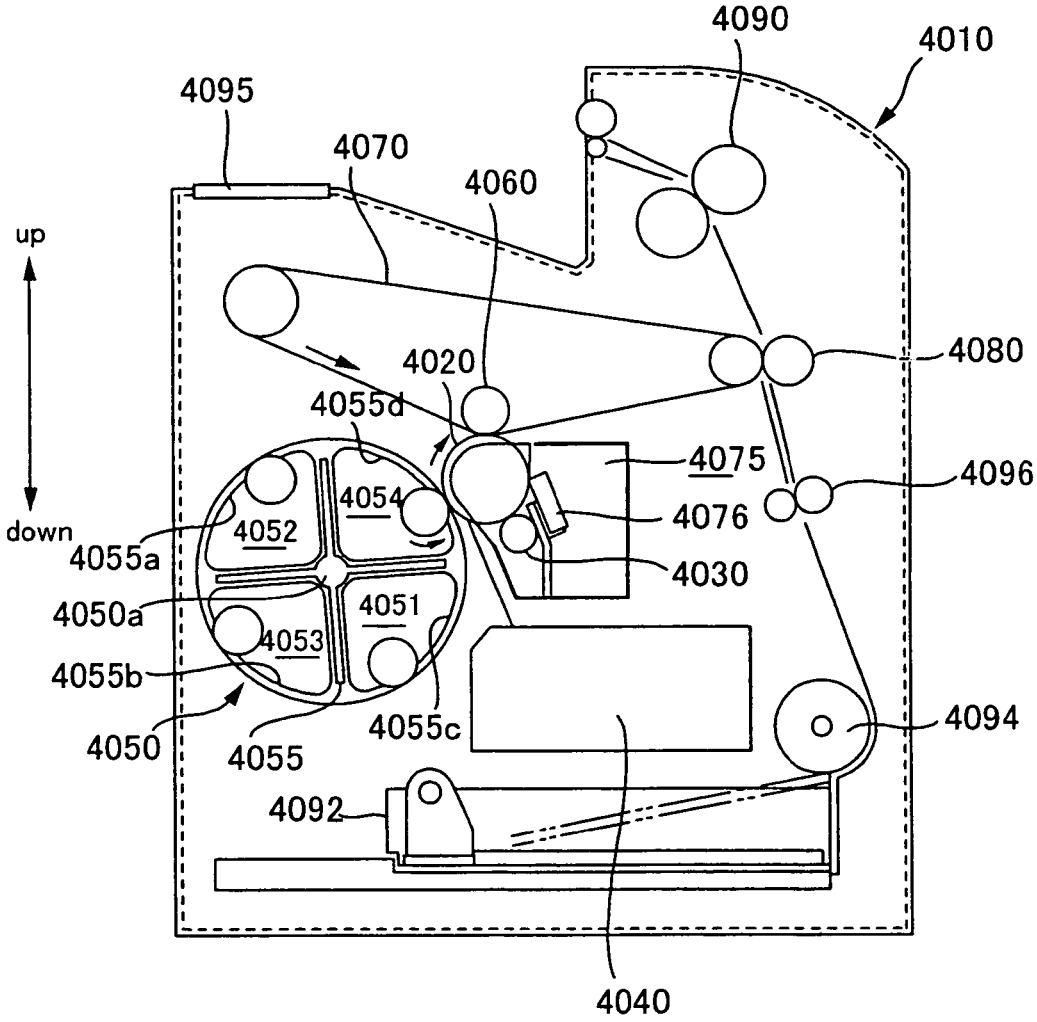
FIG. 28 is a diagram showing main structural components constructing an image forming apparatus according to another embodiment.

Next, using FIG. 28, an outline of an image-forming apparatus will be described, taking a laser-beam printer 4010 (hereinafter referred to also as "printer") as an example. FIG. 28 is a diagram showing main structural components constructing the printer 4010. Note that in FIG. 28, the vertical direction is shown by the arrow, and, for example, a paper supply tray 4092 is arranged at a lower section of the printer 4010, and a fusing unit 4090 is arranged at an upper section of the printer 4010.

As shown in FIG. 28, the printer 4010 according to the present embodiment includes a charging unit 4030, an exposing unit 4040, a YMCK developing unit 4050, a first transferring unit 4060, an intermediate transferring body 4070, and a cleaning unit 4075, all of which being arranged in the direction of rotation of a photoconductor 4020 for bearing latent images. The printer 4010 further includes a second transferring unit 4080, a fusing unit 4090, a displaying unit 4095 constructed of a liquid-crystal panel and serving as means for making notifications to a user, and a control unit (FIG. 29) for controlling these units etc. and managing the operations as a printer.

The photoconductor 4020 has a cylindrical conductive base and a photoconductive layer formed on the outer peripheral surface of the conductive base, and it is rotatable about a central axis. In the present embodiment, the photoconductor 4020 rotates clockwise, as shown by the arrow in FIG. 28.

The charging unit 4030 is a device for charging the photoconductor 4020. The exposing unit 4040 is a device for forming a latent image on the charged photoconductor 4020 by radiating laser thereon. The exposing unit 4040 has, for example, a semiconductor laser, a polygon mirror, and an F-θ lens, and radiates modulated laser onto the charged photoconductor 4020 according to image information having been input from a not-shown host computer such as a personal computer or a word processor.

The YMCK developing unit 4050 is a device for developing the latent image formed on the photoconductor 4020 using toner T, that is, black (K) toner contained in a black developing device 4051, magenta (M) toner contained in a magenta developing device 4052, cyan (C) toner contained in a cyan developing device 4053, and yellow (Y) toner contained in a yellow developing device 4054. The toner T is an example of developer contained in each of the developing devices.

In the present embodiment, the YMCK developing unit 4050 can move the positions of the four developing devices 4051, 4052, 4053, and 4054 by rotating. More specifically, the YMCK developing unit 4050 holds the four developing devices 4051, 4052, 4053, and 4054 with four holding sections 4055*a*, 4055*b*, 4055*c*, and 4055*d*. The four developing devices 4051, 4052, 4053, and 4054 can be rotated about a rotating shaft 4050*a* while maintaining their relative positions. Every time an image forming process for one page is finished, each of the developing devices selectively opposes the photoconductor 4020 to successively develop the latent image formed on the photoconductor 4020 using the toner T contained in each of the developing devices 4051, 4052, 4053, and 4054. It should be noted that each of the four developing devices 4051, 4052, 4053, and 4054 described above is attachable to and detachable from the respective holding sections of the YMCK developing unit 4050. Further, details on the developing devices will be described later.

The first transferring unit 4060 is a device for transferring, onto the intermediate transferring body 4070, a single-color toner image formed on the photoconductor 4020. When the toners of all four colors are successively transferred in a superimposing manner, a full-color toner image will be formed on the intermediate transferring body 4070.

The intermediate transferring body 4070 is a laminated endless belt that is made by providing an aluminum layer on the surface of a PET film by vapor deposition, and then further applying semiconducting coating on the outer layer thereof. The intermediate transferring body 4070 is driven to rotate at substantially the same circumferential speed as the photoconductor 4020.

The second transferring unit 4080 is a device for transferring the single-color toner image or the full-color toner image formed on the intermediate transferring body 4070 onto a medium such as paper, film, and cloth.

The fusing unit 4090 is a device for fusing the single-color toner image or the full-color toner image, which has been transferred onto the medium, onto the medium to make it into a permanent image.

The cleaning unit 4075 is a device that is provided between the first transferring unit 4060 and the charging unit 4030, that has a rubber cleaning blade 4076 made to abut against the surface of the photoconductor 4020, and that is for removing the toner T remaining on the photoconductor 4020 by scraping it off with the cleaning blade 4076 after the toner image has been transferred onto the intermediate transferring body 4070 by the first transferring unit 4060.

Figure 29:
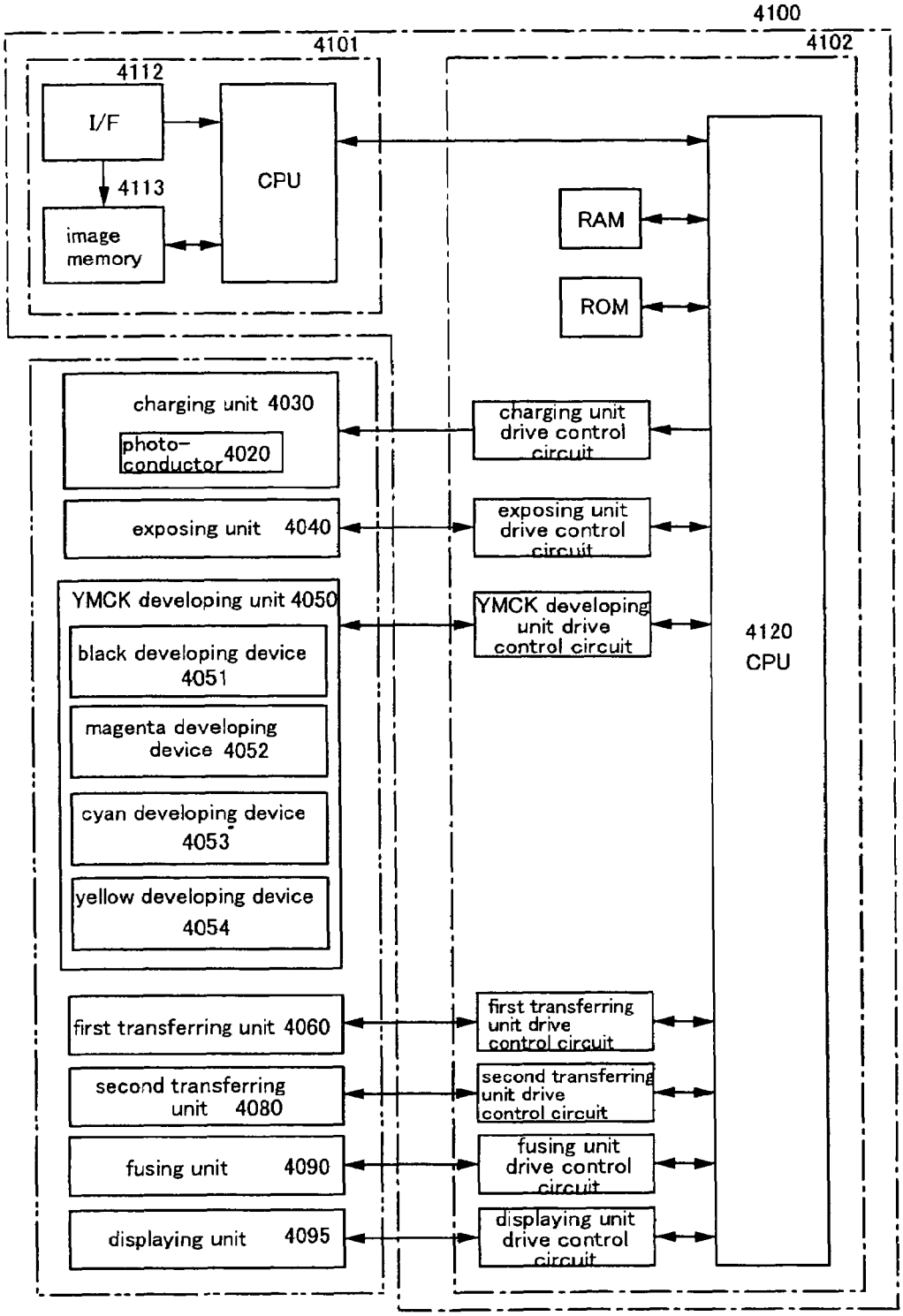
FIG. 29 is a block diagram showing a control unit of the image forming apparatus in FIG. 28.

The control unit 4100 comprises a main controller 4101 and a unit controller 4102 as shown in FIG. 29. An image signal is input to the main controller 4101, and according to instructions based on the image signal, the unit controller 4102 controls each of the above-mentioned units etc. to form an image.

Next, operations of the printer 4010 structured as above will be described with reference to other structural components.

First, when an image signal is input from the not-shown host computer to the main controller 4101 of the printer 4010 through an interface (I/F) 4112, the photoconductor 4020, a developing roller as an example of a developer bearing body, and the intermediate transferring body 4070 rotate under the control of the unit controller 4102 based on the instructions from the main controller 4101. While being rotated, the photoconductor 4020 is successively charged by the charging unit 4030 at a charging position.

With the rotation of the photoconductor 4020, the charged area of the photoconductor 4020 reaches an exposing position. A latent image that corresponds to the image information about the first color, for example, yellow Y, is formed in that area by the exposing unit 4040. As regards the YMCK developing unit 4050, the yellow developing device 4054, which contains yellow (Y) toner, is positioned in the developing position opposing the photoconductor 4020.

With the rotation of the photoconductor 4020, the latent image formed on the photoconductor 4020 reaches the developing position, and is developed with the yellow toner by the yellow developing device 4054. Thus, a yellow toner image is formed on the photoconductor 4020.

With the rotation of the photoconductor 4020, the yellow toner image formed on the photoconductor 4020 reaches a first transferring position, and is transferred onto the intermediate transferring body 4070 by the first transferring unit 4060. At this time, a first transferring voltage, which is in an opposite polarity to the polarity to which the toner T is charged, is applied to the first transferring unit 4060. It should be noted that, during this process, the photoconductor 4020 and the intermediate transferring body 4070 are placed in contact with each other, and the second transferring unit 4080 is kept separated from the intermediate transferring body 4070.

By subsequently performing the above-mentioned processes for the second, the third, and the fourth colors for each of the developing devices, toner images in four colors corresponding to the respective image signals are transferred to the intermediate transferring body 4070 in a superimposed manner. As a result, a full-color toner image is formed on the intermediate transferring body 4070.

With the rotation of the intermediate transferring body 4070, the full-color toner image formed on the intermediate transferring body 4070 reaches a second transferring position, and is transferred onto a medium by the second transferring unit 4080. It should be noted that the medium is carried from the paper supply tray 4092 to the second transferring unit 4080 via the paper-feed roller 4094 and resisting rollers 4096. During transferring operations, a second transferring voltage is applied to the second transferring unit 4080 and also the unit 4080 is pressed against the intermediate transferring body 4070.

The full-color toner image transferred onto the medium is heated and pressurized by the fusing unit 4090 and fused to the medium.

On the other hand, after the photoconductor 4020 passes the first transferring position, the toner T adhering to the surface of the photoconductor 4020 is scraped off by the cleaning blade 4076 that is supported on the cleaning unit 4075, and the photoconductor 4020 is prepared for charging for forming the next latent image. The scraped-off toner T is collected in a remaining-toner collector that the cleaning unit 4075 comprises.

===Overview of Control Unit===

Next, with reference to FIG. 29, the configuration of the control unit 4100 will be described. The main controller 4101 of the control unit 4100 is connected to the host computer through the interface 4112 and includes an image memory 4113 for storing image signals that have been input from the host computer. The unit controller 4102 is electrically connected to each of the units of the main apparatus (i.e., the charging unit 4030, the exposing unit 4040, the YMCK developing unit 4050, the first transferring unit 4060, the cleaning unit 4075, the second transferring unit 4080, the fusing unit 4090, and the displaying unit 4095). By receiving signals from sensors provided on each of the units, the unit controller 4102 detects the state of each unit and controls each unit according to the signals input from the main controller 4101.

===Configuration Example of Developing Device===

Figure 30:
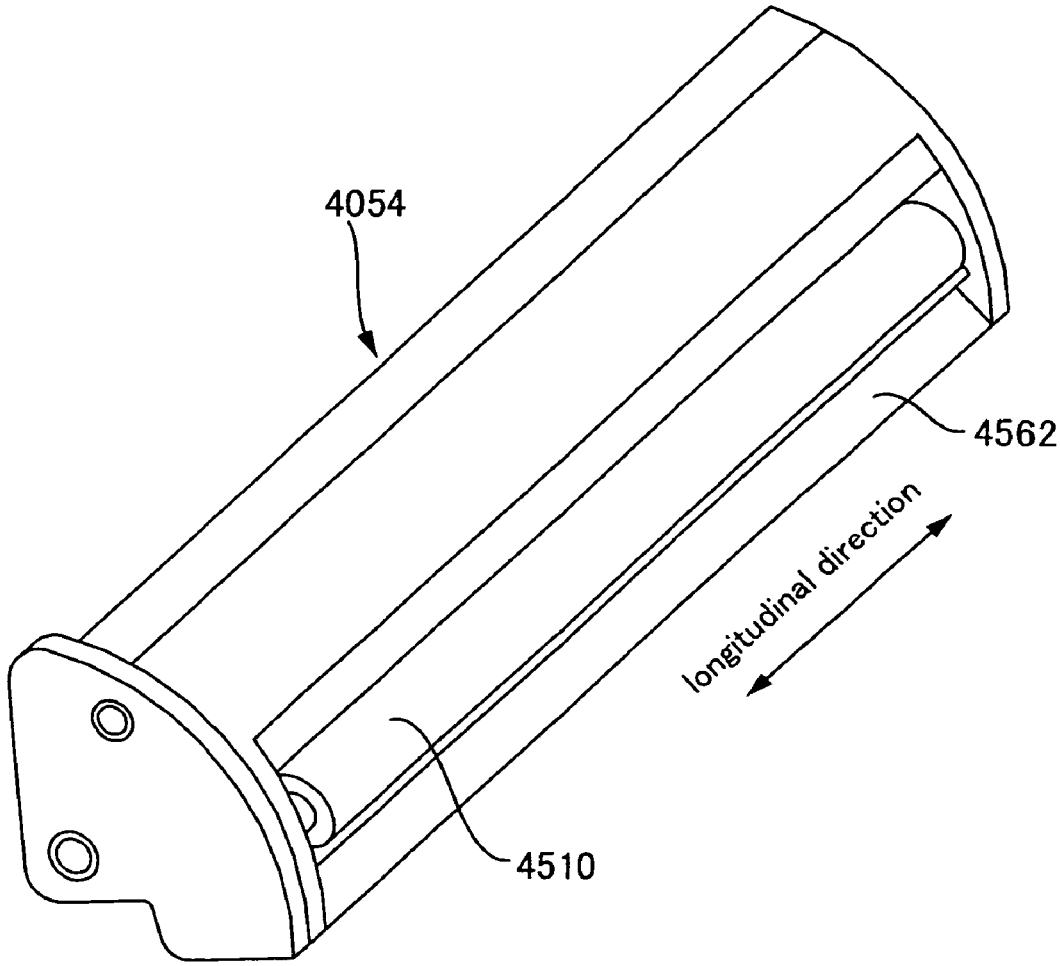
FIG. 30 is a conceptual diagram of a developing device.
Figure 31:
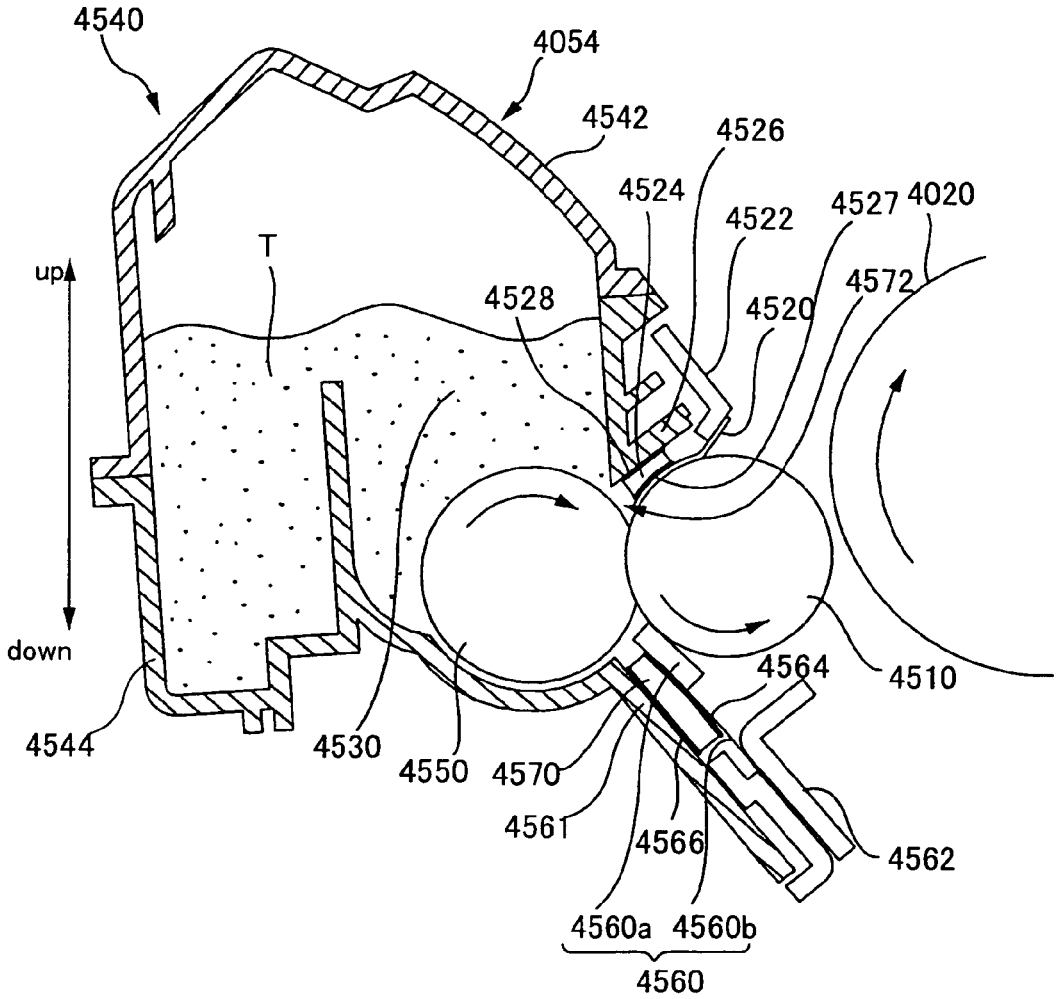
FIG. 31 is a section view showing main structural components of the developing device.

Next, using FIG. 30 and FIG. 31, an example of a configuration of the developing devices will be described. FIG. 30 is a conceptual diagram of a developing device. FIG. 31 is a section view showing main structural components of the developing device. Note that the section view shown in FIG. 31 is a section of the developing device bisected by a plane perpendicular to the longitudinal direction shown in FIG. 30. Further, in FIG. 31, the arrow indicates the vertical direction as in FIG. 28, and, for example, the central axis of the developing roller 4510 is located below the central axis of the photoconductor 4020. Further, in FIG. 31, the yellow developing device 4054 is shown to be in a state in which it is positioned at the developing position opposing the photoconductor 4020.

The YMCK developing unit 4050 comprises: the black developing device 4051 containing black (K) toner; the magenta developing device 4052 containing magenta (M) toner; the cyan developing device 4053 containing cyan (C) toner; and the yellow developing device 4054 containing yellow (Y) toner. Since the configuration of each of the developing devices is the same, explanation will be made only about the yellow developing device 4054 below.

The yellow developing device 4054 has, for example, the developing roller 4510, a toner collecting member 4520, which serves as an example of a developer collecting member, sealing members 4524 and 4570, a housing 4540, a toner supplying roller 4550, and a restriction blade 4560, which serves as an example of a thickness restricting member.

The developing roller 4510 bears toner T and delivers it to the developing position opposing the photoconductor 4020. The developing roller 4510 is made of metal and manufactured from, for example, aluminum alloy such as aluminum alloy 5056 or aluminum alloy 6063, or iron alloy such as STKM, and the roller 4510 is plated with, for example, nickel plating or chromium plating, as necessary.

Further, as shown in FIG. 30, the developing roller 4510 is supported at both ends in its longitudinal direction and is rotatable about its central axis. As shown in FIG. 31, the developing roller 4510 rotates in the opposite direction (counterclockwise in FIG. 31) to the rotating direction of the photoconductor 4020 (clockwise in FIG. 31). The central axis of the roller 4510 is located lower than the central axis of the photoconductor 4020. Further, as shown in FIG. 31, in the state where the yellow developing device 4054 opposes the photoconductor 4020, there is a gap between the developing roller 4510 and the photoconductor 4020. That is, the yellow developing device 4054 develops the latent image formed on the photoconductor 4020 in a non-contacting state. Note that an alternating field is generated between the developing roller 4510 and the photoconductor 4020 upon development of the latent image formed on the photoconductor 4020.

The toner collecting member 4520 abuts against the developing roller 4510 to collect the toner T, which is on the developing roller 4510 that has passed the developing position, into the developing device without scraping, and also to prevent the toner T in the yellow developing device 4054 from spilling out therefrom. The toner collecting member 4520 is a member made of, for example, polyethylene film. The toner collecting member 4520 is supported by a supporting metal plate 4522, and is attached to the housing 4540 via the supporting metal plate 4522. Note that the abutting position at which the toner collecting member 4520 abuts against the developing roller 4510 is situated higher than the central axis of the developing roller 4510.

Further, a sealing member 4524 which is made, for example, of Moltoprene is provided on the side opposite from the side of the developing roller 4510 with respect to the toner collecting member 4520. The sealing member 4524 prevents the toner T from spilling from between the toner collecting member 4520 and an opposing member 4526 that is arranged in opposition to the toner collecting member 4520 on the side opposite from the developing roller 4510 with respect to the toner collecting member 4520. The sealing member 4524 also presses the toner collecting member 4520 against the developing roller 4510 with its elastic force. It should be noted that the opposing member 4526 forms a portion of the housing 4540.

The sealing member 4524 is bonded to both the toner collecting member 4520 and the opposing member 4526 with a double-faced tape. That is, as shown in FIG. 31, the sealing member 4524 is bonded to the toner collecting member 4520 with a first double-faced tape 4527 and bonded to the opposing member 4526 with a second double-faced tape 4528.

Further, the first double-faced tape 4527 and the second double-faced tape 4528 are double-faced tapes having different characteristics. More specifically, the bond strength of the first double-faced tape 4527, which is for bonding the sealing member 4524 to the toner collecting member 4520, is different from that of the second double-faced tape 4528, which is for bonding the sealing member 4524 to the opposing member 4526. In the present embodiment, a double-faced tape having a peel adhesion of 5.4 N/20 mm is used as the first double-faced tape 4527, and a double-faced tape having a peel adhesion of 12.2 N/20 mm is used as the second double-faced tape 4528. It should be noted that both of the double-faced tapes have a thickness of 7 mm and their base material is nonwoven fabric.

The housing 4540 is manufactured by welding together a plurality of integrally-molded housing sections made of resin, that is, an upper housing section 4542 and a lower housing section 4544. As shown in FIG. 31, the housing 4540 has an opening 4572 opening toward the outside of the housing 4540. The above-mentioned developing roller 4510 is arranged from the outside of the housing 4540 with its peripheral surface facing the opening 4572 in such a state that a part of the roller 4510 is exposed to the outside. The restriction blade 4560, which is described in detail below, is also arranged from the outside of the housing 4540 facing the opening 4572.

Further, the housing 4540 forms a toner containing section 4530 that is capable of containing toner T. The toner containing section 4530 may be provided with a stirring member for stirring the toner T. In the present embodiment, however, a stirring member is not provided in the toner containing section 4530 because each of the developing devices (i.e., the black developing device 4051, the magenta developing device 4052, the cyan developing device 4053, and the yellow developing device 4054) is rotated with the rotation of the YMCK developing unit 4050 and thereby the toner T in each developing device is stirred.

The toner supplying roller 4550 is provided in the toner containing section 4530 described above and supplies the toner T contained in the toner containing section 4530 to the developing roller 4510. The toner supplying roller 4550 is made of, for example, polyurethane foam, and is made to abut against the developing roller 4510 in an elastically deformed state. The toner supplying roller 4550 is arranged at a lower section of the toner containing section 4530. The toner T contained in the toner containing section 4530 is supplied to the developing roller 4510 by the toner supplying roller 4550 at the lower section of the toner containing section 4530. The toner supplying roller 4550 is rotatable about a central axis. The central axis of the toner supplying roller 4550 is situated lower than the central axis of rotation of the developing roller 4510. Further, the toner supplying roller 4550 rotates in the opposite direction (clockwise in FIG. 31) to the rotating direction of the developing roller 4510 (counterclockwise in FIG. 31). Note that the toner supplying roller 4550 has the function of supplying the toner T contained in the toner containing section 4530 to the developing roller 4510 as well as the function of stripping off the toner T remaining on the developing roller 4510 after development from the developing roller 4510.

The restriction blade 4560 restricts the thickness of the layer of the toner T bore by the developing roller 4510 and also gives charge to the toner T bore by the developing roller 4510. This restriction blade 4560 has a rubber section 4560*a*, which serves as an example of an abutting section that abuts against the developing roller, and a rubber-supporting section 4560*b*, which serves as an example of a supporting section for supporting the abutting section. The rubber section 4560*a* is made of, for example, silicone rubber or urethane rubber. The rubber-supporting section 4560*b* is a thin metal plate that is made of, for example, phosphor bronze or stainless steel, and that has a springy characteristic. The rubber section 4560*a* is supported by the rubber-supporting section 4560*b*. The rubber-supporting section 4560*b* is attached to the housing 4540 via a pair of blade-supporting metal plates 4562 in a state that one end of the rubber-supporting section 4560*b* is pinched between and supported by the blade-supporting metal plates 4562. The rubber section 4560*a* is pressed against the developing roller 4510 by the elastic force caused by flexure of the rubber-supporting section 4560*b*.

Further, a sealing member 4570 which is made, for example, of Moltoprene is provided on the side opposite from the side of the developing roller 4510 with respect to the restriction blade 4560. The sealing member 4570 prevents the toner T from spilling from between the restriction blade 4560 and an opposing member 4561 that is arranged in opposition to the restriction blade 4560 on the side opposite from the developing roller 4510 with respect to the restriction blade 4560. The sealing member 4570 also applies force to the rubber section 4560*a* from the back thereof towards the developing roller 4510 to press the rubber section 4560*a* against the developing roller 4510. In this way, the sealing member 4570 makes the rubber section 4560*a* abut against the developing roller 4510 more evenly. It should be noted that the opposing member 4561 forms a portion of the housing 4540.

The sealing member 4570 is bonded to both the rubber-supporting section 4560*b* of the restriction blade 4560 and the opposing member 4561 with a double-faced tape. That is, as shown in FIG. 31, the sealing member 4570 is bonded to the rubber-supporting section 4560*b* of the restriction blade 4560 with a third double-faced tape 4564 and bonded to the opposing member 4561 with a fourth double-faced tape 4566.

Further, the third double-faced tape 4564 and the fourth double-faced tape 4566 are double-faced tapes having different characteristics. More specifically, the bond strength of the third double-faced tape 4564, which is for bonding the sealing member 4570 to the restriction blade 4560, is different from that of the fourth double-faced tape 4566, which is for bonding the sealing member 4570 to the opposing member 4561. In the present embodiment, the bond strength of the third double-faced tape 4564 is smaller than the bond strength of the fourth double-faced tape 4566, and more specifically, a double-faced tape having a peel adhesion of 5.4 N/20 mm is used as the third double-faced tape 4564, and a double-faced tape having a peel adhesion of 12.2 N/20 mm is used as the fourth double-faced tape 4566. It should be noted that both of the double-faced tapes have a thickness of 7 mm and their base material is non-woven fabric.

The end of the restricting blade 4560 opposite to the end that is being supported by the blade-supporting metal plates 4562, i.e., the tip end, is not placed in contact with the developing roller 4510; rather, a section at a predetermined distance from the tip end contacts, with some breadth, the developing roller 4510. That is, the restriction blade 4560 does not abut against the developing roller 4510 at its edge, but abuts against the roller 4510 near its central portion. Further, the restriction blade 4560 is arranged so that its tip end faces towards the upper stream of the rotating direction of the developing roller 4510, and thus, makes a so-called counter-abutment with respect to the roller 4510. It should be noted that the abutting position at which the restriction blade 4560 abuts against the developing roller 4510 is lower than the central axis of the developing roller 4510 and is also lower than the central axis of the toner supplying roller 4550.

In the yellow developing device 4054 thus structured, the toner supplying roller 4550 supplies the toner T contained in the toner containing section 4530 to the developing roller 4510. With the rotation of the developing roller 4510, the toner T, which has been supplied to the developing roller 4510, reaches the abutting position of the restriction blade 4560; then, as the toner T passes the abutting position, the toner is charged and its layer thickness is restricted. With further rotation of the developing roller 4510, the toner Ton the developing roller 4510, whose layer thickness has been restricted, reaches the developing position opposing the photoconductor 4020; then, under the alternating field, the toner T is used at the developing position for developing the latent image formed on the photoconductor 4020. With further rotation of the developing roller 4510, the toner T on the developing roller 4510, which has passed the developing position, passes the toner collecting member 4520 and is collected into the developing device by the toner collecting member 4520 without being scraped off. Then, the toner T that still remains on the developing roller 4510 can be stripped off by the toner supplying roller 4550.

As described above, by bonding the sealing member to both the abutting member and the opposing member, it is possible to allow the functions of the abutting member to be achieved effectively as well as appropriately prevent the toner from spilling.

As described in the section of the "Description of the Related Art", there are cases in which the sealing member is arranged bonded to one of either the abutting member or the opposing member, for example. In such a case, it is necessary to provide the sealing member in the developing device in such a state that the sealing member is highly compressed by the abutting member and the opposing member in order to appropriately prevent the toner from spilling from between the abutting member and the opposing member (particularly from between the sealing member and the member to which the sealing member is not bonded).

In such a situation, the abutting member receives a great force from the compressed sealing member. Therefore, a problem that the functions to be achieved by the abutting member abutting against the developer bearing body are not obtained appropriately may arise. For example, when the restriction blade serves as the abutting member, there is a possibility that an excessive restriction load is applied on the restriction blade and that it will become difficult to restrict the layer thickness of the toner appropriately. Further, when the toner collecting member serves as the abutting member, there is a possibility that it will become difficult to collect the toner into the developing device appropriately. Further, if the force applied from the compressed sealing member is even greater, then the restriction blade and the toner collecting member will deform and the functions of these members will be further impaired.

On the contrary, if the sealing member is bonded to both the abutting member and the opposing member as described above, then it is no longer necessary for the sealing member in the developing device to be provided in a state in which it is highly compressed by the abutting member and the opposing member in order to appropriately prevent the toner from spilling from between the abutting member and the opposing member. In other words, the sealing member can appropriately prevent the toner from spilling from between the abutting member and the opposing member, even when the sealing member is provided in the developing device in a less-compressed state.

In such a situation, the force that is applied from the compressed sealing member to the abutting member becomes small. Therefore, the functions that are to be achieved by the abutting member abutting against the developer bearing body are obtained appropriately. That is, when the abutting member is the restriction blade, the restriction blade can appropriately restrict the layer thickness of the toner, and when the abutting member is the toner collecting member, the toner collecting member can appropriately collect the toner into the developing device.

That is, with the developing device etc. according to the present embodiment, it becomes possible to allow the functions of the abutting member, which abuts against the developing roller, to be achieved effectively and appropriately prevent the toner from spilling.

===Other Considerations===

In the foregoing, an image forming apparatus etc. according to the present invention was described according to the above-described embodiment thereof. However, the foregoing embodiment of the invention is for the purpose of facilitating understanding of the present invention and is not to be interpreted as limiting the present invention. The present invention can be altered and improved without departing from the gist thereof, and needless to say, the present invention includes its equivalents.

In the foregoing embodiment, an intermediate transferring type full-color laser beam printer was described as an example of the image forming apparatus, but the present invention is also applicable to various other types of image forming apparatuses, such as full-color laser beam printers that are not of the intermediate transferring type, monochrome laser beam printers, copying machines, and facsimiles.

Further, in the foregoing embodiment, an image forming apparatus provided with a rotary-type developing device was described as an example. This, however, is not a limitation, and the present invention is applicable to, for example, image forming apparatuses provided with tandem-type developing devices.

Further, the photoconductor is not limited to the so-called photoconductive roller structured by providing a photoconductive layer on the outer peripheral surface of a cylindrical, conductive base. The photoconductor can be a so-called photoconductive belt structured by providing a photoconductive layer on a surface of a belt-like conductive base.

Further, in the foregoing embodiment, an example in which a restriction blade for restricting the layer thickness of toner bore by a developing roller serves as the abutting member and an example in which a toner collecting member for collecting the toner bore by the developing roller into the developing device were described. This, however, is not a limitation, and the present invention is applicable to other members as long as they are abutting members that abut against the developing roller.

Further, in the foregoing embodiment, the sealing member was bonded to both the abutting member and the opposing member by a double-faced tape. This, however, is not a limitation. For example, the sealing member may be bonded to both the abutting member and the opposing member with an adhesive.

The foregoing embodiment, however, is more preferable in terms that by bonding the sealing member with a double-faced tape, handling upon manufacture etc. becomes easy.

Further, in the foregoing embodiment, the bond strength of the double-faced tape for bonding the sealing member to the abutting member was different from the bond strength of the double-faced tape for bonding the sealing member to the opposing member. This, however, is not a limitation. For example, the bond strength of the double-faced tape for bonding the sealing member to the abutting member may be made to be the same as the bond strength of the double-faced tape for bonding the sealing member to the opposing member, for example, by using double-faced tapes having the same model number for bonding the sealing member to the abutting member and for bonding the sealing member to the opposing member.

However, when the developing device is disassembled for disposal, recycling, or reuse, for example, the developing device will be disassembled with the sealing member bonded to only the member, between the abutting member and the opposing member, to which the sealing member is bonded with the double-faced tape having a larger bond strength, if the bond strength of the double-faced tape for bonding the sealing member to the abutting member is made to be different from the bond strength of the double-faced tape for bonding the sealing member to the opposing member. That is, the developing device will be disassembled with the sealing member always bonded to a predetermined member, and therefore, the time and effort necessary for disassembling the developing device for discarding, recycling, or reusing the device, for example, are reduced. The foregoing embodiment is therefore more preferable.

Figure 32:
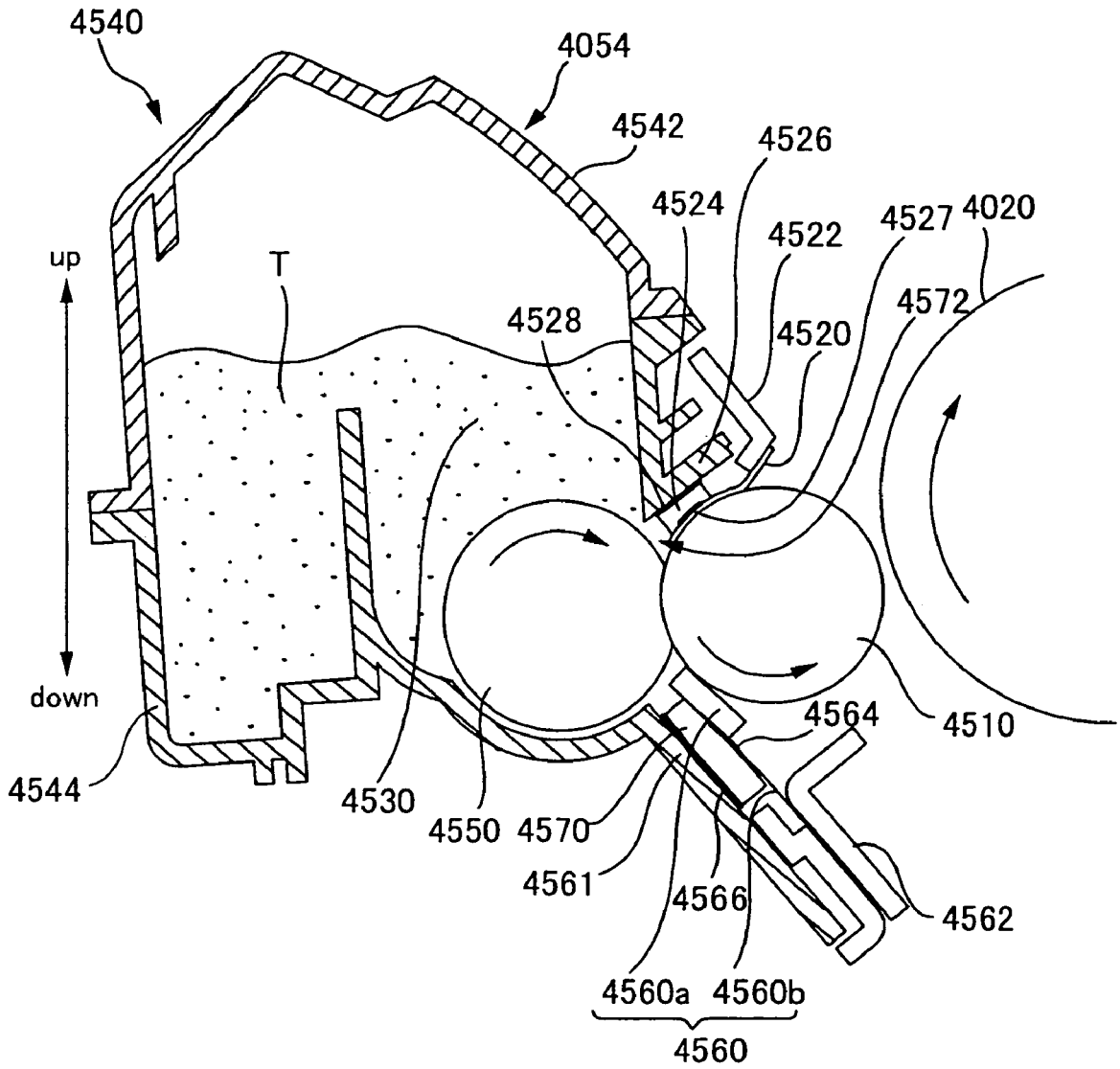
FIG. 32 is a section view showing main structural components of another developing device.

Further, the area of the double-faced tape in which the sealing member is bonded to the abutting member may be made different from the area of the double-faced tape in which the sealing member is bonded to the opposing member as shown in FIG. 32 in order to achieve the above-mentioned effects. In the example shown in FIG. 32, the area of the double-faced tape in which the sealing member is bonded to the abutting member is smaller than the area of the double-faced tape in which the sealing member is bonded to the opposing member.

With this configuration, when the developing device is disassembled for disposal, recycling, or reuse, for example, the developing device will be disassembled with the sealing member bonded to the opposing member. That is, the developing device will be disassembled with the sealing member always bonded to the opposing member, and therefore, the time and effort necessary for disassembling the developing device for discarding, recycling, or reusing the device, for example, are reduced. The present embodiment is therefore preferable. It should be noted that FIG. 32 is a section view showing main structural components of this developing device.

Further, in the foregoing embodiment, the bond strength of the double-faced tape for bonding the sealing member to the restriction blade was made to be smaller than the bond strength of the double-faced tape for bonding the sealing member to the opposing member. This, however, is not a limitation. For example, the bond strength of the double-faced tape for bonding the sealing member to the restriction blade may be larger than the bond strength of the double-faced tape for bonding the sealing member to the opposing member.

If, however, the bond strength of the double-faced tape for bonding the sealing member to the restriction blade is smaller than the bond strength of the double-faced tape for bonding the sealing member to the opposing member, then upon disassembly of the developing device, the device will be disassembled with the sealing member bonded to the opposing member.

The foregoing embodiment is more preferable in terms that the time and effort for work relating to recycling and reuse of the restriction blade are reduced, because upon disassembly of the developing device, the sealing member is removed first from the restriction blade, for which the demand for recycling or reuse is higher than the opposing member (i.e., the housing).

Further, in the foregoing embodiment, the bond strength of the double-faced tape for bonding the sealing member to the restriction blade was made to be smaller than the bond strength of the double-faced tape for bonding the sealing member to the opposing member, the sealing member was bonded to both the rubber-supporting section of the restriction blade and the opposing member by the double-faced tape, the rubber-supporting section was made of metal, and the opposing member was made of resin. This, however, is not a limitation.

The foregoing embodiment, however, is more preferable in terms that the time and effort for work relating to recycling and reuse of metal are reduced, because upon disassembly of the developing device, the sealing member is removed first from the metal, for which the demand for recycling or reuse is higher than resin.

<<<Configuration of Image Forming System etc.>>>

Next, an embodiment of an image forming system, which serve as an example of an embodiment of the present invention, is described with reference to the drawings.

Figure 33:
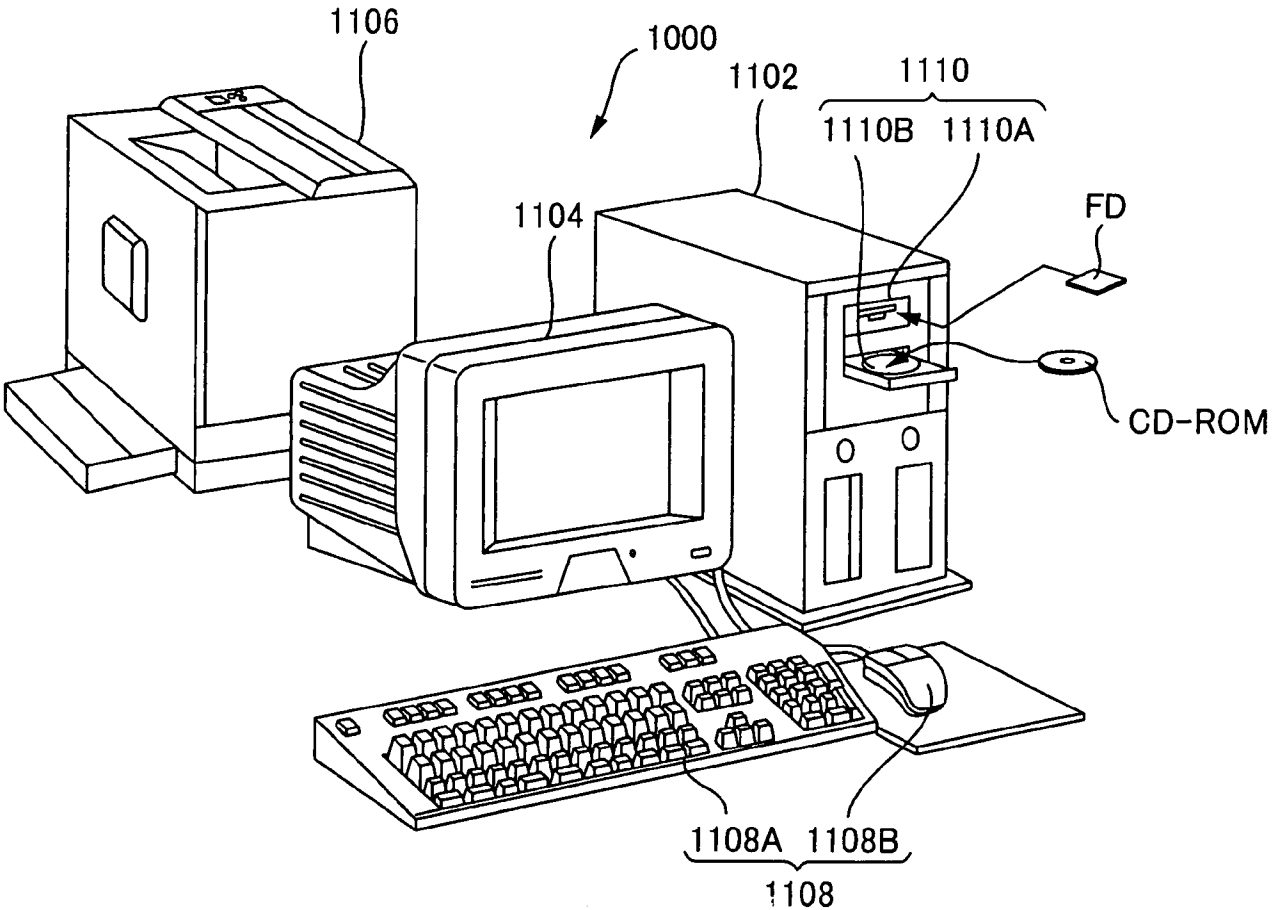
FIG. 33 is an explanatory diagram showing an external configuration of an image forming system.

FIG. 33 is an explanatory drawing showing an external structure of an image forming system. The image forming system 1000 comprises a computer 1102, a display device 1104, a printer 1106, an input device 1108, and a reading device 1110. In this embodiment, the computer 1102 is accommodated in a mini-tower type housing, but this is not a limitation. A CRT (cathode ray tube), a plasma display, or a liquid crystal display device, for example, is generally used as the display device 1104, but this is not a limitation. The printer described above is used as the printer 1106. In this embodiment, a keyboard 1108A and a mouse 1108B are used as the input device 1108, but this is not a limitation. In this embodiment, a flexible disk drive device 1110A and a CD-ROM drive device 1110B are used as the reading device 1110, but the reading device is not limited to these, and it may also be other devices such as a MO (magneto optical) disk drive device and a DVD (digital versatile disk).

Figure 34:
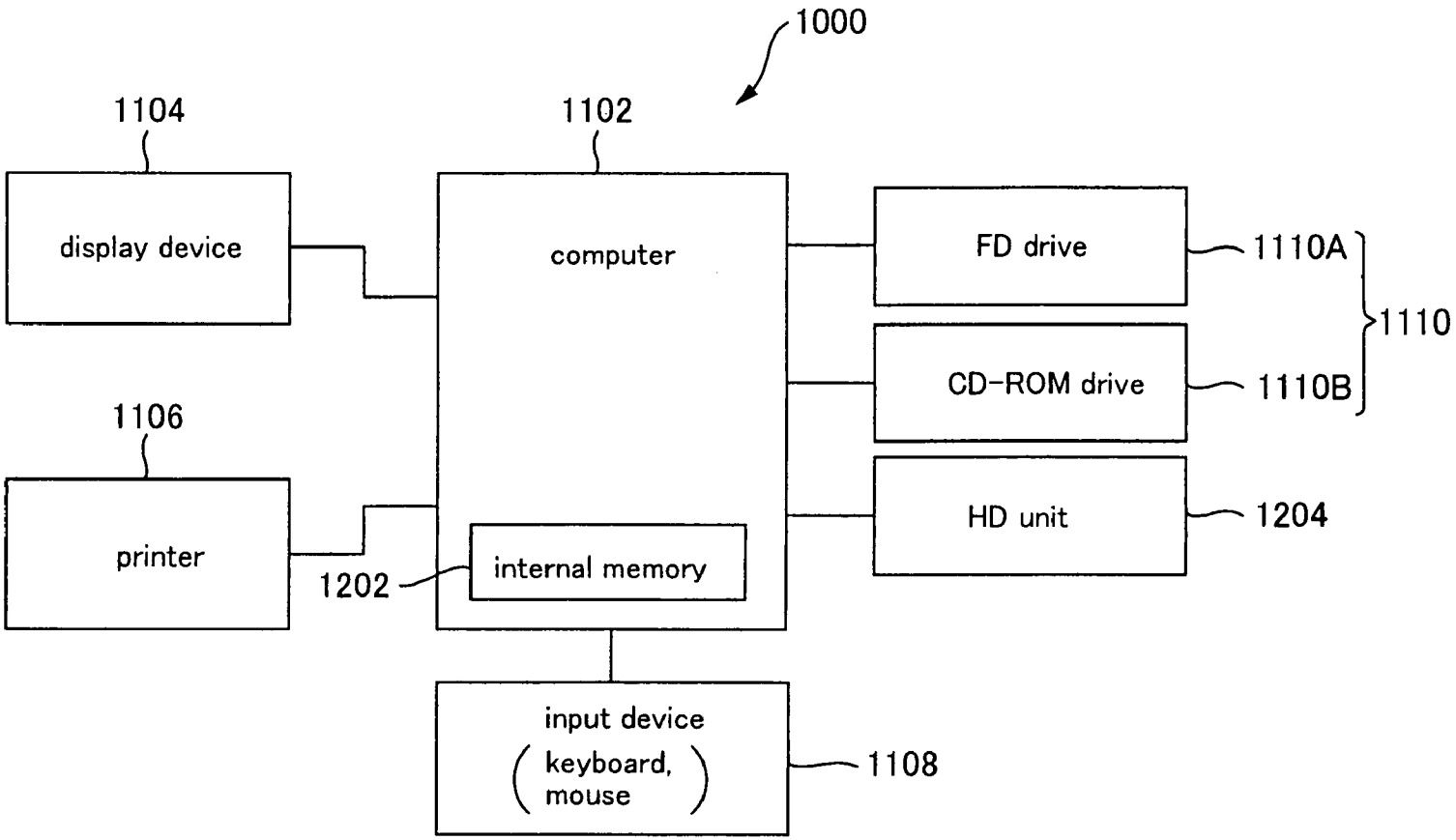
FIG. 34 is a block diagram showing a configuration of the image forming system shown in FIG. 33.

FIG. 34 is a block diagram showing a configuration of the image forming system shown in FIG. 33. Further provided are an internal memory 1202, such as a RAM inside the housing accommodating the computer 1102, and an external memory such as a hard disk drive unit 1204.

It should be noted that in the above description, an example in which the image forming system is structured by connecting the printer 1106 to the computer 1102, the display device 1104, the input device 1108, and the reading device 1110 was described, but this is not a limitation. For example, the image forming system can be made of the computer 1102 and the printer 1106, or the image forming system does not have to comprise any one of the display device 1104, the input device 1108, and the reading device 1110.

Further, for example, the printer 1106 can have some of the functions or mechanisms of the computer 1102, the display device 1104, the input device 1108, and the reading device 1110. As an example, the printer 1106 may be configured so as to have an image processing section for carrying out image processing, a displaying section for carrying out various types of displays, and a recording media attach/detach section to and from which recording media storing image data captured by a digital camera or the like are inserted and taken out.

As an overall system, the image forming system that is achieved in this way becomes superior to conventional systems.

What is claimed is:

1. An image forming apparatus comprising:

a photoconductor on which a latent image is formed;

a movable moving body to and from which a developer container for containing developer can be attached and detached, and a fusing unit for fusing a developer image corresponding to the latent image onto a medium, wherein before detachment of said developer container that is attached to said moving body, said image forming apparatus temporarily halts said moving body at least once while said moving body moves from a position at which said image forming apparatus is instructed to perform detachment of said developer container to a predetermined detachment position at which said developer container can be detached.

2. An image forming apparatus according to claim 1, wherein:

said developer container has a storage element for storing information about said developer container; and said image forming apparatus carries out communication with said storage element when said image forming apparatus temporarily halts said moving body while said moving body moves to said predetermined detachment position.

3. An image forming apparatus according to claim 1, wherein a movement speed at which said moving body moves to said predetetmined detachment position reaches its maximum right before said image forming apparatus temporarily halts said moving body at least once.

4. An image forming apparatus according to claim 3, wherein:

a plurality of the developer containers can be attached to and detached from said moving body, each of said developer containers being capable of containing developer of a different color; and said movement speed that has reached its maximum right before said image forming apparatus temporarily halts said moving body at least once is approximately the same as a movement speed at which said moving body moves when an image is formed on a medium using the developers of the plurality of the different colors that are contained in said plurality of developer containers attached to said moving body.

5. An image forming apparatus according to claim 1, wherein:

said moving body is a rotatable rotating body;

said rotating body has a rotating shaft at the center of said rotating body, an axial direction of said rotating shaft intersecting with the vertical direction; and the developer container that is to be detached is positioned lower, in the vertical direction, than said rotating shaft when said image forming apparatus temporarily halts said rotating body while said rotating body rotationally moves to said predetermined detachment position.

6. An image forming apparatus according to claim 5, wherein said image forming apparatus further comprises a developer receiving member that is for receiving the developer and that is positioned at a lower side, in the vertical direction, of said rotating body.

7. An image forming apparatus according to claim 5, wherein:

said developer container has a developer bearing body for bearing the developer, and an opening towards which said developer bearing body faces; and said opening of the developer container that is to be detached is positioned at a lower side, in the vertical direction, of said developer container when said image forming apparatus temporarily halts said rotating body while said rotating body rotationally moves to said predetermined detachment position.

8. An image forming apparatus according to claim 7, wherein said opening of said developer container that is to be detached is positioned at an upper side, in the vertical direction, of said developer container when said rotating body has rotationally moved to said predetermined detachment position.

9. An image forming apparatus according to claim 7, wherein:

said developer container includes a developer charging member that is for electrically charging the developer bore by said developer bearing body, and that has an abutting member that abuts against said developer bearing body, and a supporting member for supporting said abutting member;

said developer charging member faces said opening from the outside; and said supporting member has a slide member on the surface thereof for causing the developer to slide.

10. An image forming apparatus according to claim 1, wherein a halt position of said moving body for when said image forming apparatus temporarily halts said moving body while said moving body moves to said predetermined detachment position is a standby position of said moving body for when said image forming apparatus is on standby for formation of an image to be carried out.

11. An image forming apparatus according to claim 10, wherein:

said moving body is a rotatable rotating body;

said rotating body has a rotating shaft at the center of said rotating body, an axial direction of said rotating shaft intersecting with the vertical direction;

a plurality of the developer containers can be attached to and detached from said rotating body, each of said developer containers being capable of containing developer of a different color; and the developer container for containing black developer is positioned lower, in the vertical direction, than said rotating shaft when said image forming apparatus temporarily halts said rotating body at said standby position.

12. An image forming apparatus according to claim 1, wherein:

a plurality of the developer containers can be attached to and detached from said moving body, each of said developer containers being capable of containing developer of a different color;

said image forming apparatus has a plural-color image-forming mode in which said image forming apparatus forms an image on a medium using the developers of the plurality of the different colors that are contained in said plurality of developer containers attached to said moving body, and a single-color image-forming mode in which said image forming apparatus forms an image on a medium using developer that is of a single color and that is contained in one of said plurality of developer containers attached to said moving body; and said image forming apparatus temporarily halts said moving body at least once while said moving body moves to said predetermined detachment position if the image-forming mode of said image forming apparatus right before the detachment of said developer container is said single-color image-forming mode, and the developer container that is to be detached is the developer container that contains said developer of the single color.

13. An image forming apparatus according to claim 1, wherein:

a plurality of the developer containers can be attached to and detached from said moving body, each of said developer containers being capable of containing developer of a different color; and said image forming apparatus temporarily halts said moving body at least once while said moving body moves to said predetermined detachment position if the developer container that is to be detached is the developer container that contains black developer.

14. An image forming apparatus comprising a movable moving body to and from which a developer container for containing developer can be attached and detached, wherein:

before detachment of said developer container that is attached to said moving body, said image forming apparatus temporarily halts said moving body at least once while said moving body moves to a predetermined detachment position at which said developer container can be detached;

said developer container has a storage element for storing information about said developer container;

said image forming apparatus carries out communication with said storage element when said image forming apparatus temporarily halts said moving body while said moving body moves to said predetermined detachment position;

a movement speed at which said moving body moves to said predetermined detachment position reaches its maximum right before said image forming apparatus temporarily halts said moving body at least once;

a plurality of the developer containers can be attached to and detached from said moving body, each of said developer containers being capable of containing developer of a different color;

said movement speed that has reached its maximum right before said image forming apparatus temporarily halts said moving body at least once is approximately the same as a movement speed at which said moving body moves when an image is formed on a medium using the developers of the plurality of the different colors that are contained in said plurality of developer containers attached to said moving body;

said moving body is a rotatable rotating body;

said rotating body has a rotating shaft at the center of said rotating body, an axial direction of said rotating shaft intersecting with the vertical direction;

the developer container that is to be detached is positioned lower, in the vertical direction, than said rotating shaft when said image forming apparatus temporarily halts said rotating body while said rotating body rotationally moves to said predetermined detachment position;

said image forming apparatus further comprises a developer receiving member that is for receiving the developer and that is positioned at a lower side, in the vertical direction, of said rotating body;

said developer container has a developer bearing body for bearing the developer, and an opening towards which said developer bearing body faces;

said opening of the developer container that is to be detached is positioned at a lower side, in the vertical direction, of said developer container when said image forming apparatus temporarily halts said rotating body while said rotating body rotationally moves to said predetermined detachment position; and said opening of said developer container that is to be detached is positioned at an upper side, in the vertical direction, of said developer container when said rotating body has rotationally moved to said predetermined detachment position.

15. An image forming apparatus comprising a movable moving body to and from which a developer container for containing developer can be attached and detached, wherein:

before detachment of said developer container that is attached to said moving body, said image forming apparatus temporarily halts said moving body at least once while said moving body moves from a position at which said image forming apparatus is instructed to perform detachment of said developer container to a predetermined detachment position at which said developer container can be detached;

a halt position of said moving body for when said image forming apparatus temporarily halts said moving body while said moving body moves to said predetermined detachment position is a standby position of said moving body for when said image forming apparatus is on standby for formation of an image to be carried out;

said moving body is a rotatable rotating body;

said rotating body has a rotating shaft at the center of said rotating body, an axial direction of said rotating shaft intersecting with the vertical direction;

a plurality of the developer containers can be attached to and detached from said rotating body, each of said developer containers being capable of containing developer of a different color; and the developer container for containing black developer is positioned lower, in the vertical direction, than said rotating shaft when said image forming apparatus temporarily halts said rotating body at said standby position.

16. An image forming apparatus comprising a movable moving body to and from which a developer container for containing developer can be attached and detached, wherein:

before detachment of said developer container that is attached to said moving body, said image forming apparatus temporarily halts said moving body at least once while said moving body moves from a position at which said image forming apparatus is instructed to perform detachment of said developer container to a predetermined detachment position at which said developer container can be detached;

a plurality of the developer containers can be attached to and detached from said moving body, each of said developer containers being capable of containing developer of a different color;

said image forming apparatus has a plural-color image-forming mode in which said image forming apparatus forms an image on a medium using the developers of the plurality of the different colors that are contained in said plurality of developer containers attached to said moving body, and a single-color image-forming mode in which said image forming apparatus forms an image on a medium using developer that is of a single color and that is contained in one of said plurality of developer containers attached to said moving body;

said image forming apparatus temporarily halts said moving body at least once while said moving body moves to said predetermined detachment position if the image-forming mode of said image forming apparatus right before the detachment of said developer container is said single-color image-forming mode, and the developer container that is to be detached is the developer container that contains said developer of the singe color; and said image forming apparatus temporarily halts said moving body at least once while said moving body moves to said predetermined detachment position if the developer container that is to be detached is the developer container that contains black developer.

17. An image forming apparatus comprising a photoconductor on which a latent image is formed;

a movable moving body that is provided with a developer container for containing developer, and a fusing unit for fusing a developer image corresponding to the latent image onto a medium, wherein before detachment of said developer container that is attached to said moving body, said image forming apparatus temporarily halts said moving body at least once while said moving body moves from a position at which said image forming apparatus in instructed to perform detachment of said developer container to a predetermined detachment position at which said developer container can be detached.

18. An image forming system comprising:

a computer;

a display device that is connectable to said computer; and an image forming apparatus, wherein: said image forming apparatus is connectable to said computer; said image forming apparatus includes a photoconductor on which a latent image is formed; a movable moving body to and from which a developer container for containing developer can be attached and detached; a fusing unit for fusing a developer image corresponding to the latent image onto a medium, wherein before detachment of said developer container that is attached to said moving body, said image forming apparatus temporarily halts said moving body at least once while said moving body moves from a position at which said image forming apparatus is instructed to perform detachment of said developer container to a predetermined detachment position at which said developer container can be detached.

* * * * *